US010570677B2

(12) United States Patent
Richardson et al.

(10) Patent No.: US 10,570,677 B2
(45) Date of Patent: Feb. 25, 2020

(54) HIGH EFFICIENCY DRILLING AND TRIPPING SYSTEM

(71) Applicant: WARRIOR RIG TECHNOLOGIES LIMITED, Calgary (CA)

(72) Inventors: Allan Stewart Richardson, The Woodlands, TX (US); Peter Ernest James Root, Calgary (CA)

(73) Assignee: Warrior Rig Technologies Limited, Calgary (CA)

( * ) Notice: Subject to any disclaimer, the term of this patent is extended or adjusted under 35 U.S.C. 154(b) by 146 days.

(21) Appl. No.: 15/580,619

(22) PCT Filed: Jun. 10, 2016

(86) PCT No.: PCT/CA2016/050672

§ 371 (c)(1),
(2) Date: Dec. 7, 2017

(87) PCT Pub. No.: WO2016/197255

PCT Pub. Date: Dec. 15, 2016

(65) Prior Publication Data

US 2018/0179833 A1 Jun. 28, 2018

Related U.S. Application Data

(60) Provisional application No. 62/173,580, filed on Jun. 10, 2015, provisional application No. 62/205,594, filed on Aug. 14, 2015.

(51) Int. Cl.
*E21B 19/084* (2006.01)
*E21B 19/06* (2006.01)
(Continued)

(52) U.S. Cl.
CPC ..... *E21B 19/06* (2013.01); *E21B 3/02* (2013.01); *E21B 15/00* (2013.01); *E21B 19/00* (2013.01);
(Continued)

(58) Field of Classification Search
CPC ..... E21B 19/008; E21B 19/02; E21B 19/08; E21B 19/084; E21B 19/16; E21B 19/06
See application file for complete search history.

(56) References Cited

U.S. PATENT DOCUMENTS 2,781,185 A * 2/1957 Robbins ..... E21B 19/084 173/147
3,002,560 A * 10/1961 Paget ..... E21B 3/00 166/77.51
(Continued)

FOREIGN PATENT DOCUMENTS

GB 2472929 A 2/2011
WO 2012128735 A1 9/2012

*Primary Examiner* — Kenneth L Thompson
(74) *Attorney, Agent, or Firm* — Oyen Wiggs Green & Mutala LLP

(57) ABSTRACT

Apparatus for use in subsurface drilling permits coupling and uncoupling of drill string sections while continuously moving the drill string. Tripping times can be reduced while maintaining low speeds of the drill string. In one embodiment coupling units operable to make or break couplings between drill string sections are arranged to circulate around a closed path. Each of the coupling units includes an elevator. Drill string sections may be passed off to a pipe handling system on a back side of the apparatus.

65 Claims, 56 Drawing Sheets

(51) Int. Cl.

| | |
|---|---|
| ***E21B 19/16*** | (2006.01) |
| ***E21B 19/14*** | (2006.01) |
| ***E21B 21/01*** | (2006.01) |
| ***E21B 19/00*** | (2006.01) |
| ***E21B 3/02*** | (2006.01) |
| ***E21B 15/00*** | (2006.01) |

(52) U.S. Cl.
CPC ..... *E21B 19/14* (2013.01); *E21B 19/161* (2013.01); *E21B 21/01* (2013.01)

(56) References Cited

U.S. PATENT DOCUMENTS

| | | | | |
|---|---|---|---|---|
| 3,857,450 | A | 12/1974 | Guier | |
| 4,024,925 | A * | 5/1977 | Brown | E21B 19/084 175/85 |
| 4,267,675 | A * | 5/1981 | Cochran | E21B 7/023 212/348 |
| 4,491,450 | A * | 1/1985 | George | E21B 19/155 104/112 |
| 4,701,869 | A | 10/1987 | Callegari, Sr. et al. | |
| 7,404,697 | B2 * | 7/2008 | Thompson | E21B 19/155 414/22.58 |
| 8,463,664 | B2 | 6/2013 | Griggs et al. | |
| 8,844,616 | B2 | 9/2014 | Krohn et al. | |
| 8,955,602 | B2 | 2/2015 | Pilgrim | |
| 2005/0230109 | A1 | 10/2005 | Kammann et al. | |
| 2010/0171593 | A1 | 7/2010 | Zierolf | |
| 2014/0124218 | A1 | 5/2014 | Pilgrim | |
| 2014/0138081 | A1 | 5/2014 | Yorga et al. | |

* cited by examiner

HIGH EFFICIENCY DRILLING AND TRIPPING SYSTEM

CROSS-REFERENCE TO RELATED APPLICATIONS

This application claims priority from U.S. patent application No. 62/173,580 filed on 10 Jun. 2015 and U.S. patent application No. 62/205,594 filed on 14 Aug. 2015 both of which are hereby incorporated herein by reference for all purposes. For purposes of the United States of America, this application claims the benefit of U.S. patent application No. 62/173,580 filed on 10 Jun. 2015 and U.S. patent application No. 62/205,594 filed on 14 Aug. 2015.

FIELD

This invention relates to subsurface drilling. Example applications are drilling for petroleum and/or natural gas. The application relates to apparatus and methods for handling tubular strings (e.g. drill string sections, casing or the like).

BACKGROUND

Subsurface drilling uses a drill string made up of a series of sections that are connected to one another end-to-end. The sections that couple together longitudinally to make a drill string may be called various names including "drill string sections", "joints", "tubulars", "drill pipes", or "drill collars". Most commonly, the sections each have a pin end and a box end with complementary threads that are screwed together. The threads are commonly API standard threads.

When a well is being drilled, a drill bit is provided at the downhole end of the drill string. The drill bit drills a borehole that is somewhat larger in diameter than the drill string such that there is an annulus surrounding the drill string in the borehole. As the well is drilled, drilling fluid is pumped down through the drill string to the drill bit where it exits and returns to the surface through the annulus. The drilling fluid serves to counteract downhole pressures and keep the wellbore open. The drilling fluid also carries rock and other cuttings to the surface. As drilling progresses and the well bore gets deeper, new drill string segments are added at the uphole end of the drill string.

The first (farthest downhole) sections of a drill string are typically made up of heavy drill collars which, through their weight, apply pressure to the drill bit. This part of the drill string is typically called a bottom hole assembly or "BHA". Above the BHA, the drill string sections may be lighter in weight.

Drilling is typically done using a drill rig. The drill rig includes equipment for rotating the drill string. In some cases, this equipment comprises a rotary table. In other cases, this equipment comprises a top drive. In either case, at the drill rig, as drilling progresses, new sections are added to the top of the drill string. This is done using equipment on the drill rig. Adding a new section typically involves supporting the drill string, uncoupling the top end of the drill string from the kelly or top drive that was supporting it, coupling a new section to the top end of the drill string, connecting the uphole end of the new section to the kelly or top drive and resuming drilling. Typically the weight of the drill string is carried by slips on the drill rig floor while a new section is being added to the drill string.

Periodically, as drilling progresses, it is usually necessary to retrieve the drill string from the well bore. This may be required, for example, to replace the drill bit if the drill bit is becoming worn. This also may be required in cases where there is downhole equipment of some kind that needs to be retrieved to the surface for servicing. The process of bringing a drill string back to the surface and returning the drill string into a partially completed well bore is called "tripping". Since well bores may be many thousands of feet deep, tripping may take a long time to complete. Operating a drill rig is very expensive. Consequently, tripping can contribute large costs.

Some systems have been proposed for making tripping a drill string more efficient. These include U.S. Pat. No. 8,844,616 and US20140124218. These systems have various disadvantages. Practical alternatives to these systems are required.

There is a general need for ways to improve the efficiency of subsurface drilling. There is a particular need to reduce the time taken to trip a drill string.

SUMMARY

This invention has a number of aspects. While these aspects may be practiced in various combinations with one another, a number of these aspects can be applied individually. By way of non-limiting example, some aspects described herein include:

- Methods for tripping drill strings (in and/or out);
- Methods for subsurface drilling.
- Apparatus useful for tripping a drill string.
- Apparatus useful for subsurface drilling.
- Methods for supporting drill strings or drill string segments.
- Elevators useful for supporting drill strings or drill string segments.
- Apparatus useful for supporting top drives.
- Methods for using top drives.
- Crossheads useful for supporting apparatus in a drill rig.
- Methods for collecting drilling fluid while tripping a drill string.
- Apparatus for collecting drilling fluid while tripping a drill string.
- Apparatus for supporting a load by way of a chain.
- Methods for supplying power to moving units.
- Apparatus for supplying power to moving units.
- Apparatus useful for delivering equipment (e.g. top drives, mud cans or the like) to well center in a drilling environment.
- Methods for delivering equipment (e.g. top drives, mud cans or the like) to well center.

One aspect provides methods for tripping a drill string or other tubular string (casing is another example of a tubular string). The tubular string may comprise coupled-together separate sections or may be a continuous tubular string (e.g. a string of drill pipes welded end-to end of arbitrary length). A method for tripping a tubular string may comprise providing a circulating member supporting a plurality of elevators, moving the circulating member to cause the elevators to circulate along a closed path. While moving the circulating member, a first one of the elevators may engage the tubular string at a first location and a second one of the elevators may engage the tubular string at a second location. The first and second locations optionally correspond to first and second tool joints of the drill string. The weight of the drill string is initially supported on the first one of the elevators and is then transferred to the second one of the elevators. The method may optionally comprise additional steps. Various additional steps are described below. One skilled in the art would understand that the steps below can be added to the methods for tripping a drill string in any logical combination or order.

In some embodiments, after transferring the weight of the drill string to the second one of the elevators, a connection of a drill string section containing the first tool joint is unmade from a drill string section containing the second tool joint. Unmaking the connection may comprise gripping the second tool joint with a backup jaw, gripping the drill string section with a rotary jaw and turning the rotary jaw relative to the backup jaw. Unmaking the connection may be performed while moving the circulating member such that the second one of the elevators lifts the drill string while the connection is unmade.

In some embodiments, after unmaking the connection, transferring the tubular string section to a pipe handling system. In some embodiments, the drill string section may be carried to a backside of the path and, on the backside of the path, the drill string section may be transferred to a pipe handling system. Transferring the drill string section to the pipe handling system may comprise lowering a bottom end of the drill string section onto an end stop of the pipe handling system and allowing relative motion of the first one of the elevators and the end stop to lift the first tool joint relative to the first one of the elevators. While lowering the bottom end of the drill string section onto the end stop, the end stop may be moving in a generally downward direction.

In some embodiments, before transferring the weight of the drill string to the second one of the elevators, a connection of a drill string section containing the first tool joint is made to a drill string section containing the second tool joint. The drill string section containing the second tool joint may be delivered from below the circulating member. Alternatively, the drill string section containing the second tool joint may be delivered from circulating member. Making the connection may be performed while moving the circulating member such that the first one of the elevators lowers the drill string while the connection is being made.

In some embodiments, a make break unit is carried together with each one of the elevators and unmaking the connection is performed by the make break unit corresponding to the second one of the elevators.

In some embodiments, while supporting the drill string on the first one of the plurality of elevators, a top drive is coupled to the circulating member and a quill of the top drive is coupled to a coupling at an uphole end of the drill string. With the quill of the top drive coupled to the uphole end of the drill string, the top drive is operated or held to drive the drill string to advance the borehole while moving the circulating member (the borehole may be advanced without rotating the drill string if a downhole motor is provided to drive a drill bit). The weight of the drill string is transferred to the second one of the plurality of elevators, the quill of the top drive is uncoupled from the drill string and the top drive is uncoupled from the circulating member. Optionally, while supporting the drill string on the first one of the plurality of elevators the circulating member may be operated to move the drill string in the borehole. The movement may comprise reciprocation of the drill string. In some embodiments, the top drive is connected to the circulating member by attaching it to the elevator or crosshead.

In some embodiments, transferring the weight of the drill string onto the second one of the elevators may comprise moving the elevators relative to one another. The elevators may be suspended from pivotal couplings that connect the elevators to the circulating member and engaging the first tool joint of the drill string with a first one of the elevators may comprise pivoting the first one of the elevators about its point of connection to the circulating member. While transferring the weight of the drill string to the second one of the elevators the drill string longitudinally may move at a speed in the range of 0 to 5 feet/second (approximately 0 to 1½ m/s).

In some embodiments, before unmaking the connection, the drill string may be passed through a cavity of a mud can. The mud can may be located substantially to surround the connection. It is not necessary that the mud can be split, the cavity of the mud can may be defined by a tubular body. Drilling fluid that escapes when the connection is unmade may be removed from the cavity of the mud can by gravity drainage, suction, pumping or some combination thereof. In some embodiments, before unmaking the connection a first seal is inflated around a circumference of the first drill string section and/or a second seal is inflated around a circumference of the second drill string section. After unmaking the connection, the mud can may be moved past the second one of the plurality of elevators without removing the mud can from the tubular string. In some embodiments, this comprises tilting the second one of the elevators. In other embodiments, this comprises passing the mud can through an opening in the second one of the plurality of elevators, where the opening is large enough to allow the mud can to pass through the elevator without removing the mud can from the drill string.

In some embodiments, the circulating member may comprise a pair of parallel chain loops supported for circulation on a tower. Each of the pair of parallel chain loops may be driven with a corresponding drive sprocket.

Another aspect of the invention provides drilling apparatuses. A drilling apparatus may comprise a tower, a pair of parallel chain loops supported for circulation on the tower, a drive connected to circulate the chain loops, a plurality of crossheads connected pivotally between the chain loops at spaced-apart locations along the chain loops, each of the crossheads supporting an elevator for a drill string, and one or more actuators coupled to adjust an elevation of each elevator relative to the chain loops. The apparatus may optionally comprise additional features. Various additional features are described below. One skilled in the art would understand that the features below can be added to the drilling apparatuses in any logical combination.

In some embodiments, the chain loops are supported by a pair of top sprockets at a top end of a path followed by the chain loops and the tower is constructed to provide an opening between the top sprockets, the opening extending vertically from a location above the tops of the top sprockets by a distance sufficient to pass a tubular string section suspended by the elevator of one of the crossheads while a point of attachment of the crosshead to the chain loops is passing over the top sprockets. The opening may extend vertically by a distance of at least 10 meters downward from top edges of the top sprockets. In some embodiments the opening extends for 20 or more meters below tops of the top sprockets.

In some embodiments, each of the crossheads comprises first and second pivotal couplings respectively coupled to the first and second chain loops and a platform suspended from the first and second pivotal couplings, the platform having an opening extending from an edge of the platform to a location directly below a pivot axis of the couplings. The platform may be coupled to the pivotal couplings by extendable beams that are attached to the platform and are slidably coupled to the pivotal couplings. For example, each side of the platform may be coupled to a corresponding one of the pivotal couplings by a pair of spaced-apart linear rails or by a telescoping beam. One of the one or more actuators may be located between the linear rails of each of the pairs of linear rails. The actuators may act on bridges coupling the linear rails of each of the pairs of linear rails to selectively raise the platform toward, or lower the platform away, from the pivot axis of the couplings. The linear rails may extend through guide tubes attached to the pivotal couplings and the guide tubes include spaced-apart bushings or bearings.

In some embodiments, each of the chain loops comprises opposing longitudinally-extending plates coupled by transversely-extending pins and the pivotal couplings each comprise one of the pins being a hollow pin having a bore extending longitudinally through the pin. In some embodiments a spherical bearing is located in the bore between the plates, and a spigot coupled to the pin by the spherical bearing. A passage may extend through the spigot in at least one of the pivotal couplings, the passage being connected to supply power to one or more devices supported on the cross heads. In some embodiments, the passage exits on an axial centerline of the spigot and the drilling apparatus comprises a rotary coupling connected to fluidly couple the passage to a hydraulic conduit extending along the chain. The pins preferably comprise rollers.

In some embodiments, the drilling apparatus comprises an actuator connected to tilt the crosshead about the pivot axis of the pivotal couplings.

In some embodiments, the drilling apparatus comprises a top drive, the top drive comprising a quill operable to drive rotation of a drill string and first and second couplings respectively operable to detachably couple the top drive to the first and second chain loops. The chain loops may each comprise transversely-extending longitudinally spaced apart pins and the first and second couplings each comprise a rotatable member projecting from the top drive and engageable between adjacent pins of one of the chain loops, an end of the rotatable member having opposed projecting ears wherein a dimension between outer edges of the ears exceeds a spacing between the adjacent pins. Ends of the pins may be formed to taper in a direction at right angles to the projection of the ears. Surfaces of the rotatable member inward from the ears may be radiused to match a radius of curvature of the pins. In particular, radii of the ears in multiple planes may create a compound curve that matches the pins. A track may extend parallel to the chain loops wherein the top drive is slidably mounted to the track and the track is pivotally coupled to the tower. A hoist may be coupled to the top drive and operative to lift the top drive up the track.

In some embodiments, the drive is connected to drive the chain loops by drive sprockets that engage exterior sides of the chain loops. The drive sprockets may each be located between a pair of idler sprockets, the idler sprockets mounted in an interior of the corresponding chain loop. In alternative embodiments one or more drive sprockets are located inside each of the chain loops. In some embodiments, two drive motors for driving the chain loops are provided and the two drive motors are synchronized. They may be mechanically synchronized such as by a chain or a common rotating shaft connected to each of the two drive motors (e.g. by angle drives). They may also be synchronized electronically.

In some embodiments, the chain loops follow parallel paths and each of the paths has a straight section. A midline between the two straight sections (i.e. the straight section of each chain loop) may be substantially aligned with a wellbore. The straight section may be at least as long as a drill string section. The straight section is at least 50 feet (about 15 m) in length in some embodiments and may be significantly longer than this.

In some embodiments, the chain loops carry four crossheads and the four crossheads are equally spaced apart along the chain loops. The crossheads may be spaced apart along the chain loops by distances that are approximately equal to multiples of the length of tubulars to be handled by the apparatus.

In some embodiments, the elevators are mounted for rotation relative to the crossheads and the center of rotation of the elevator corresponding to a centerline of a drill string section supported by the elevator.

In some embodiments described here, one or more of the elevators may comprise first and second support members each pivotally mounted to a base for rotation about respective horizontal pivot axes, the first and second support members pivotally rotatable about their respective horizontal pivot axes between, a joint-supporting configuration and an open configuration. In the joint-supporting configuration, portions of adjoining edges of the first and second support members each define a corresponding portion of an aperture dimensioned to pass a generally vertical drill pipe extending along a centerline and a top face of each of the first and second members defines a corresponding portion of a joint-supporting surface extending peripherally around the aperture for supporting a drill string section. In the open configuration, the top faces of each of the first and second support members are spaced apart from one another by a distance sufficient to pass a vertical drill pipe extending along the centerline. The base and the first and second support members in the open configuration define an opening dimensioned to allow a vertical drill string section to be passed from an outside edge of the base to the centerline when the support members are in the open configuration.

In some embodiments, the elevator is mounted to the crosshead for rotation about a generally vertical axis centered relative to the aperture. The elevator may comprise a latch operable to hold outside ends of the first and second support members together when the first and second support members are in the joint-supporting configuration. The latch may comprise first and second latch members, a hook on one of the first and second latch members and a loop on the other one of the first and second latch members, the first latch member fixedly mounted to the first support member, the second latch member mounted to rotate about the horizontal pivot axis of the second support member and an actuation mechanism connected to cause the second latch member and the second support member to rotate in opposite directions about the horizontal pivot axis of the second support member.

Optionally, the second latch member may comprise a rod extending coaxially through the second support member along the horizontal pivot axis of the second support member and the actuation mechanism comprises eccentric pins projecting from the rod of the second latch member and the second support member and an actuator arranged to urge the eccentric pins to move in opposing arcs relative to the horizontal pivot axis of the second support member, thereby causing the rod of the second latch member and the second support member to counter-rotate relative to one another. The actuator mechanism optionally comprises a yoke engaging the eccentric pins, a first linear actuator arranged to move the yoke in a first direction and a second linear actuator arranged to move the yoke in a second direction opposed to the first direction. The first and second linear actuators may be mounted to the crosshead, engage abutment surfaces of the yoke without being attached to the yoke. In some embodiments, the first and second linear actuators are replaced by a single double-action linear actuator attached to the yoke.

In some embodiments, the actuation mechanism comprises a yoke engaging first and second cams for rotating the first and second support members and a third cam arranged to rotate the second latch member opposite the direction of rotation of the second support member. In some embodiments, the first and second support members each comprise a collar removably affixed to a rotating piece wherein the collars.

In some embodiments, the drilling apparatus comprises a control system connected to control the actuators to transfer weight of a supported drill string from one of the elevators to a next one of the elevators, the control system comprising a programmable controller, an interface connecting the programmable controller to operate the actuators to selectively raise or lower each of the elevators and load sensors operative to supply signals to the programmable controller, the load signals indicative of loads being carried by each of the elevators. The actuators may comprise hydraulic actuators and the load sensors comprise pressure sensors connected to measure pressure of hydraulic fluid in the hydraulic actuators.

In some embodiments, the drilling apparatus comprises a mud can. The mud can may comprise a hollow cylinder, a handle in fluid connection with a cavity of the hollow cylinder and an outlet for providing suction to the hollow cylinder through the handle. The mud can may be locatable over or may surround a drill string connection while the connection is uncoupled to collect drilling fluids that are thereby released.

In some embodiments, the mud can comprises one or more inflatable seals arranged within the hollow cylinder. In other embodiments, the expandable seals may be employed. Some embodiments comprise a controller for selectively inflating each of the one or more inflatable seals arranged within the hollow cylinder. In some embodiments, the crossheads are tiltable to allow the mud can to pass from a drill string connection above the crosshead to a drill string connection below the crosshead. In some embodiments, the mud can pass from a drill string connection above the crosshead to a drill string connection below the crosshead without tilting the crosshead.

Another aspect of the invention provides mud cans. A mud can may comprise a hollow cylinder, a substantially hollow handle in fluid connection with a cavity of the hollow cylinder and an outlet for connecting to a suction unit to provide suction to the hollow cylinder through the handle. The mud can may be locatable over a drill string connection while the connection is uncoupled to collect drilling fluids that are thereby released. A mud can may optionally comprise additional features. Various additional features are described below. One skilled in the art would understand that the features below can be added to a mud can in any logical combination.

In some embodiments, the mud can comprises one or more inflatable seals arranged within the hollow cylinder to improve suction. The one or more inflatable seals may comprise a first annular seal inflatable to create a seal between an interior surface of the cavity and a circumference of a first drill string section. The one or more inflatable seals may comprise a second annular seal inflatable to create a seal between an interior surface of the cavity and a circumference of a second drill string section. The handle may define an aperture for allowing a rotatable jaw to rotate through the aperture when the mud can is installed on a crosshead. An axial length of the hollow cylinder may be greater than a length of a coupling between adjacent drill string sections.

Another aspect of the invention provides a method for uncoupling adjacent drill string sections. The method comprises passing the drill string through a cavity of a mud can, unthreading a first drill string section from a second drill string section, locating the mud can substantially over the connection, applying suction to the cavity of the mud can to capture drilling fluid released by unmaking the connection, unstabbing the first drill string section from the second drill string section, and capturing drilling fluid released by the unstabbing within the mud can. The method may optionally comprise additional steps. Various additional steps are described below. One skilled in the art would understand that the steps below can be added to the methods for uncoupling adjacent drill string sections in any logical combination or order.

In some embodiments, before applying suction to the cavity, the method comprises inflating a first seal around a circumference of the first drill string section and/or inflating a second seal around a circumference of the second drill string section. After unstabbing, the method may comprise moving the mud can past a second elevator. In some embodiments, this comprises tilting the elevator. In some other embodiments, moving the mud can past the second elevator comprises passing the mud can through an opening in the second elevator, the opening being larger in diameter than the mud can.

Another aspect of the invention provides drilling elevators. The drilling elevator may comprise a first shaft rotatably mounted on a platform for rotation about a longitudinal axis of the first shaft and a second shaft substantially parallel to the first shaft, rotatably mounted on the platform for rotation about a longitudinal axis of the second shaft. The first and second shafts respectively may comprise first and second collar portions. The first and second shaft are rotatable between a closed configuration in which the first and second collars form a drill string supporting surface and an open configuration in which the first and second collars are spaced apart from one another to allow a drill string to pass through a space therebetween. Various optional features of drilling elevators are described herein. One skilled in the art would understand that various combinations of those features may be combined in different embodiments of the drilling elevators.

In some embodiments, the first and second collars abut one another in the closed configuration to form the drill string supporting surface. In some embodiments, the platform is rotatably mounted to a base. A plurality of roller bearings between the platform and the base may allow rotation of the platform relative to the base. In some embodiments, the first and second collars are removably mounted to the first and second shafts.

In some embodiments, the first and second linear actuators are arranged to force a yoke in opposite directions, the yoke attached to each of the first and second shafts by first and second cams respectively to translate linear motion of each of the first and second linear actuators into rotation of the first and second shafts, wherein actuation by the first linear actuator forces the first and second shafts into the closed configuration and actuation of the second linear actuator forces the first and second shafts into the open configuration. Rotation of the first and second shafts may comprise rotation of the first shaft in a first direction and rotation of the second shaft in a second direction, the second direction opposite to the first direction. In some embodiments, the first and second linear actuators abut but are not attached to the yoke.

In some embodiments, moving between the closed configuration and the open configuration comprises rotating the first and second shafts in opposite directions.

In some embodiments, the drilling elevator comprises a latching mechanism to maintain alignment of the first and second shafts in the closed configuration. The latching mechanism may comprise a hook portion attached to one of the first and second shafts and a loop portion attached to the other of the first and second shafts. The first and second linear actuators may be arranged to force a yoke in opposite directions, the yoke attached to each of the first and second shafts by first and second cams respectively to translate linear motion of each of the first and second linear actuators into rotation of the first and second shafts wherein actuation by the first linear actuator forces the first and second shafts into the closed configuration and actuation of the second linear actuator forces the first and second shafts into the open configuration. A third cam may be arranged to translate linear motion of the first and second linear actuators into rotational motion of the hook portion, rotational motion of the hook portion being in an opposite direction of rotational motion of the one of the first and second shafts. Translating linear motion of the first and second linear actuators into rotational motion of the hook portion may comprise the third cam rotating a hook shaft arranged within the one of the first and second shafts, wherein the hook shaft is connected to the hook portion.

Another aspect of the invention provides apparatuses for mounting a drilling tool to a pair of parallel chains where the chains each comprise transversely-extending longitudinally spaced apart rollers. An apparatus may comprise first and second couplings comprising first and second rotatable members projecting from the drilling tool and engageable between adjacent rollers of one of the chains, an end of the rotatable member having opposed projecting ears wherein a dimension between outer edges of the ears exceeds a minimum spacing between the adjacent rollers. The apparatus may optionally comprise additional features. Various additional features are described below. One skilled in the art would understand that the features below can be added to an apparatus in any logical combination.

In some embodiments, ends of the rollers are formed to taper in a direction at right angles to the projection of the ears. The surfaces of the rotatable member inward from the ears may be radiused to match a radius of curvature of the rollers. A dimension of the rotatable members orthogonal to the dimension between outer edges of the ears may be less than the minimum spacing between the adjacent rollers.

In some embodiments, mounting the drilling tool to the pair of parallel chains comprises inserting the first rotatable member into a spacing between adjacent rollers on a first one of the chains and inserting the second rotatable member into a spacing between adjacent rollers on a second one of the chains and rotating the first and second rotatable members approximately 90 degrees to lock the rotatable members between the adjacent rollers.

In some embodiments, actuators are provided for rotating the first and second rotatable members. The actuators may comprise any type of actuator such as linear actuators or rotary actuators. Sensors may be provided to monitor engagement of the rotatable members with the chains. The drilling tool may comprise any type of drilling tool, such as but not limited to top drives and make break units.

Another aspect of the invention provides an apparatus for supplying power to one or more tools suspended from a pair of rotating parallel chain loops. The apparatus may comprise a rotary union located within the chain loops and one or more power cables, extending from the rotary union, for supplying power to the tools suspended from the pair of parallel chain loops. Each of the one or more power cables passes through a hollow roller link in one or more of the chain loops to avoid tangling as the parallel chain loops rotate and then is connected to the one or more tools. The apparatus may optionally comprise additional features. Various additional features are described below. One skilled in the art would understand that the features below can be added to the apparatuses in any logical combination.

In some embodiments, each of the one or more power cables comprises a rotary union as it passes into the hollow roller link. In some embodiments, separate power cables for each tool. In other embodiments, a single power cable that extends along the length of the pair of rotating parallel chains loops and supplies power to each of the one or more tools. A plurality of additional power cables may extend from the single power cable that extends along the length of the pair of rotating parallel chain loops to power each of the one or more tools. The one or more power cables may be retractable.

The power cables may comprise hydraulic power cables or electrical power cables or combinations of both. The power cables may comprise pressure hoses and return hoses. The pressure hose may extend along a first chain of the pair of parallel chain loops and the return hose may extend along a second chain of the pair of parallel chain loops.

The rotary union may comprise a fixed port for receiving power and one or more rotary ports for supplying power to the one or more power cables that extend therefrom.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

FIG. 9A is a partially schematic view illustrating transfer of power to a circulating chain. FIG. 9B is a bottom view of the portion of the apparatus shown in FIG. 9A. FIGS. 9C and 9D are respectively side and front views of a section of chain equipped with a mechanical power delivery system.

FIG. 10A is a partially schematic view illustrating transfer of power to a circulating chain. FIG. 10B is a bottom view of the portion of the apparatus shown in FIG. 10A. FIGS. 10C and 10D are respectively front and side views of a section of chain supporting a mechanical power delivery system according to another example embodiment.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

One aspect of this invention provides apparatus useful for tripping a drill string. Such apparatus is operable to raise the drill string, uncouple an uphole segment from the drill string, and hand off that uphole segment to a storage apparatus where it can be stored until needed again. In some embodiments, the process is performed continuously such that removal of the uphole drill string section occurs while the drill string is being lifted out of the borehole.

Figure 1:
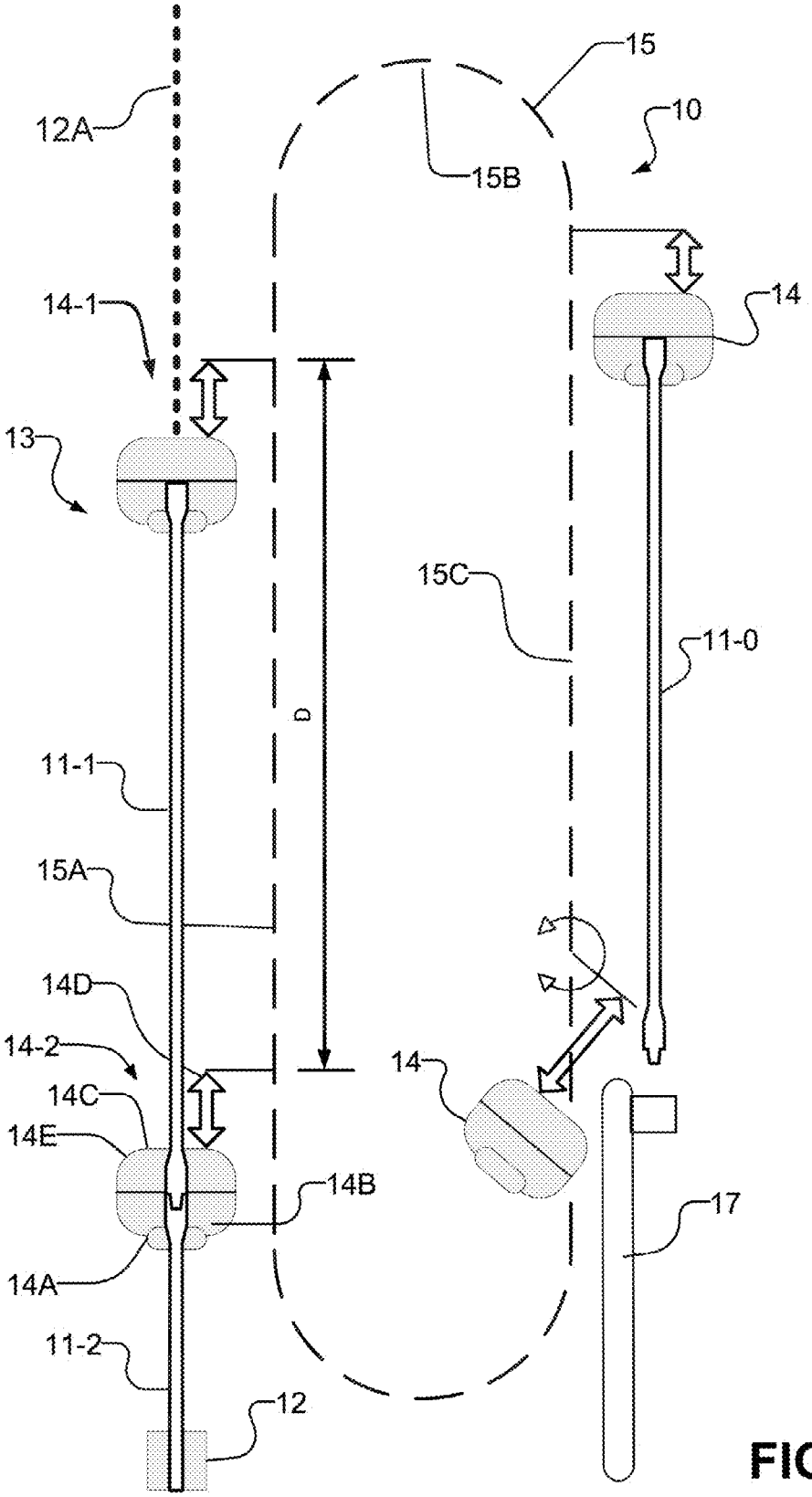
FIG. 1 is a schematic illustration showing a drill string handling system according to an example embodiment.

FIG. 1 shows an example apparatus 10. Apparatus 10 is located adjacent to the top of a well 12. A drill string 13 made up of sections 11-1, 11-2 etc. (individually or collectively sections 11) enters the wellbore of well 12. Drill string 13 is aligned along a line 12A that coincides with well center. In some cases a blowout protector (BOP) may be located at the top of well 12.

Apparatus 10 comprises a plurality of connection units 14 which are arranged to travel along a closed path 15. Path 15 includes a section 15A aligned with well center 12A. Section 15A is typically vertical. In some embodiments section 15A and well center 12A are inclined at some angle to vertical.

Connection units 14 each include an elevator 14A. An elevator is a mechanism for grasping and holding drill string 13. Typical drill string sections have tapered or square upset tooljoints near their ends. In some embodiments, elevator 14A is designed to close around the drill string section to engage such tooljoints. In some embodiments elevator 14A may comprise a slip type elevator that can grip a drill string 13 at any point. When the elevator is closed around the drill string section, the elevator can support the weight of the drill string section (and any other parts of the drill string coupled below the drill string section being supported by the elevator). Elevators are commercially available. Some elevators are designed to carry weights of 150 tons, 250 tons, 350 tons, or more.

Connection unit 14 also includes an elevation adjuster 14B which is operable to shift elevator 14A up or down relative to the rest of connection unit 14. Elevation adjuster 14B may be controlled to transfer weight of a drill string between different elevators 14A and also to compensate for variations in the lengths of tubulars. In some embodiments elevation adjuster 14 allows the entire connection unit 14 to be scoped up or down relative to path 15.

Connection unit 14 may also include a tilt adjuster 14F which is operable to tilt links supporting elevator 14A at an angle relative to path 15. Tilt adjuster 14F may be used to shift elevator 14A laterally relative to path 15. For example, when a top drive is coupled to drill string 13 as described elsewhere herein, tilt adjuster 14F may be controlled to displace coupling unit 14 so that a drill string section supported by the elevator 14A of the coupling unit 14 does not interfere with the top drive. This may allow the supported drill string section to be brought quickly into place for coupling to the top end of drill string 13 after the top drive has been disconnected from drill string 13. A tilt adjuster 14F may be used to tilt an elevator 14A so that it does not interfere with a pipe handling system 17 arranged to deliver drill string sections to and from apparatus 10.

Figure 5A:
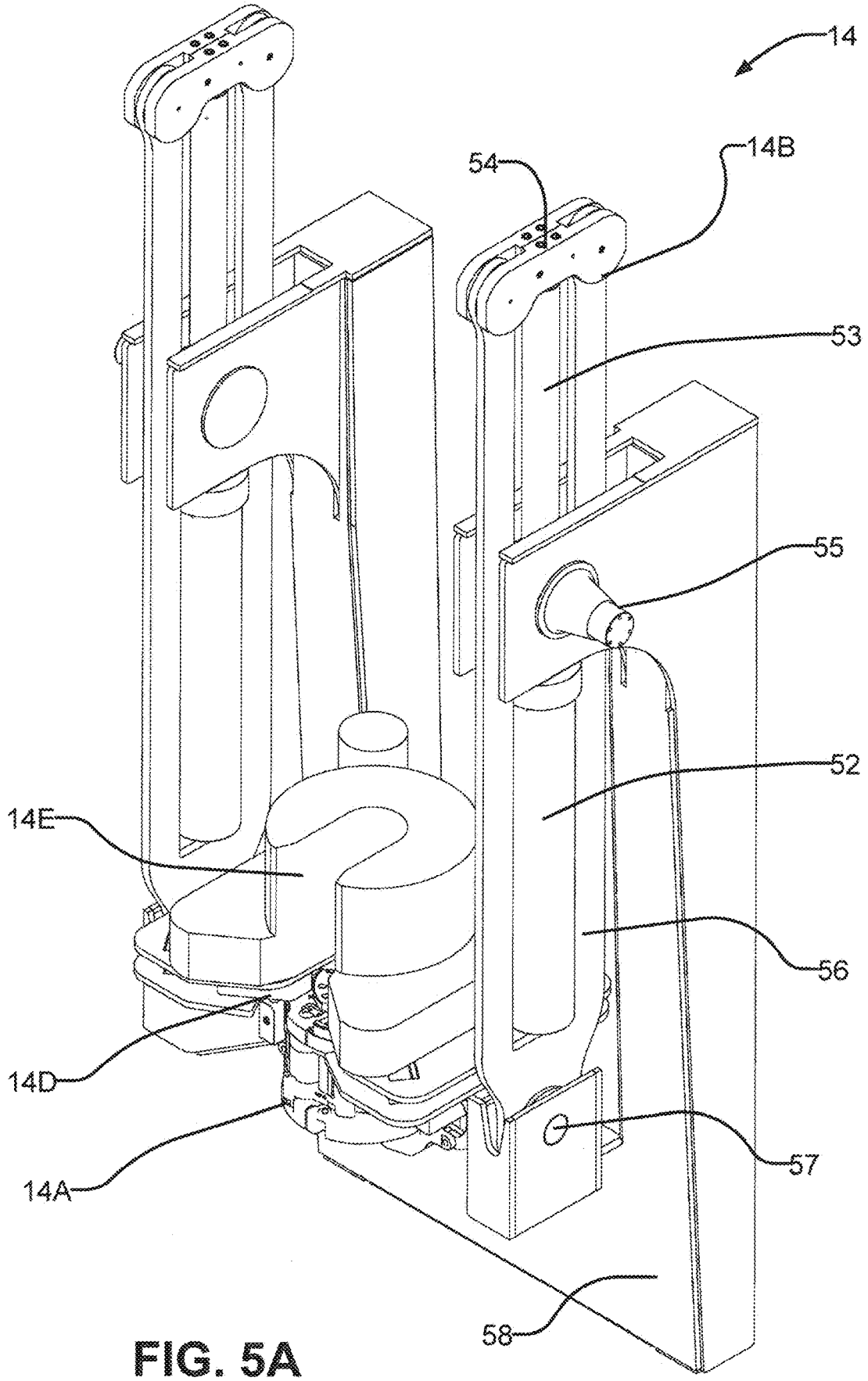
FIGS. 5A and 5B are illustrations showing a crosshead equipped with a connection unit according to an example embodiment.
Figure 5B:
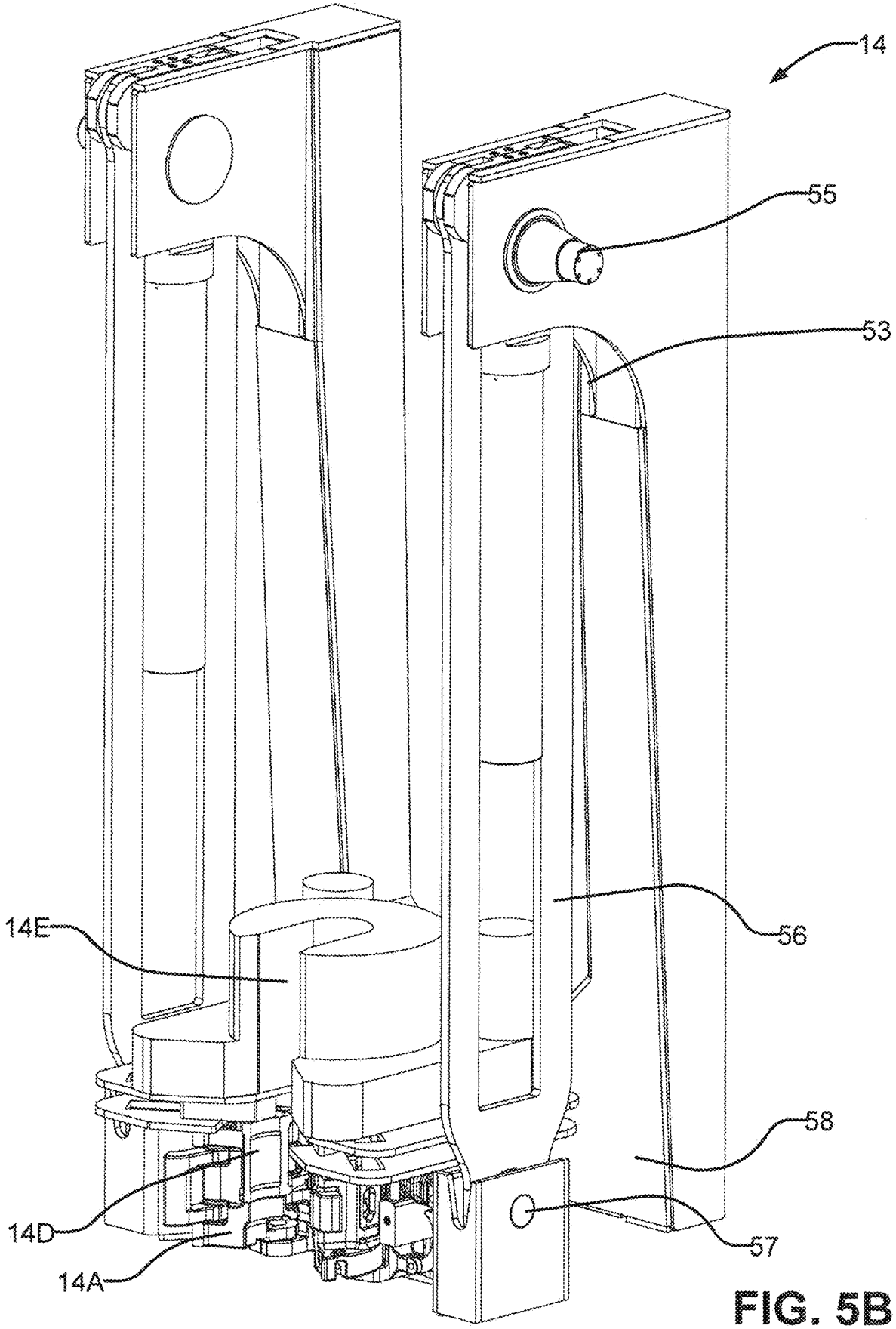
Figure 5C:
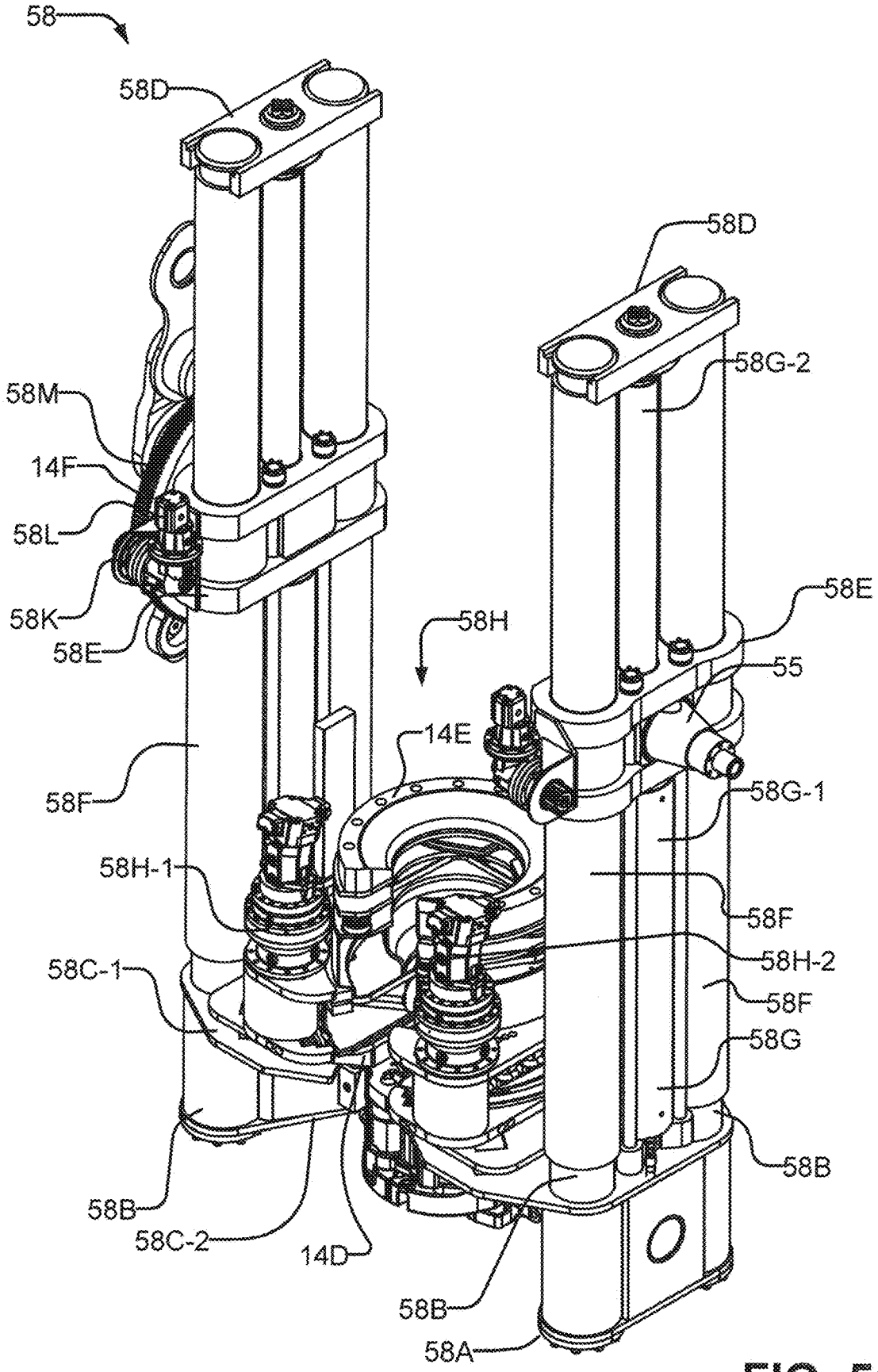
FIGS. 5C and 5D are perspective views of another example crosshead apparatus operable to provide elevation adjustment relative to a point at which the apparatus is connected to a conveyor.
Figure 5D:
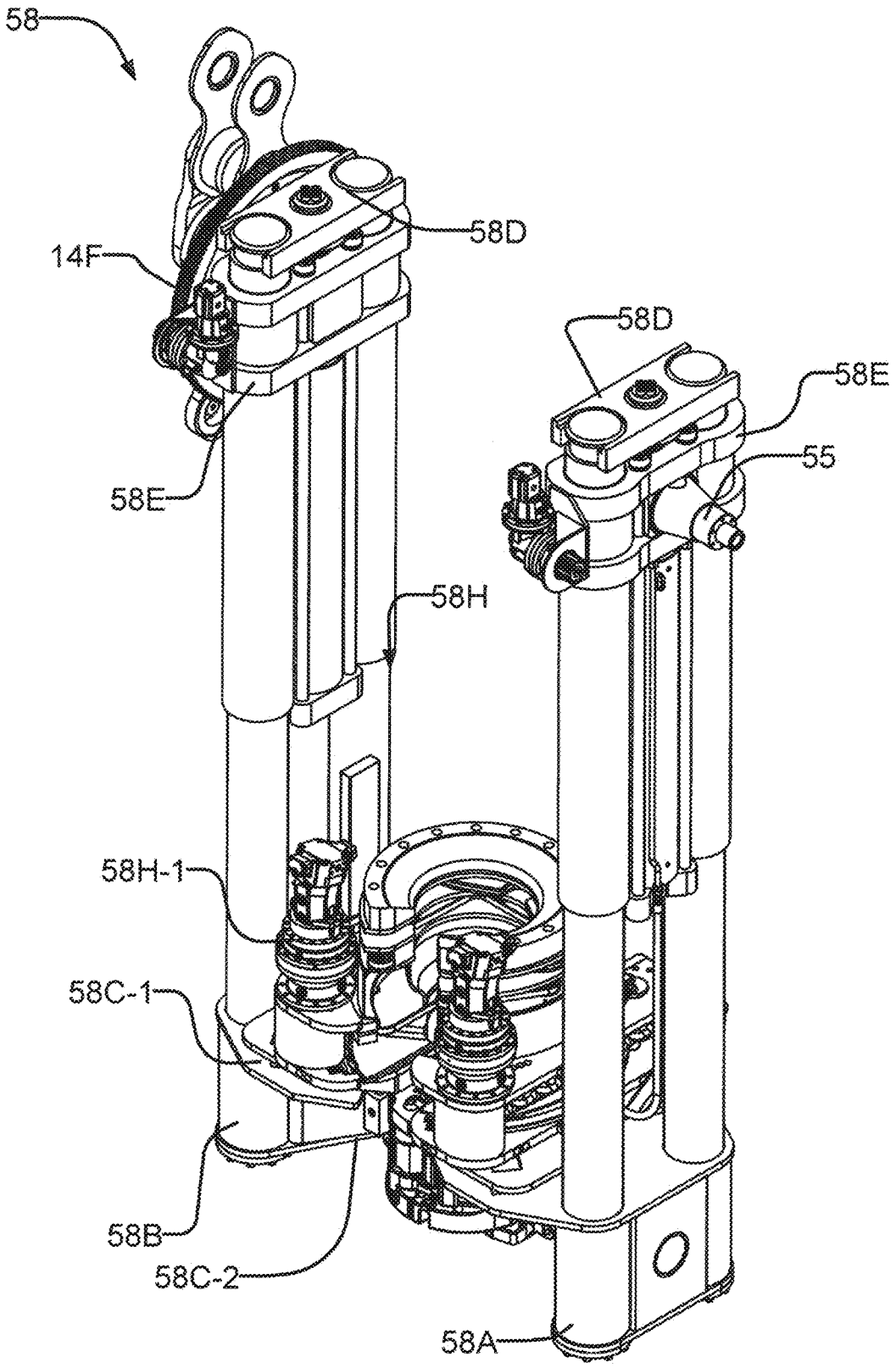

Tilt adjuster 14F may comprise, for example, a tilt gear 58K driven by a motor 58L as illustrated in FIGS. 5C and 5D. The tilt gear may engage a toothed element 58M such as a gear or a curved rack. In other embodiments, tilt adjuster 14F may comprise other actuators coupled to controllably swing elevator 14A to one side or the other of path 15. For example, tilt adjuster 14F could be implemented using a chain or belt drive or a hydraulic cylinder or other linear actuator suitably coupled to be selectively engaged to displace elevator 14A away from path 15 by tilting a linkage or otherwise. In some embodiments the entire connection unit 14 is pivoted relative to path 15 by tilt adjuster 14F.

Tilt of connection units 14 may be driven actively (e.g. by a tilt adjuster 14F) or passively (e.g. a connection unit 14 may encounter ramps, tracks, rollers or the like that cause the path taken by the elevator 14A of the connection unit to deviate from path 15 at different locations around path 15 as the connection unit 14 circulates).

Connection units 14 may also each comprise an engagement/disengagement unit (which may also be called a make/break unit) which is operable to make or break a connection between adjacent drill string sections. In some embodiments, the engagement/disengagement unit 14C comprises jaws which are engageable with couplings of adjacent drill string sections 11 and are rotatable relative to one another to screw the threaded coupling between the two sections 11 together or to unscrew the threaded coupling between the two sections 11 so that the sections are separated from one another.

In the illustrated embodiment, connection unit 14 includes a fixed jaw 14D which is disposed below a rotatable jaw 14E. Fixed jaw 14D may hold a drill string section that is being supported by elevator 14A so that the supported drill string section does not rotate. Rotatable jaw 14E may then engage and rotate a drill string section that is above the supported drill string section to either couple or uncouple the drill string sections.

Engagement/disengagement unit 14C has a configuration which allows a drill string or drill string section to pass into the engagement/disengagement unit from one side. For example, fixed jaw 14D and rotatable jaw 14E may each comprise a gap wide enough to receive a drill string section. When the gaps are aligned with one another engagement/disengagement unit 14C may be moved transversely relative to a drill string section from a position adjacent to the drill string section until the drill string section has entered the gap.

A centralizer may be provided to move an end of a drill string section onto well center (for example to facilitate stabbing the drill string section into the uphole end of drill string 13). The centralizer may be of any suitable type. A centralizer may be included as part of a connection unit 14, as part of a separate make/break machine, as a separate device mounted on a crosshead or the like. It is generally desirable to bring the end of a drill string section onto well center with a small tolerance (e.g. ¼ inch). In some embodiments a centralizer may include a pair of moving arms that bring the drill string section to a fixed center position.

Some drilling operations are conducted in locations that are very windy. High wind loads may blow a section of drill string around and make the drill string section harder to handle. In some embodiments elevator actuators 14B and/or tilt adjuster 14F are actuated as tubulars are being carried in a manner that provides live damping of wind-induced oscillations. In an example embodiment, sensors associated with connection units 14 sense the onset of wind-induced motion of a supported drill string section and a control system operates actuators (e.g. elevator adjusters 14B and/or tilt adjuster 14F) to dampen the motion in response to the sensor signals.

Tubulars that are being carried by elevators 14A associated with connection units 14 may optionally be gripped with the rotatable and/or backup jaws of an engagement/disengagement unit 14C as they are being carried to stabilize the tubulars against, among other things, wind-induced motions or vessel dynamics.

Connection units 14 are spaced apart along path 15 by a distance D such that the elevator 14A of a first one of the connection units 14-1 can engage and support a drill string section 11-1 that is being added to or taken off of the uphole end of the drill string. A second connection unit 14-2 can have its elevator 14A engaged with the next drill string section 11-2 that drill string section 11-1 is being coupled to or uncoupled from. In other words, on vertical section 15A, two connection units 14 are spaced apart from one another by a distance D that is approximately equal to the lengths of the drill string sections 11 which make up drill string 13. In some embodiments drill sections 11 are about 30 feet (about 10 m) or about 45 feet (about 15 m) long. Variations in the lengths of individual drill string sections 11 may be accommodated by adjusting elevator adjusters 14B.

A pipe handling system 17 provides drill string sections to apparatus 10 or takes away drill string sections 11 from apparatus 10 as required.

In an example method of operation, connection units 14 are circulating continuously along path 15. For example, connection units may travel along vertical section 15A at a speed of ½ to 4 feet per second (about 15 cm/sec to 125 cm/sec). 1½ feet/second (about 45 cm/second) is typical. While connection units 14 circulate around path 15 the weight of drill string 13 may be transferred from the elevator 14A of one connection unit 14 to the next to either hoist drill string 13 (e.g, for tripping out) or to lower drill string 13 (e.g. for tripping in). At the same time drill string sections may be removed from (for tripping out) or coupled onto (for tripping in) the uphole end of drill string 13.

FIGS. 2A to 2G illustrate stages in the operation of an apparatus 10A according to an example embodiment. In the FIG. 2A embodiment, connection units 14 include crossheads that are pivotally attached at spaced apart locations between a pair of circulating members that follow path 15. In some embodiments the circulating members comprise loops of chain, such as roller chain. Elevators 14A are mounted on the crossheads. Actuators are provided to raise or lower the crossheads relative to their points of attachment to the circulating members.

Figure 2A:
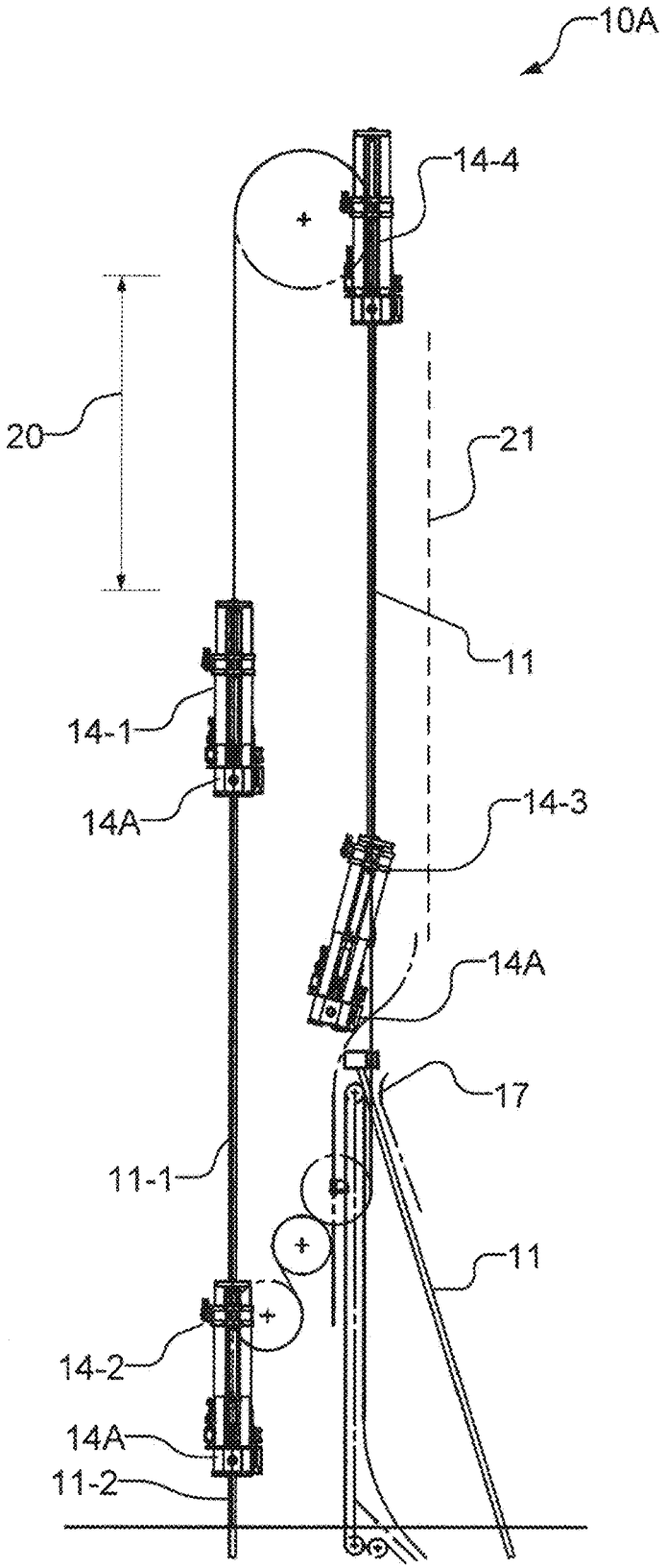
FIGS. 2A to 2G are partially schematic illustrations showing an example drill string handling system at various phases of a continuous tripping cycle.
Figure 2B:
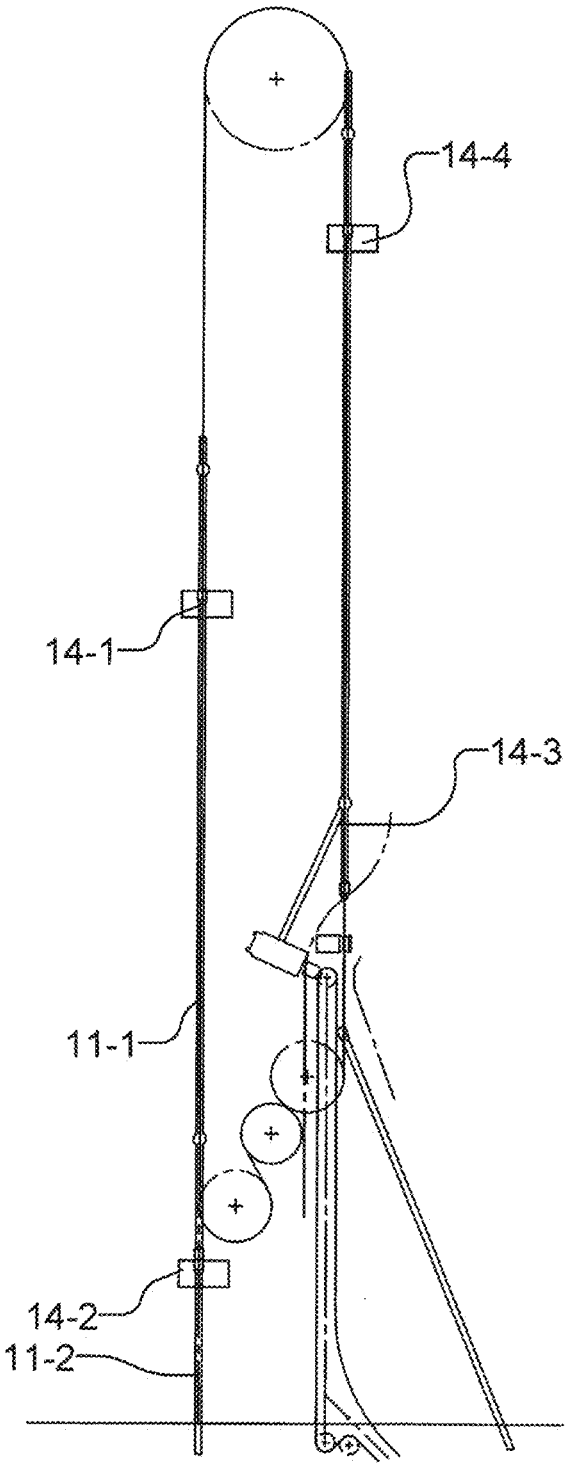
Figure 2C:
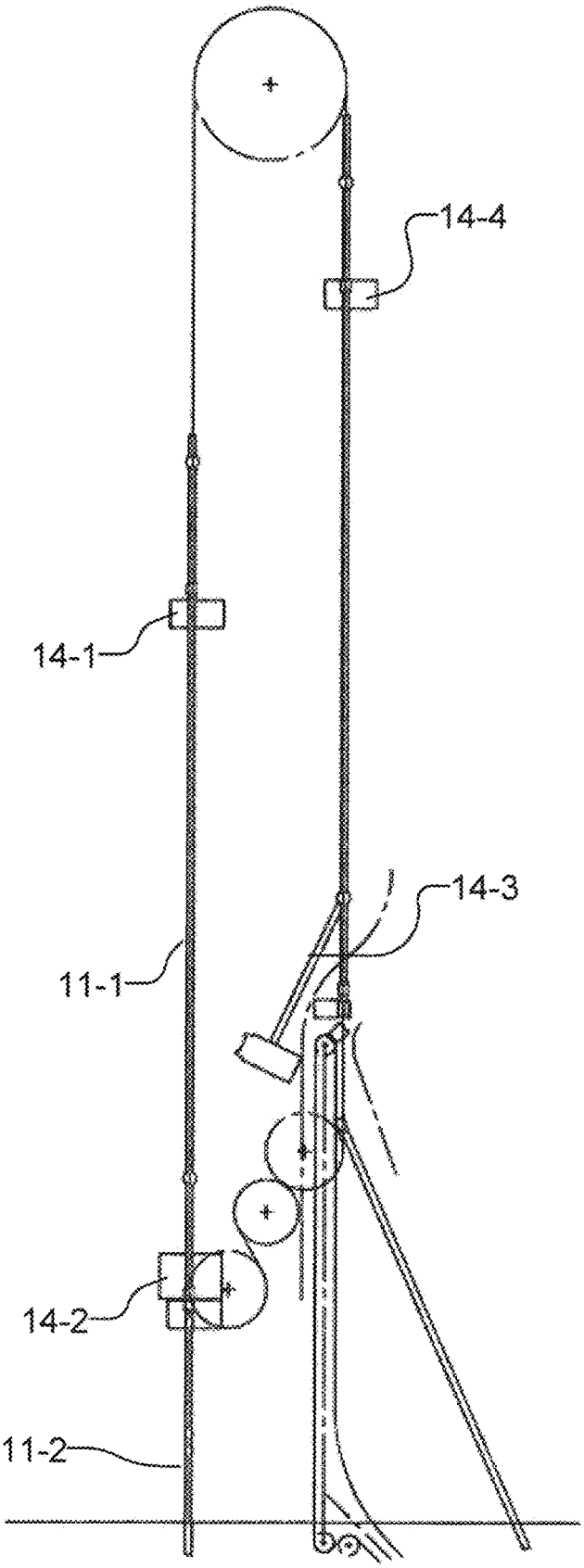

For clarity, FIGS. 2B to 2G are simplified relative to FIG. 2A by omitting details of the crossheads and showing schematically only those make/brake devices that are actively being used at the depicted phase of operation. FIG. 2A indicates a connection zone 20 in which connections between drill string sections 11 are made or broken (depending on the direction of tripping). FIG. 2A also shows an offset trajectory 21 along which drill string sections 11 may be carried on the back side of apparatus 10A so that the drill string sections 11 can be handed off to a pipe handling system 17.

Figure 2D:
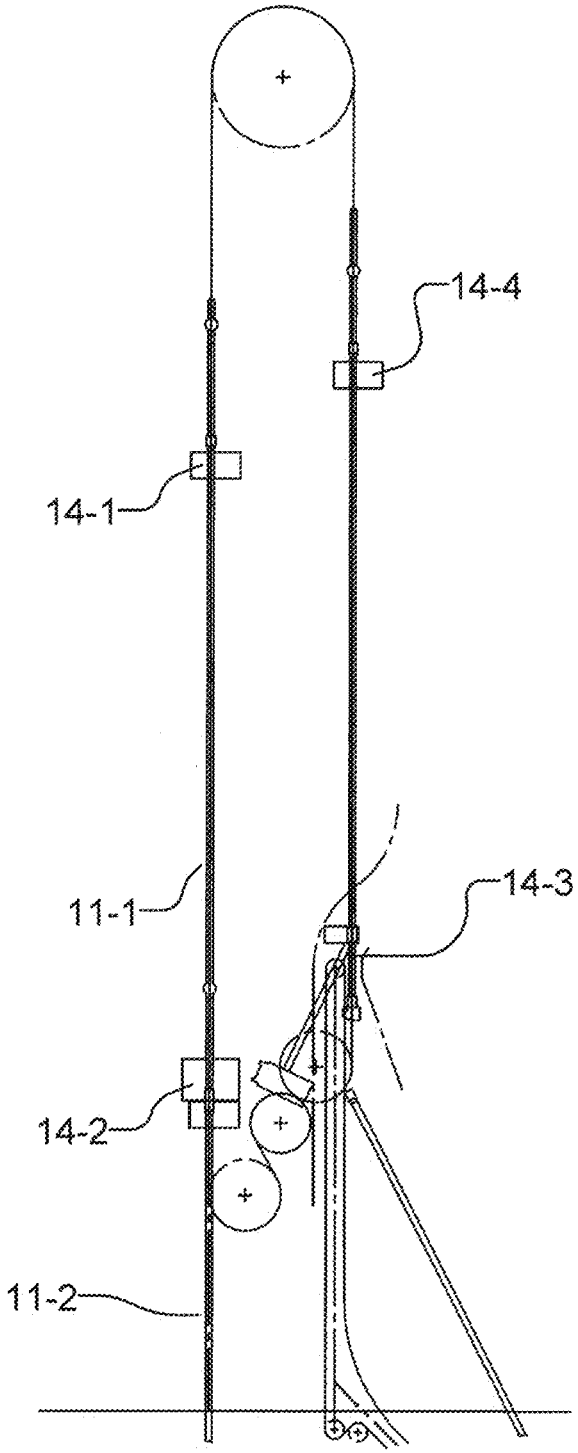
Figure 2E:
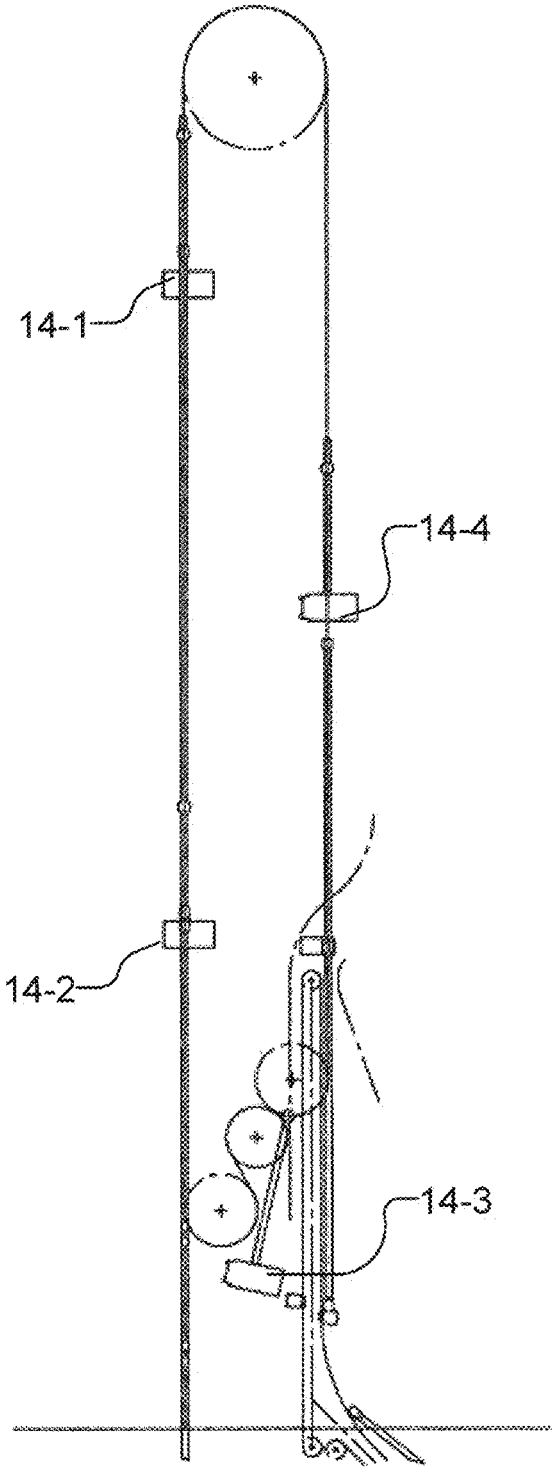
Figure 2F:
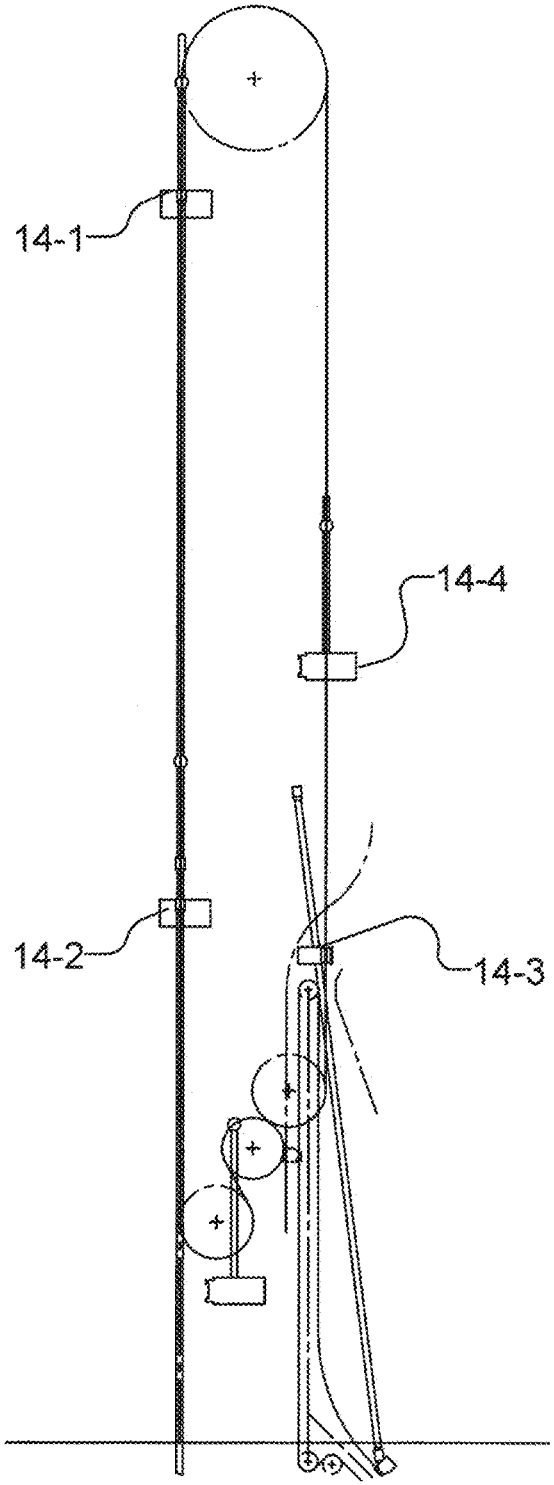
Figure 2G:
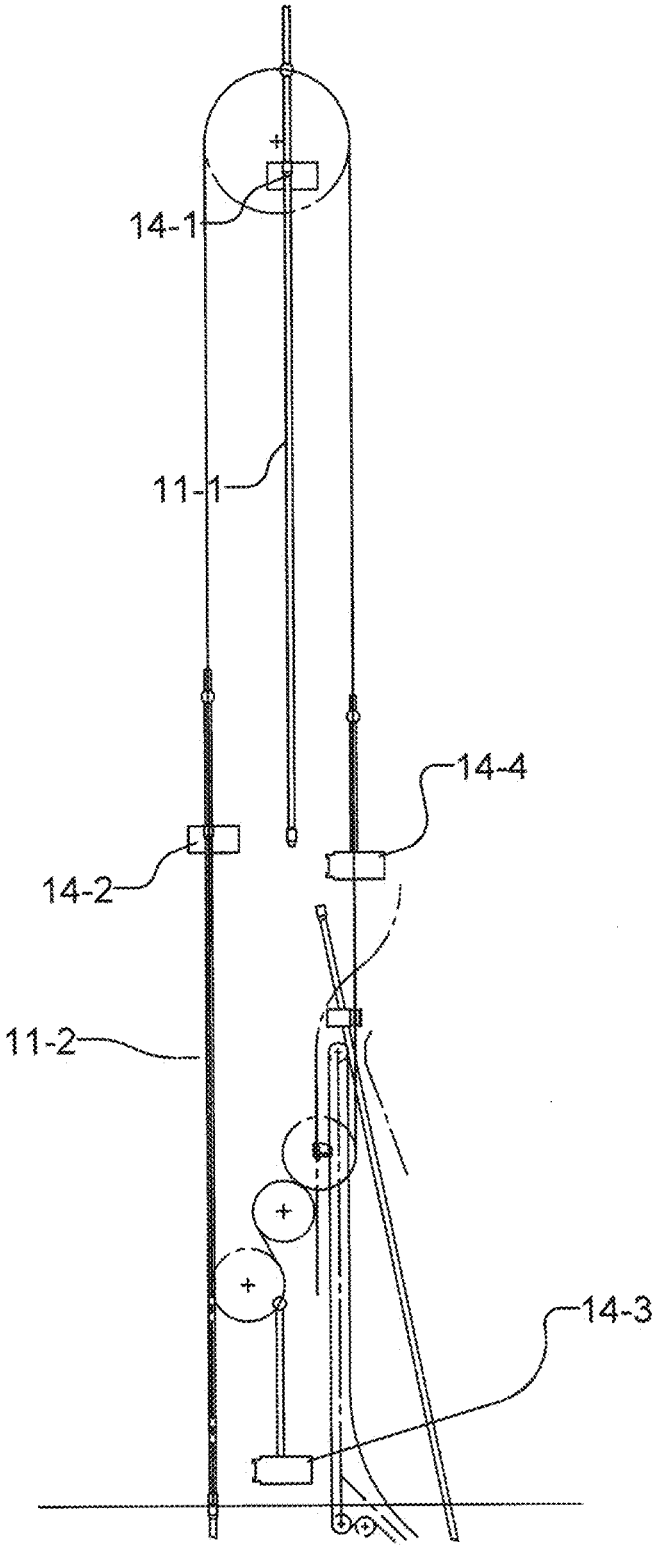
Figure 2H:
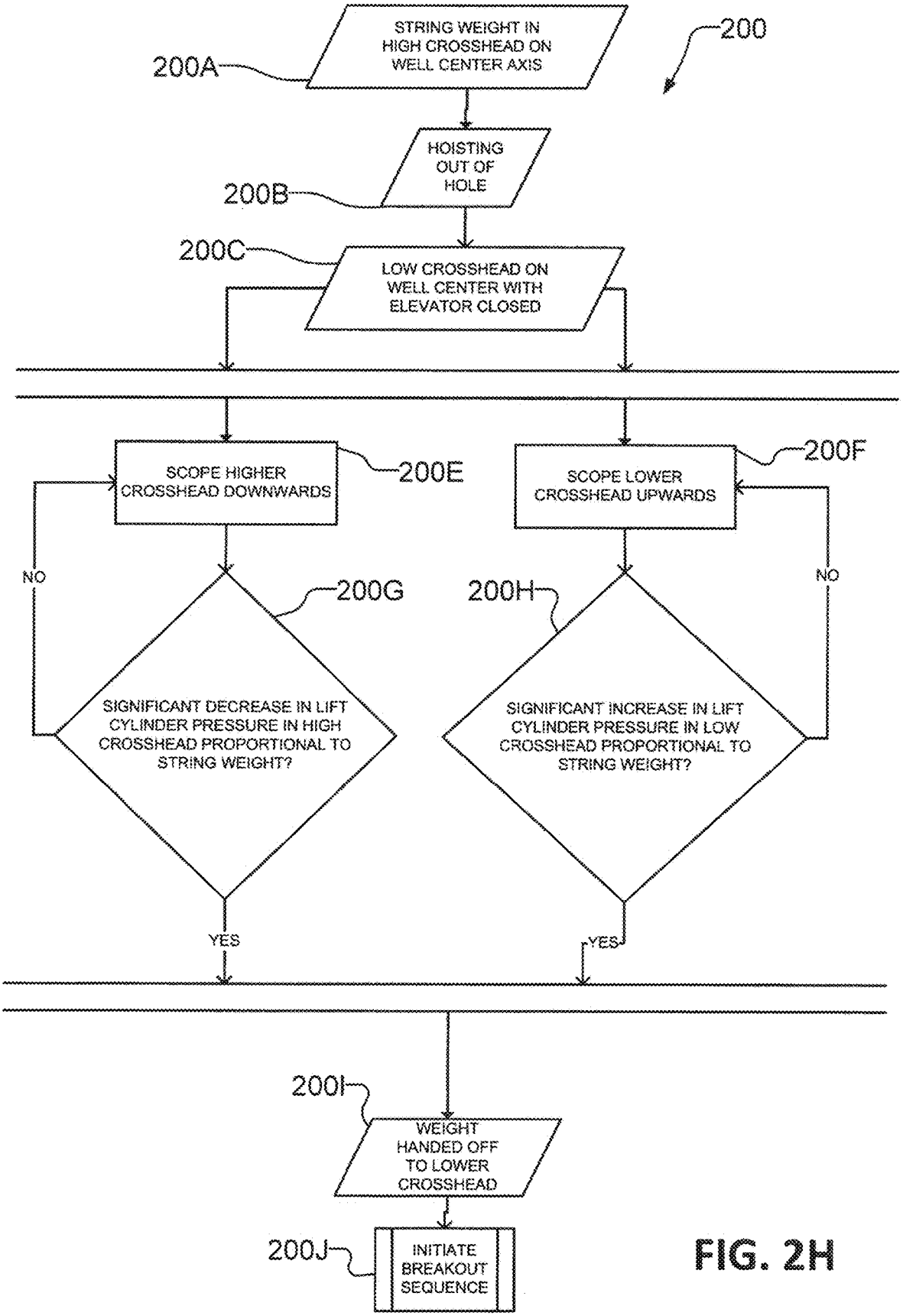
FIG. 2H is a flow chart illustrating an example method for handing off of a drill string between two elevators according to one example embodiment.

FIG. 2H illustrates an example method 200 for tripping out. Method 200 involves transferring the weight of drill string 13 from one elevator 14A to an elevator 14A of an adjacent lower connection unit 14. Method 200 begins in block 200A with the elevator 14A on a first one 14-1 of connection units 14 engaged with and supporting a top end of the drill string (e.g. the top end of section 11-1 as illustrated in FIG. 2A).

As illustrated in FIG. 2D, the first connection unit 14-1 continues to circulate along path 15, the entire drill string 13 is lifted (block 200B). When drill string 13 has been lifted high enough, the elevator 14A of a second connection unit 14-2 can engage (block 200C) the next drill string section 11-2 which, at this point, has been lifted far enough that its uphole tool joint has been pulled clear of well 12. At this point, both of connection units 14-1 and 14-2 are on vertical section 15A of path 15 as shown in FIG. 1 and the topmost drill string section 11-1 is extending vertically between the two connection units 14 on well center 12A.

Once connection unit 14-2 has engaged drill string section 11-2, the weight of drill string 13 can be handed off so that drill string 13 is supported by connection unit 14-2. This may be done by one or both of: lowering the elevator 14A of the topmost connection unit 14-1 using elevation adjuster 14B (as in block 200E), and raising the elevator 14A of the lowermost connection unit 14-2 using elevator adjuster 14B (as in block 200F). In either case, a sensor may detect significant decrease in the weight carried by elevator 14A of the higher connection unit 14-1 (as in block 200G) and/or an increase in weight carried by the elevator 14A of the lower connection unit 14-2 (as in block 200H). For example, where elevators 14A are supported by hydraulic cylinders the sensor(s) may monitor lift cylinder pressure at connection units 14-1 and/or 14-2 to determine when the transfer of weight of drill string 13 to connection unit 14-2 is complete (as indicated at block 200I). Since the weight of the drill string is now being supported by the lowermost connection unit 14-2, the topmost drill string section 11-1 may be uncoupled from the rest of drill string 13 (block 200J), as illustrated in FIG. 2G. This may be done, for example, by operating the engagement/disengagement mechanism provided by connection unit 14-2.

For example, fixed jaw 14D may grip the upper end of drill string section 11-2 and thereby prevent rotation of the upper end of drill string section 11-2 and the rest of drill string 13 while rotatable jaw 14E grips and turns the uppermost drill string section 11-1 thereby uncoupling section 11-1 from the rest of drill string 13. Simultaneously with this, elevator adjusters 14B on one or both of the first and second connection units 14 may be operated to lift the uppermost drill string section clear of drill string section 11-2 to which it was coupled (i.e. 'unstab' the uppermost drill string section). The uncoupling of section 11-1 may occur as connection units 14 continue to circulate around path 15.

Figure 2I:
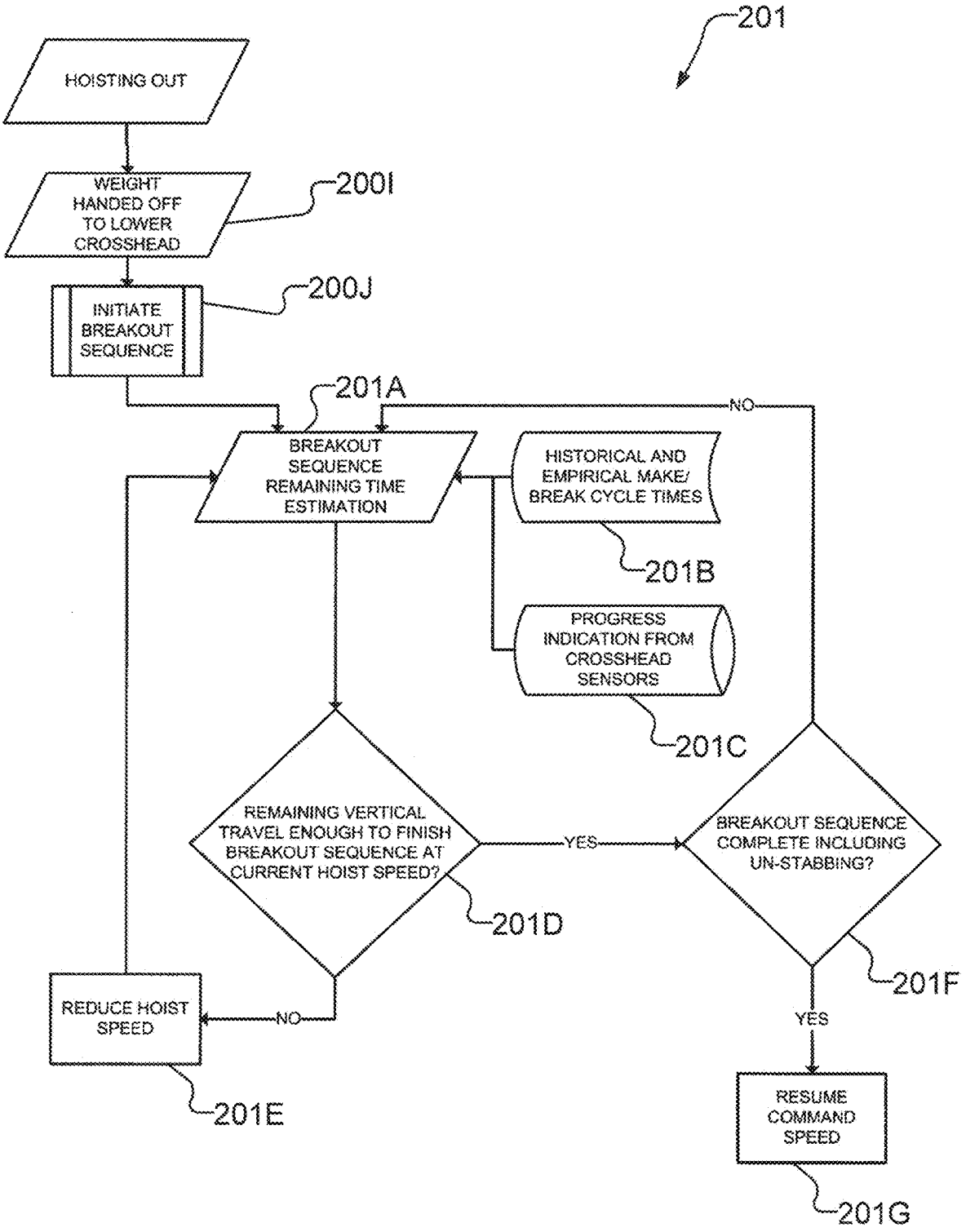
FIG. 2I is a flow chart illustrating a method for ensuring correct timing of a handoff according to one example embodiment.

FIG. 2I is a flow chart illustrating a breakout sequence 201 according to an example embodiment. After the weight of drill string 13 is handed off to connection unit 14-2, as described above, a controller or operator estimates how much time is required to uncouple adjacent drill string sections 11 (block 201A). Any one or more of numerous factors may contribute to estimating the time required for uncoupling. For example, historical and empirical make/break cycle times (block 201B) and/or progress indications from sensors associated with connection units 14 (block 201C) may be used as inputs to block 201A, which may be performed automatically by a programmed controller in some embodiments.

Block 201D determines if there is enough vertical distance to finish uncoupling drill string sections 11 at the current speed of hoisting before uppermost connection unit 14-1 leaves the straight front side 15A of path 15. If so (YES result from block 201D), then the uncoupling may continue to completion and un-stabbing may occur (blocks 201F and 201G). If there is not enough vertical distance to finish uncoupling sections 11-1 from section 11-2 at the current speed of hoisting (NO result from block 201D), then the hoist speed is reduced at block 201E.

By not requiring uncoupling to happen at any specific location along path 15, this breakout sequence does not require the sequence of events to occur within exacting tolerances and allows for some flexibility.

While the above events are occurring, connection units 14-1 and 14-2 may be continuously moving upwards along vertical section 15A of path 15. When the uppermost connection unit 14-1 reaches the top of vertical section 15A, the now-uncoupled uppermost drill string section 11-1 that it is still carrying is taken over the top end 15B of path 15 and carried laterally out of alignment with the rest of drill string 13. Drill string section 11-1 may then be carried downward along the backside 15C of path 15. Somewhere on the backside 15C of path 15, the drill string section 11-1 being carried by the first connection unit 14-1 may be disconnected from the elevator 14A and handed off to a pipe handling system 17 which takes and stores the drill string section.

FIG. 1 shows a drill string section 11-0 being handed off to a pipe-handling system 17. In some embodiments drill string sections 11 are handed off while they are hanging vertically such that handoff can occur anywhere within a range of positions along back side 15B. This may facilitate control of the handoff to pipe handling system 17. In some embodiments, pipe handling system 17 comprises a conveyor that carries movable end-stops such that an end of a drill string section 11 is lowered onto an end stop of the conveyor, which then supports the drill string section 11. The drill string section 11 may then be released from the elevator 14A. In other embodiments, pipe handling system 17 may comprise a reciprocating skate, arcuate or rectilinear arm grabber, robot arm, circulatory hoist, or the like. In some embodiments, drill string section 11 is passed off to a pipe handling system 17 anywhere after the connection is broken (i.e. vertical section 15A of path 15 or backside 15C of path 15).

In some embodiments the elevators 14A of connection units 14 are movable laterally relative to path 15 when the connection units are travelling down the back side 15C of path 15. This allows elevators 14A to be shifted laterally e.g. by tilting after drill-string sections 11 are passed off to pipe handling system 17. This may allow connection units 14 to pass by the pipe handling system 17 after the drill string section has been handed off. The pass off to pipe handling system 17 may occur in line with path 15 or spaced apart behind path 15 by a distance within the lateral range of motion of connection units 14.

Horizontal displacement of elevator 14A relative to path 15 may be achieved, for example, by pivoting connection unit 14 or a link that supports elevator 14A. Control over the lateral position of elevators 14A may be provided, for example, by an actuator (e.g. a link tilt mechanism such as tilt adjuster 14F) or a track and roller system.

In the meantime, the second connection unit 14-2 has continued to lift drill string 13 up to the point where a third connection unit 14-3 can engage a next drill string section which has been pulled high enough to be engaged by the elevator of the third connection unit 14-3. The process can then be continued with drill string sections being lifted and uncoupled from one another as they travel up vertical section 15A of path 15, carried between two connection units 14. After each drill string section is uncoupled from the rest of the drill string, it is passed off to pipe handling system 17 on the backside 15C of path 15 or at another suitable location.

The process may be reversed in order to add drill string sections 11 to the top of a drill string 13 as the drill string 13 is tripped back down into a borehole.

In some embodiments, a top drive may be removably coupled to move along path 15. This facilitates using apparatus as described herein for drilling as well as for tripping. FIGS. 3A to 3G illustrate a sequence of steps in an example drilling operation using a top drive 30 having a quill 30A that can be coupled to drive drill string 13. In some embodiments top drive 30 may be driven along path 15 to apply down force (generally known in the industry as 'pulldown') to drill string 13, if desired.

Figure 3A:
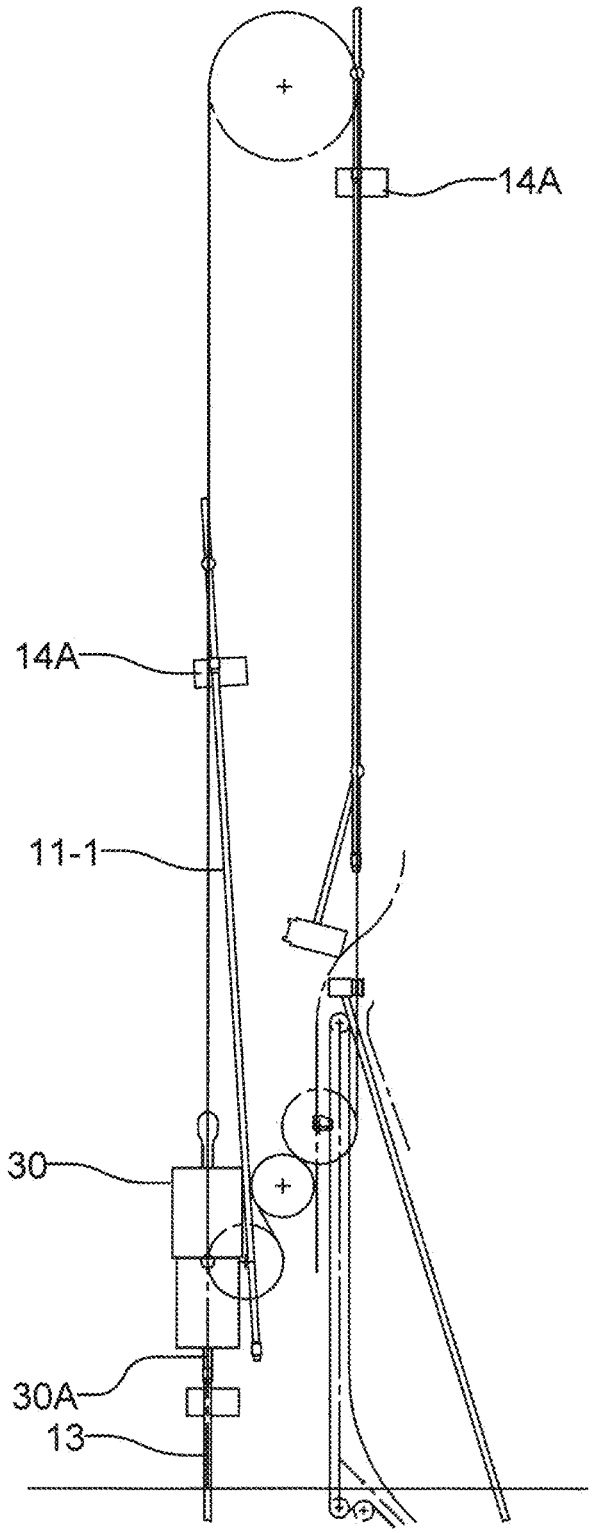
FIGS. 3A to 3F are schematic illustrations showing an example drill string handling system at various phases of drilling/reaming using a top drive.

FIG. 3A shows top drive 30 in its lowest drilling position. A drill string section 11-1 is being readied to add to drill string 13. FIG. 3A shows how drill string section 11-1 may be tilted so that it does not interfere with top drive 30. This may be achieved, for example, by pivoting the connection unit supporting drill string section 11-1.

Figure 3B:
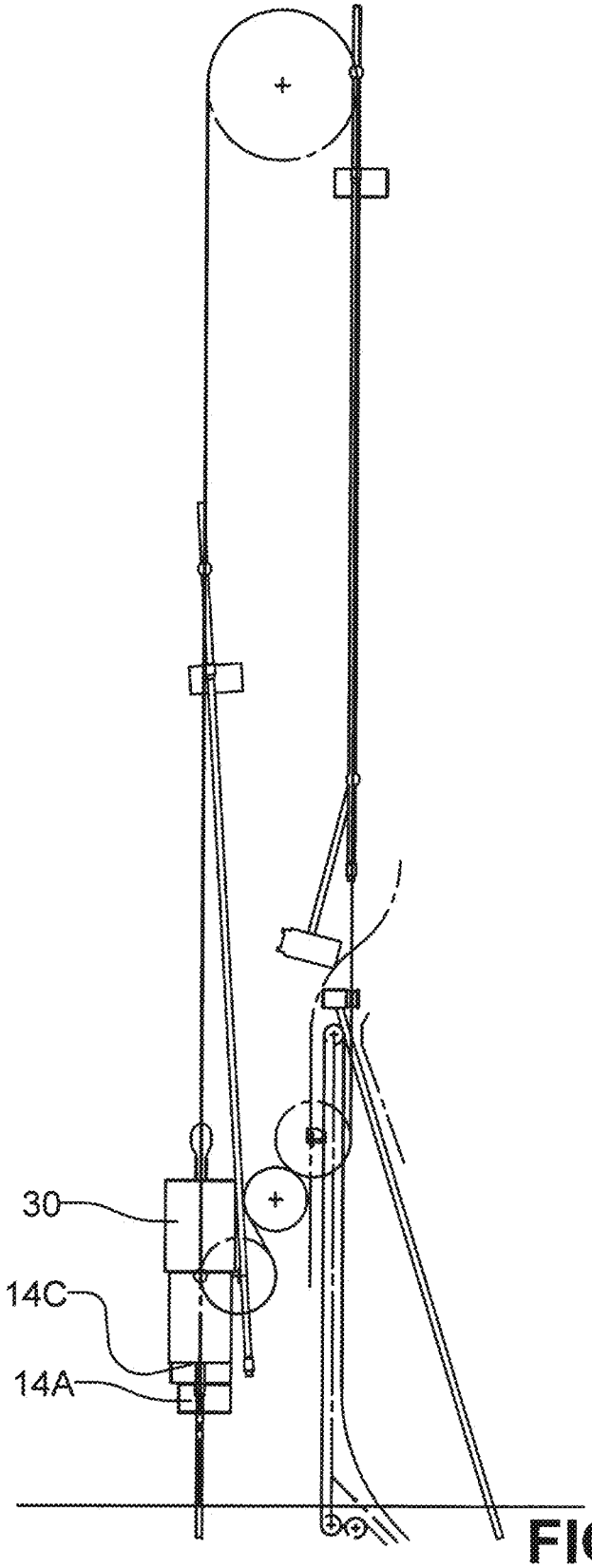

In FIG. 3B, make/break unit 14C holds the top of drill string 13 against rotation so that top drive 30 can be disconnected from drill string 13. Make break unit 14C may grip a quill of top drive 30 in one set of jaws and grip drill string 13 with another sect of jaws and then turn the two sets of jaws relative to one another. This avoids transmitting torque through whatever structure is supporting the top drive. Here the 'quill' of the top drive may include a saver sub, valve, crossover or other component that is carried by the top drive. In lower-torque applications the top drive may be driven to unmake the connection between the quill of top drive 30 and drill string 13.

Figure 3C:
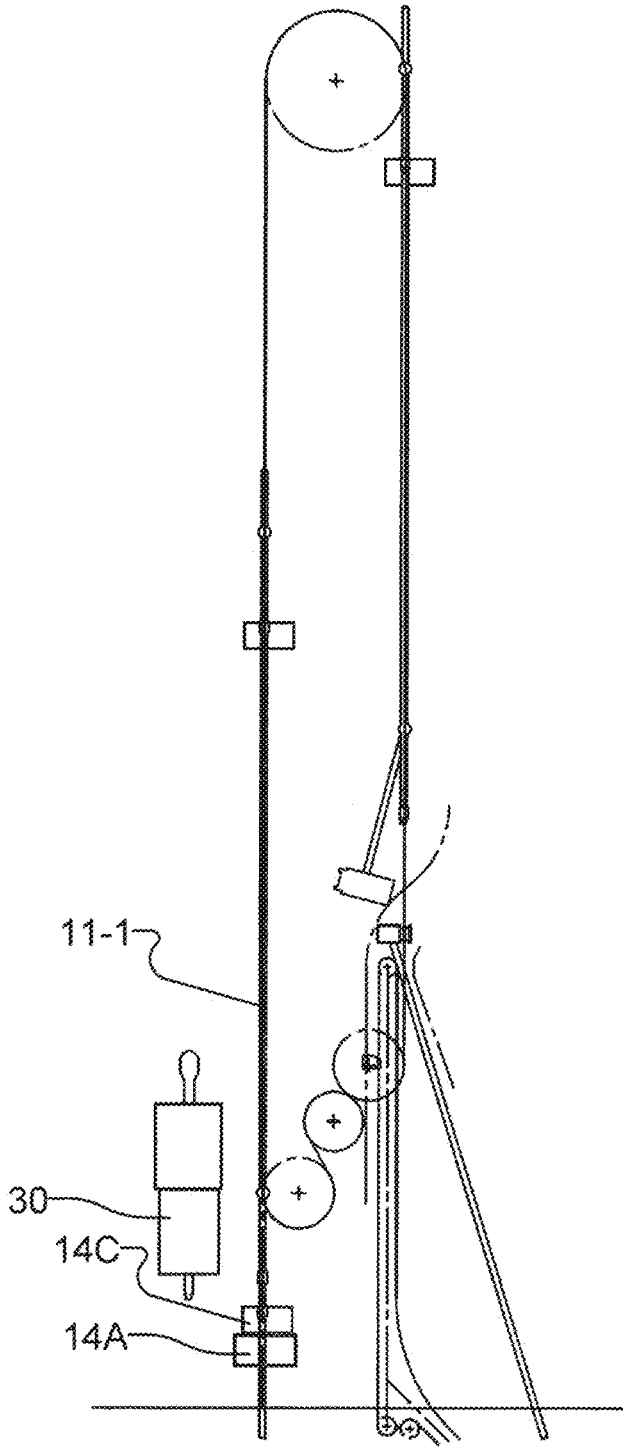
Figure 3D:
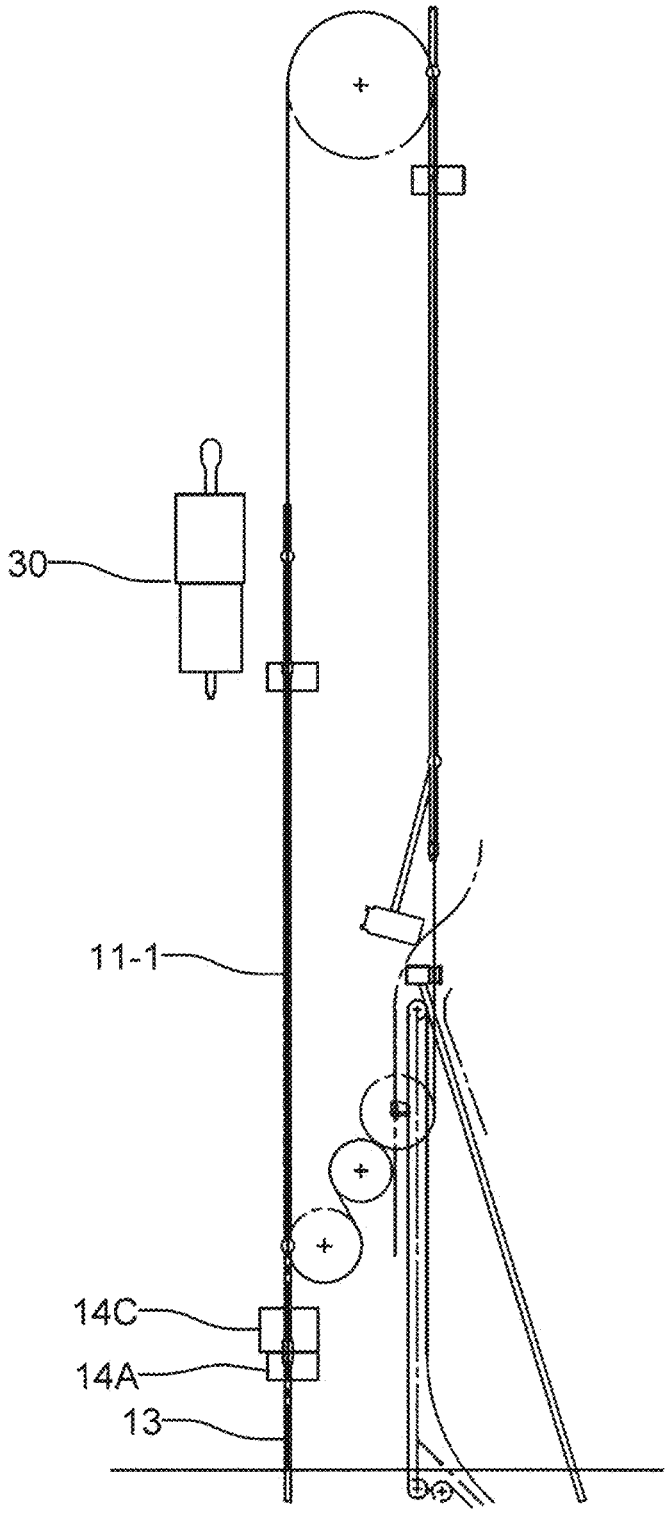

In FIG. 3C, top drive 30 is moved out of the line of drill string 13 and another drill string section 11-1 is moved into alignment with drill string section 13. As shown in FIG. 3D, make/break unit 14C then couples drill string section 11-1 to the top end of drill string 13. While this is being done, top drive 30 is hoisted to above the upper end of drill string section 11-1 by a hoist (not shown). The hoist may be relatively light duty because it only needs to transport top drive 30. While top drive 30 is being hoisted and/or while drill string connections are being made or unmade, apparatus 10 may oscillate the drill string up and down to reduce the likelihood of sticking of the drill string in the wellbore.

Figure 3E:
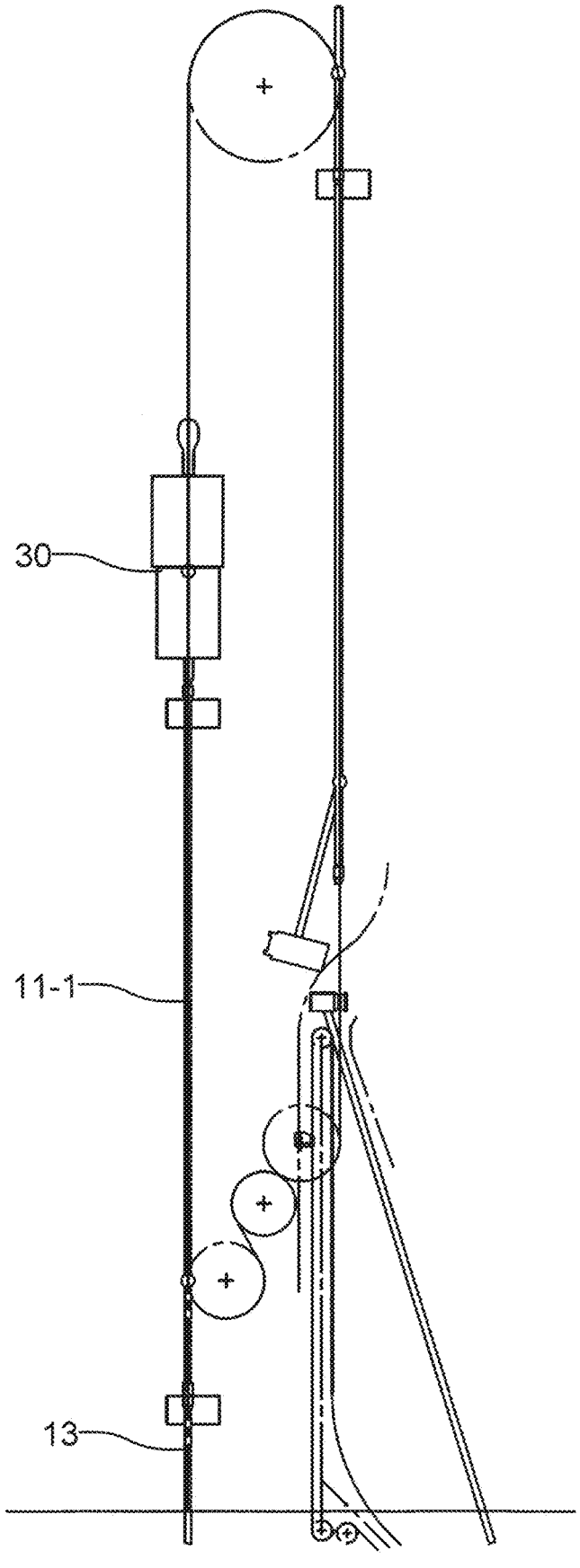
Figure 3F:
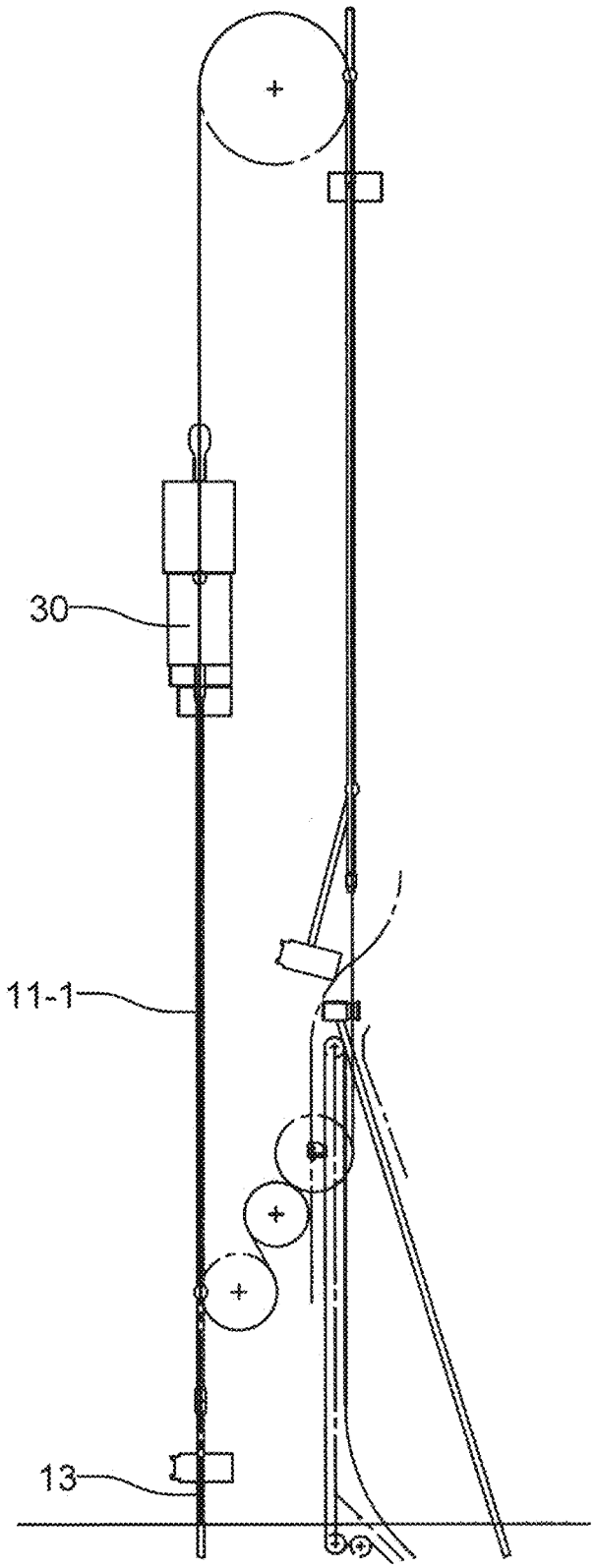

In FIG. 3E, top drive 30 is coupled to the upper end of drill string section 11-1. The coupling may be performed by gripping both the top drive quill and drill string by jaw sets of make break unit 14C and then operating make break unit 14C to make the connection. In situations involving lower torques (e.g. while using relatively small-diameter drill pipe make break unit 14C may hold the upper end of drill string section 11-1 against rotation and the quill of top drive 30 may be driven to make the connection. Drilling can then resume as shown in FIG. 3F. During this phase of drilling, if desired, pulldown may be applied to the drill string by operating the drive system to move the top drive and connection unit 14 downwardly.

Top drive 30 may be coupled to a connection unit 14 (see FIG. 1) or to a chain or other circulating member that carries connection units 14 around path 15. In the alternative, top drive 30 may be coupled to a separate track, chain or the like that guides top drive 30 to move along vertical section 15A of path 15 as drilling progresses.

As drilling continues, a new drill string section 11 may be handed off to another connection unit 14 which is travelling up on the backside 15C of path 15. As drilling progresses, the new drill string section may be tilted so that it does not damage top drive 30. When drilling has progressed to the point that the connection unit 14 with which the top drive is associated has again reached or is near the bottom of vertical section 15A as shown in FIG. 3A (i.e. it is time to attach a new drill string section to the top of the drill string) the process may be repeated. The process may be reversed for reaming operations.

Each of connection units 14 requires power to drive various actuators to perform functions such as raising or lowering the elevator, gripping or ungripping the drill string with a backup jaw, centralizing a drill string section to be added to the drill string, gripping and rotating the drill string, etc. Power may be supplied to connection units 14 in any of various ways.

Figure 4A:
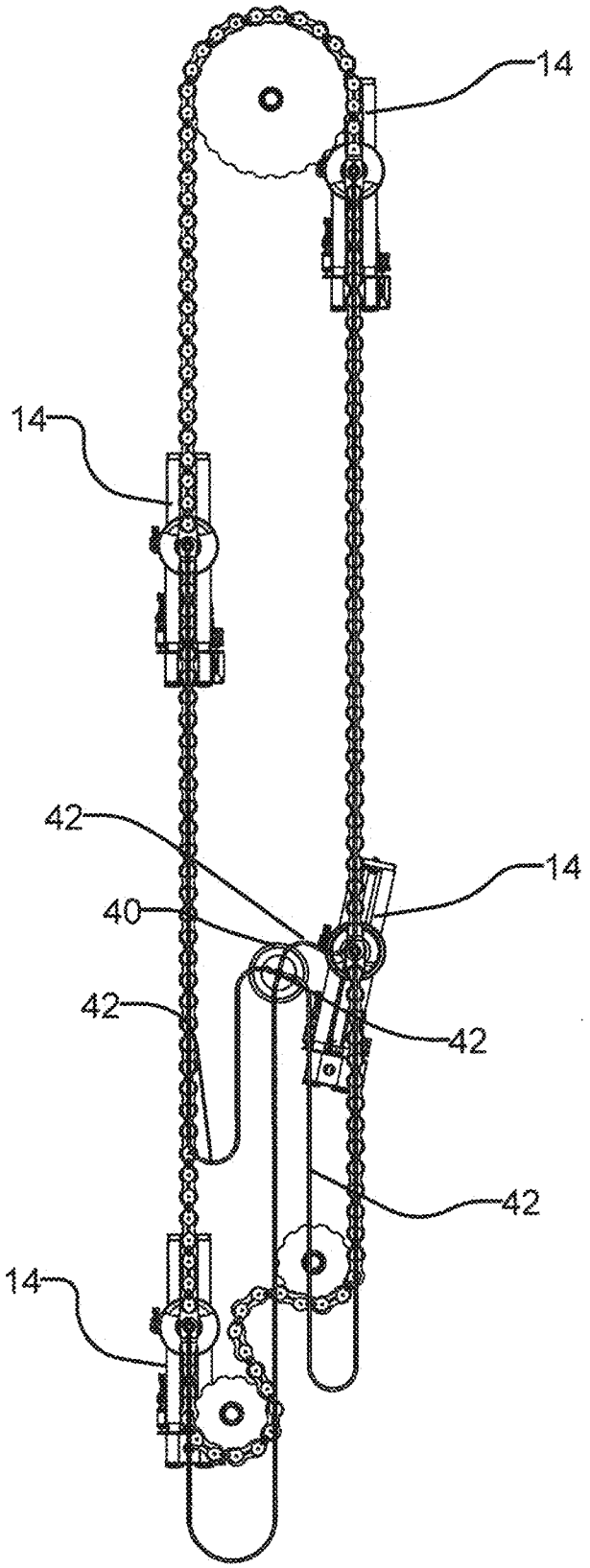
FIG. 4A is a schematic illustration showing one way to supply power to circulating connection units.

In one example embodiment illustrated in FIG. 4A, power is supplied to connection units 14 in the form of electrical or hydraulic power supplied by way of a rotary union 40 which may be located at a reasonably sensible location in path 15, such as a point that is central in path 15. Cables or hoses (not shown) carry hydraulic fluid and/or electrical power to or from rotary union 40 from a hydraulic pump or electrical power source. In some embodiments, rotary union 40 has a single fixed port and a plurality of rotating ports such that each rotating port may be connected to supply power to one of connection units 14.

In some embodiments hydraulic power is delivered to connection units 14 and electrical power is generated at connection units 14 by hydraulically-driven electrical generators. In some embodiments batteries are carried with connection units 14. The batteries may power sensors, control circuits and/or data communication systems for example. In some embodiments both hydraulic and electrical power are delivered to connection units 14 from a rotary union 40.

Flexible cables or hoses 42 carry the electrical or hydraulic power from rotating ports of rotary union 40 to the individual connection units 14. Each of these flexible cables or hoses may include a rotary coupling or union. Where connection units 14 are supported between circulating elements the flexible cables or hoses 42 may be routed to couplings on an outside face of one of the circulating elements which connect trough the circulating element to the corresponding connection unit 14. For example, the hose may connect to a corresponding connection unit 14 through a rotary union.

Each cable or hose 42 is long enough to reach the corresponding connection unit 14 anywhere along path 15. As connection units 14 circulate around path 15 in either direction, rotary union(s) 40 also rotate. Rotary union(s) 40 may optionally be driven to rotate together with the circulation of the connection units 14 around path 15.

Figure 4B:
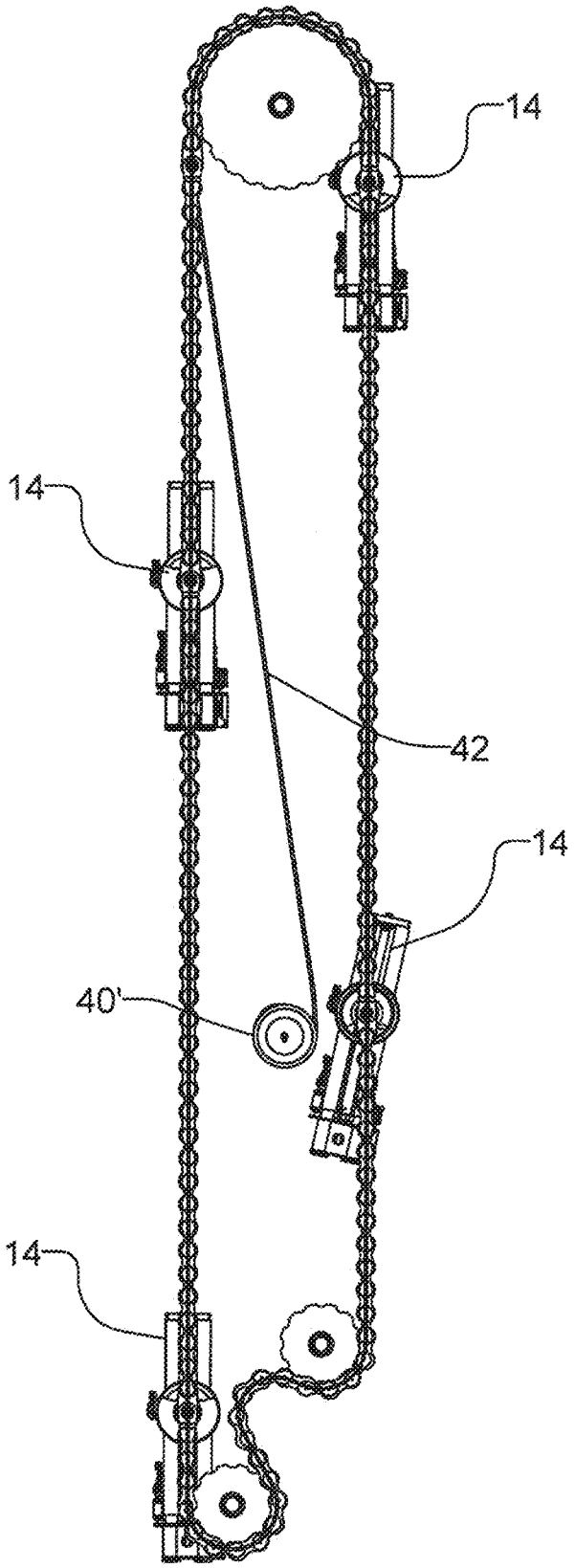
FIG. 4B is a schematic illustration showing another way to supply power to circulating connection units.

As illustrated in FIG. 4B, instead of providing separate cables or hoses from a rotary union to individual connection units 14, a cable or hose may be routed from a rotary union 40' to a point on path 15 and then continue along path 15 to service a plurality of connection units 14. As above, the cable or hose connected to the point on path 15 may include a rotary union at either or both ends and/or somewhere along its length to avoid twisting of the cable or hose. In some embodiments a plurality of cables and/or hoses are coupled to each connection unit 14. Each one of the cables or hoses may comprise one section that extends from a rotary union to path 15 and then extends along path 15 to service each one of the connection units 14.

In an example embodiment, each of connection units 14 is connected to receive a pressure-side hydraulic hose and a return-side hydraulic hose. In some such embodiments, the pressure side hose may be routed from a hydraulic power unit to a non-rotating port of a first rotary union, from a rotating port of the first rotary union to a first point on path 15 and then connected to pressure-side fittings on all of connection units 14 through one or more hose sections that extend generally along path 15 and circulate around path 15. Similarly, return-side hoses may extend along path 15 from return fittings on each of connection units 14 to a second point on path 15. A return hose may connect the second point to a rotating port of a second rotary coupling. The return path may be completed by a hose extending from a non-rotating port of the second rotary coupling back to the hydraulic power unit. In some embodiments the pressure-side hose extends along a first chain on one side of the apparatus and the return-side hose extends along a second chain on a second side of the apparatus. In some embodiments the chains comprise pins and hydraulic fluid is routed to and/or from connection units 14 through channels that extend through pins of the chains In some embodiments, separate rotary unions are provided for the pressure and return sides of a hydraulic power supply or for the two or more wires required to complete an electrical circuit. In some embodiments, one rotary union is provided on each side of an apparatus.

Control of the functions of each connecting unit 14 as well as apparatus 10 may be coordinated by a control system which may be made up of one or more controllers. The controllers may, for example, comprise programmable controllers such as PLCs. The controllers may communicate with each of connection units 14 by way of wired or wireless data connections and may also receive status information from the connection units 14 by way of the wired or wireless data connections. Wired data connections may be provided alongside or be integrated with power connections (as described above for example). The control system may control functions such as opening and closing elevators 14A or controlling the gripping and ungripping of drill string sections by jaws 14D and/or 14E, and or controlling rotation of rotatable jaw 14E and/or controlling operation of elevation adjuster 14B. The data communication network may also transmit signals back to the control system.

These signals may include signals such as a reading from a load cell or a hydraulic pressure in the hydraulic circuit controlling elevation adjuster 14B. This signal is indicative of the extent to which a particular elevator is supporting the weight of the drill string. By monitoring this signal, the control system can determine when weight of the drill string has been handed off from one of connection unit 14 to another connection unit 14. Other signals may indicate circumstances such as the presence of a drill string section at a particular location, whether an elevator is closed or open, torque applied to make or break a connection between drill string segments, the current elevation of an elevator 14A (measured, for example, by a linear position sensor), the current status of a pipe handling system and the like.

In some embodiments the control system uses advance knowledge of the lengths of individual drill string sections to be added to or removed from a drill string to position elevators 14A at optimum elevations. By doing so, the apparatus may be made to operate somewhat more quickly since elevators 14A can be pre-positioned at elevations such that the travel of the elevators during hand off from one elevator 14A to the next elevator 14A is reduced.

Knowledge of the lengths of tubulars may be acquired in any of a variety of ways. In some embodiments, pipe handling system 17 includes a system for measuring tubulars. Pipe handling system 17 may pass measurements for the tubulars to the control system. In some embodiments, the control system is configured to store the lengths of tubulars when the tubulars are first handled (e.g. during drilling). For example, the length of a tubular may be measured when the tubular is being coupled into the drill string or being coupled to a top drive. In some embodiments the control system bases a measurement of the length of the tubular on the distance between a top drive coupled to the tubular and an elevator 14A holding the drill string. Once the tubulars have been measured then the length of each tubular is known (as long as the sequence of the tubulars is preserved).

In some embodiments the control system has access to a data store containing the length of each tubular cross-referenced to a machine-readable identifier for the tubular. A reader reads the machine-readable identifier and the control system can then look up the corresponding length in the database. Some example systems for identifying and tracking drill string sections are described in U.S. Pat. No. 4,701,869A; WO2012128735A1; US20100171593A1; US20050230109A1; U.S. Pat. No. 8,463,664B2; and GB2472929A all of which are hereby incorporated herein by reference.

In other embodiments, the length of a drill string section 11 can be detected in real time. Example ways to measure a drill string section include:

- Detecting the presence of one end of a drill string section 11 at a centralizer (e.g. immediately prior to coupling the drill string section into the drill string or immediately after uncoupling the drill string section from the drill string) and calculating the length of the drill string section 11 based on the distance between the centralizer and an elevator supporting the drill string section (which can be known from the geometry of the apparatus and the positions of elevator adjusters 14F—which may, for example, be measured using linear position sensors).
- Determining the distance between an elevator 14A supporting a drill string section and a conveyor backstop of a pipe handling system 17 at the time when the conveyor torque significantly decreases (i.e. tubular liftoff) .
- Determining the distance between locations of two elevators at the time when the weight of the drill string is transferred from one of the elevators to another.
- Measuring drill string sections 11 off line and recording the measurements.
- etc.

In some embodiments, RFID tags may be employed to store information on each drill string section 11. A sensor on apparatus 10 may keep track of each RFID tag for prediction of the length of each drill string section 11.

Where the length of each drill string section 11 is known in advance, the control system may actuate an elevator adjuster 14B in advance to position the corresponding elevator 14A at an appropriate elevation such that coupling/uncoupling of the tubular from the drill string and/or passing off of the weight of the drill string from one elevator 14A to another can be made with minimum travel of elevator adjusters 14B. This may allow for increased and consistent tripping speeds.

A system as described above may be implemented in various ways. FIGS. 5A through 5D illustrate connection units 14 according to non-limiting example embodiments. Elevator 14A is fully raised in FIGS. 5A and 5C and fully lowered in FIGS. 5B and 5D. Each connection unit may comprise a platform suspended from pivotal connection points on circulating elements by extendable beams. The extendable beams may be retracted or extended to raise or lower the platform relative to the circulating members and can withstand bending moments. The extendable beans may have various constructions including linear rails, telescoping members or the like. The extendable beams may be integrated with actuators connected to extend or retract the extendable beams or may be extended or retracted by separate actuators.

In the embodiments shown in FIGS. 5A and 5B elevator adjustment mechanisms 14B comprises a trunnion-mounted hydraulic cylinder 52 having a piston 53 that can be extended or retracted to move a cross-arm 54 vertically relative to a frame 58. Elevator 14A is suspended from cross-arm 54 by links 56 which are pivotally mounted at points 57 to an assembly comprising elevator 14A. Connection unit 14 may be connected between a pair of parallel chains or other flexible elements arranged to circulate around a path 15. Connection unit 14 may be coupled to the flexible elements by spigots 55.

FIGS. 5C and 5D illustrate another example apparatus 58 useful for mounting a device such as an elevator, connection unit, make/break unit or other device to a circulating flexible element (e.g. a chain) while permitting adjustment of the elevation of all or part of the apparatus relative to a connection point). Apparatus 58 comprises a generally U-shaped frame 58A. Frame 58A is made up of a number of parallel linear rails 58B. In the example embodiments shown, two linear rails 58B are provided on each side of frame 58. Linear rails 58B may comprise round shafts, for example. Linear rails 58B are held in parallel relationship to one another by a base 58C at their lower ends as well as by bridges 58D at their upper ends. In the illustrated embodiment, base 58C comprises a weldment that includes upper and lower plates 58C-1 and 58C-2.

Spigots 55 or other attachment members are provided on carriages 58E that are slidable along linear rails 58B. In the illustrated embodiment, each carriage 58E comprises a pair of guide tubes 58F. Suitable bushings or linear bearings 58J within guide tubes 58F facilitate sliding of carriages 58F along linear rails 58B without binding. Guide tubes 58F facilitate spacing bushings or bearings 58J widely apart so that normal forces on bearings or bushings 58J are reduced, thereby reducing friction. Such normal forces resist bending moments on linear rails 58B that may arise as the weight of drill string 13 is applied to base 58C.

Carriages 58E are positioned relative to base 58C by linear actuators 58G. In the illustrated embodiment, actuators 58G comprise hydraulic cylinders. The body 58G-1 of each cylinder is coupled to the corresponding carriage 58E and the rod 58G-2 of each cylinder extends to engage the corresponding bridge 58D. Base 58C (and any apparatus carried on base 58C) can be raised relative to spigots 55 by extending actuators 58G. Base 58C can be lowered relative to spigots 55 by retracting actuators 58G.

Figure 5E:
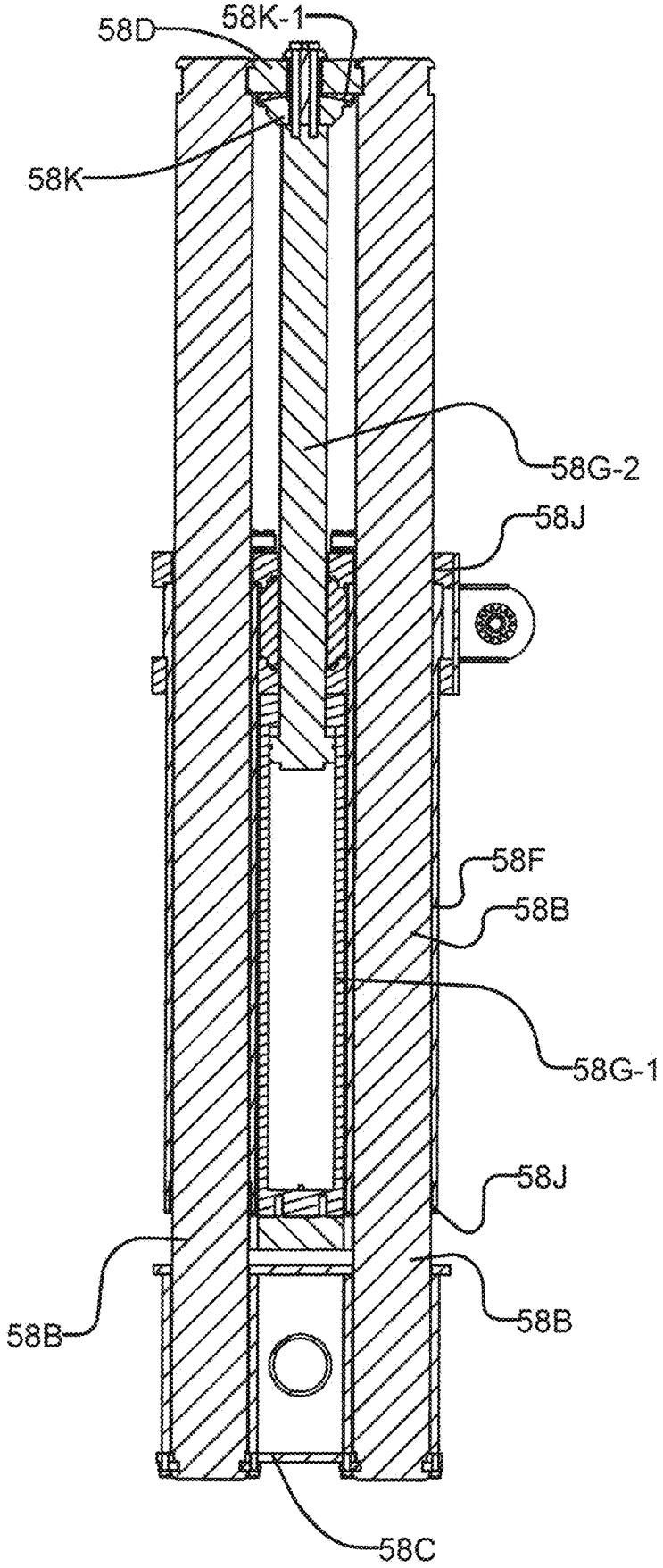
FIGS. 5E and 5F are cross sectional elevation views of parts of the apparatus of FIG. 5C.
Figure 5F:
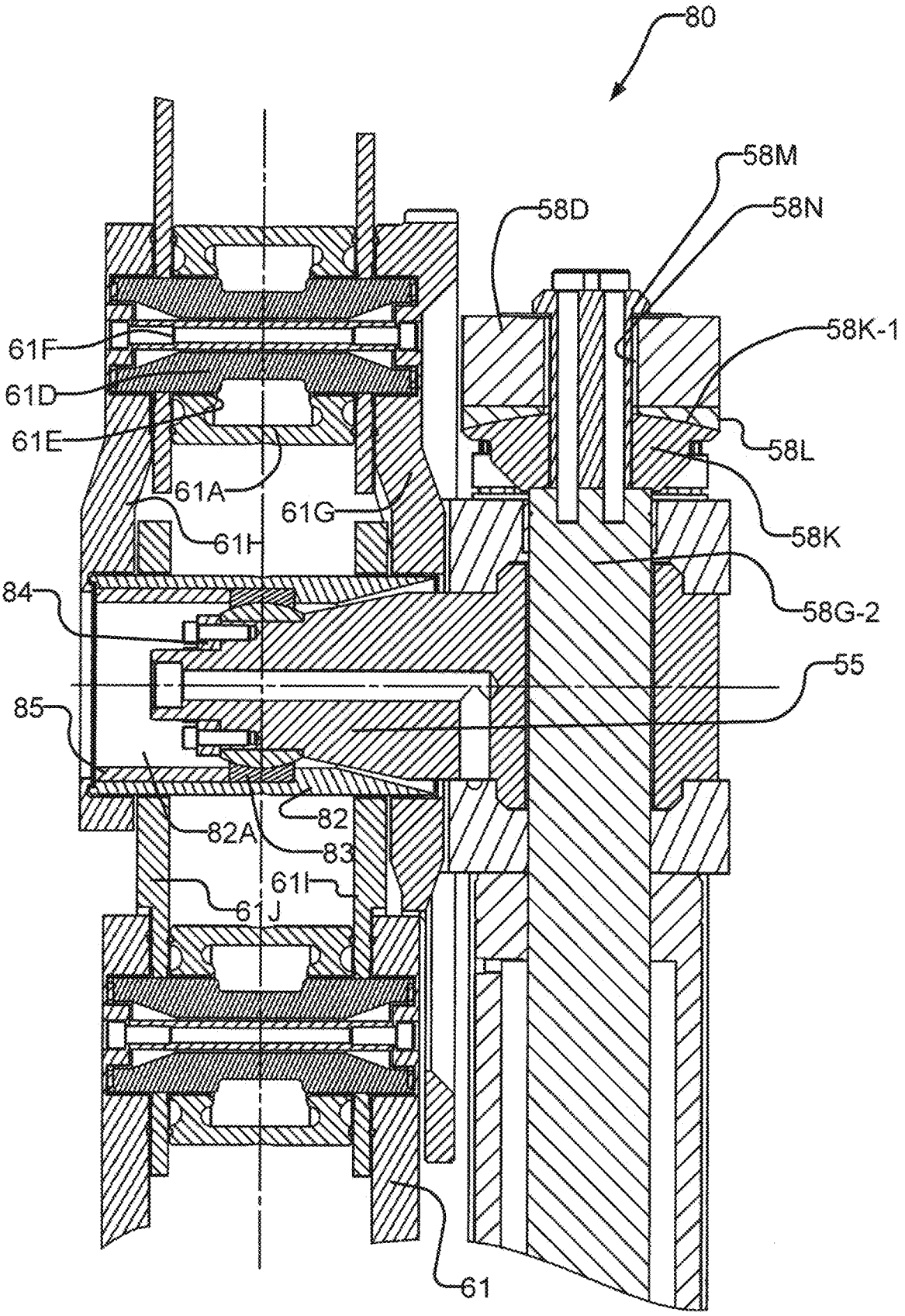

In some embodiments, ends of rods 58G-2 are coupled to bridges 58D in a manner that permits certain movements of the rod ends relative to bridges 58D. For example, the coupling may permit rod ends to move laterally and/or to pivot relative to bridges 58D. Such connections may avoid placing side loads on rods 58G-2 even in cases where there is some deflection of frame 58A due to very high loads applied through base 58C. FIG. 5E is an elevation cross-section through one side of apparatus 58. FIG. 5F is a cross section though a top end of rod 58G-2. These figures illustrate a possible arrangement for interfacing the top end of rod 58G-2 to bridge 58D. In this example embodiment, rod 58G-1 carries a washer 58K that engages a lower surface of bridge 58D. Washer 58K has a curved (e.g. spherical) upper surface 58K-1 that fits into a correspondingly-curved concave surface provided by a washer 58L. This allows bridge 58D to tilt without applying significant bending moments to rod 58G-2. A pin 58M projects from rod 58G-2 through an aperture 58N in bridge 58D. Aperture 58N is larger than pin 58M such that the end of rod 58G-2 can move laterally relative to bridge 58D.

Apparatus of a wide variety of types may be supported by or from base 58C. In the illustrated embodiment a make/break unit 58H is provided. Other example embodiments may provide only an elevator on base 58C. Make/break unit 58H may comprise one or more motors 58H-1 and 58H-2, as illustrated in FIG. 5C, for actuating make/break unit 58H. Motors 58H-1, 58H-2 may be located on a front side of base 58C (i.e. on the same side as the opening of make/break unit 58H), as illustrated or on a back side of base 58C (i.e. behind the opening of make/break unit 58H).

Figure 6A:
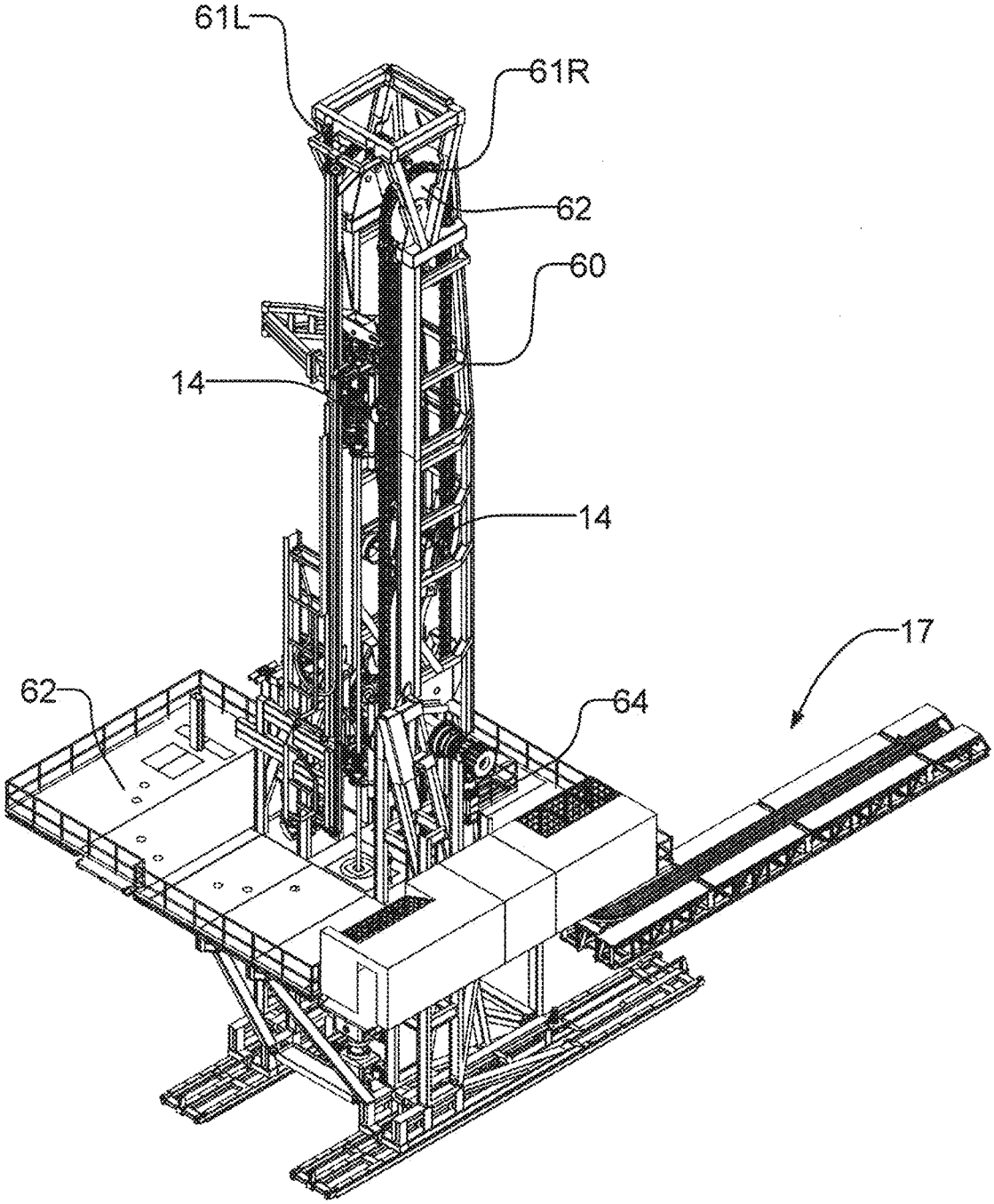
FIGS. 6A and 6B are illustrations showing overall layout and some construction details of a drill string handling system according to an example embodiment.
Figure 6B:
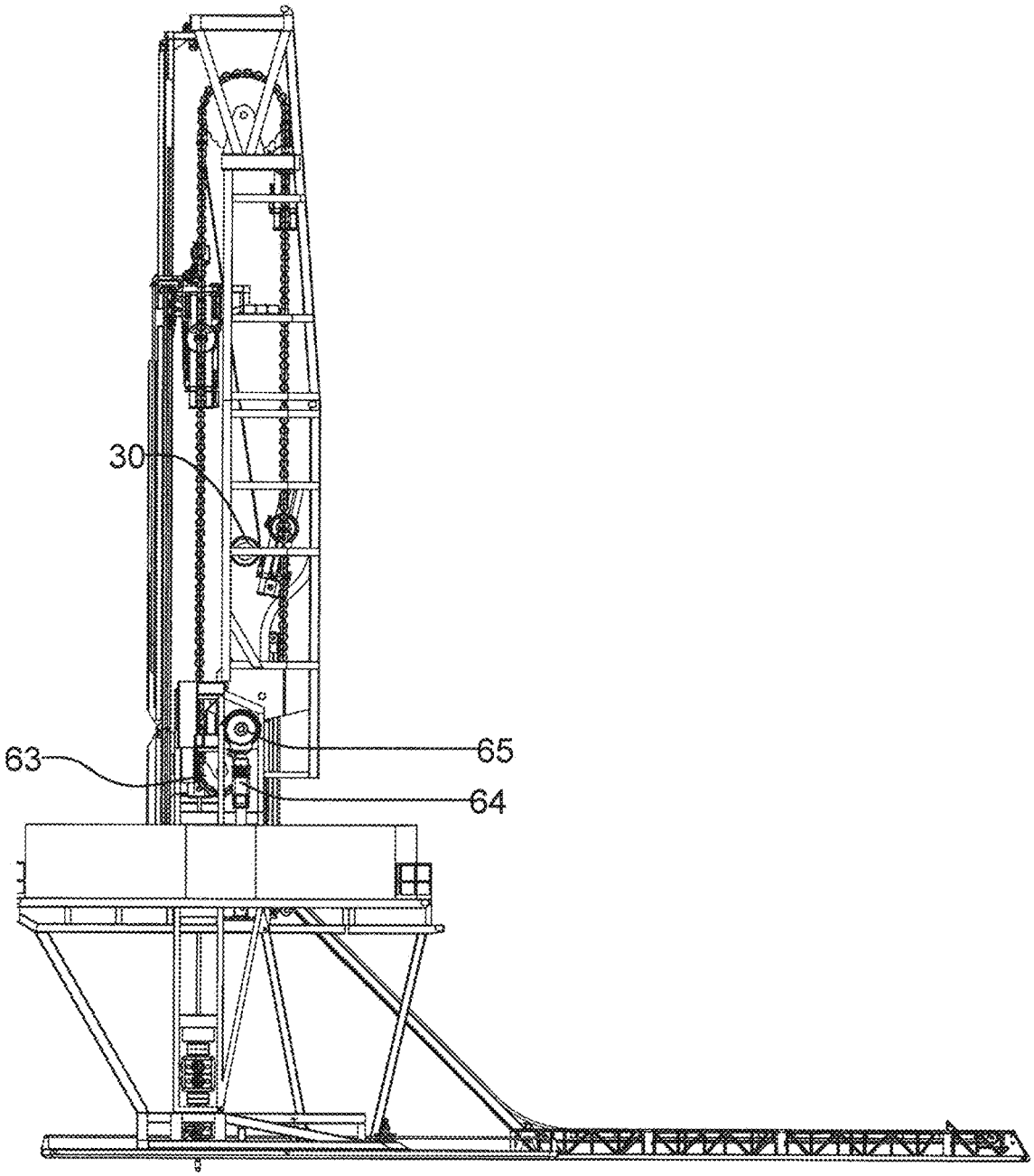

FIGS. 6A and 6B illustrate an apparatus 10 according to one non-limiting example embodiment. Apparatus 10 as illustrated in these Figures comprises a mast 60. Mast 60 supports chains 61L and 61R which are operable to circulate around sprockets 62 when driven by drive sprockets 63. The arrangement of sprockets 62 may be varied, for example chains 61L and 61R may pass around one larger sprocket 62 or a plurality of smaller sprockets 62 at the top of mast 60.

Drive sprockets 63 may be driven, for example, by a hydraulic or electric motor through a suitable power transmission such as a planetary transmission. FIG. 6B shows motor 64 and transmission 65. Motor 64 may drive transmission 65 via a gear, chain or belt drive however, this is not mandatory.

Figure 14:
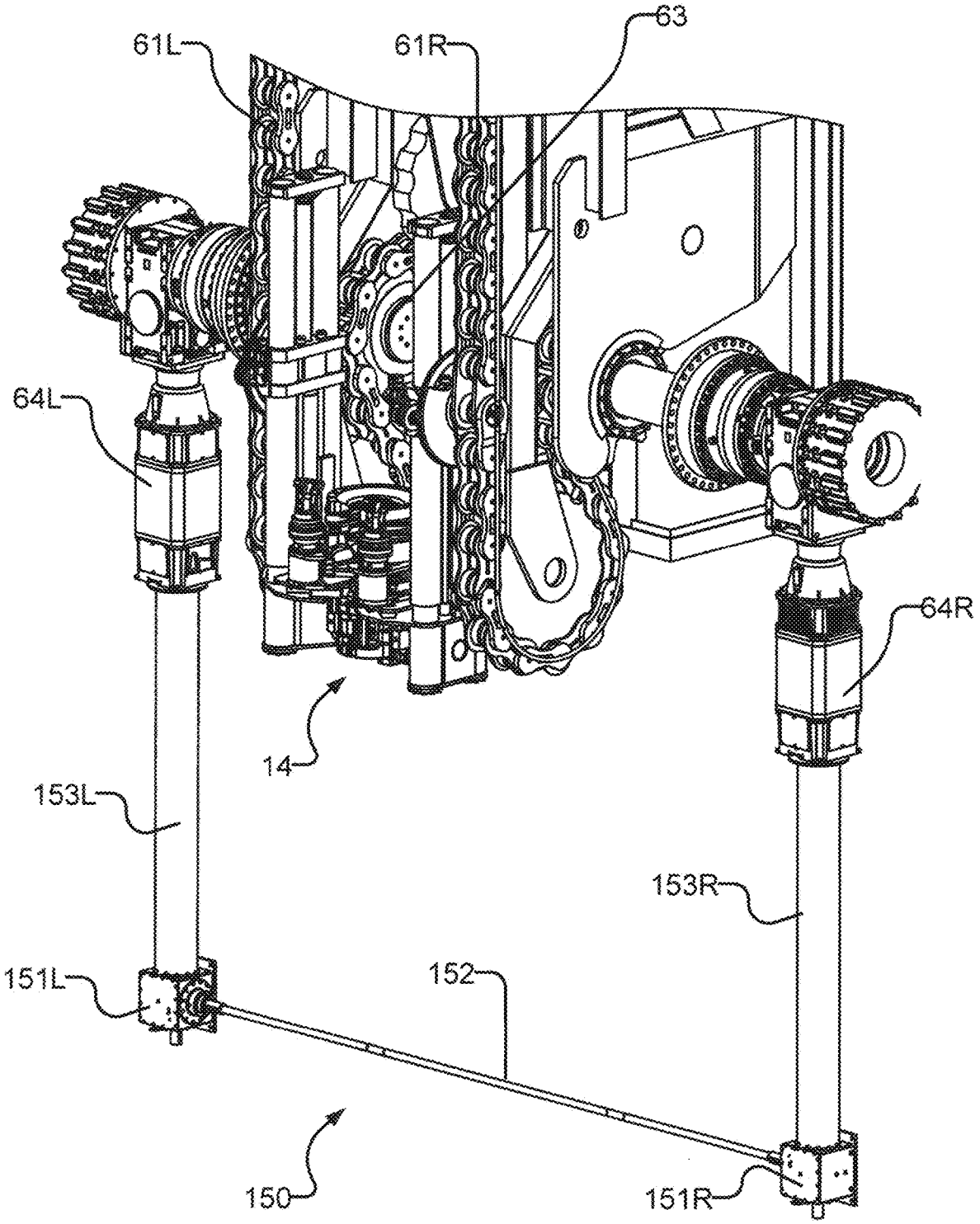
FIG. 14 shows a mechanical motor synchronization system.
Figure 15:
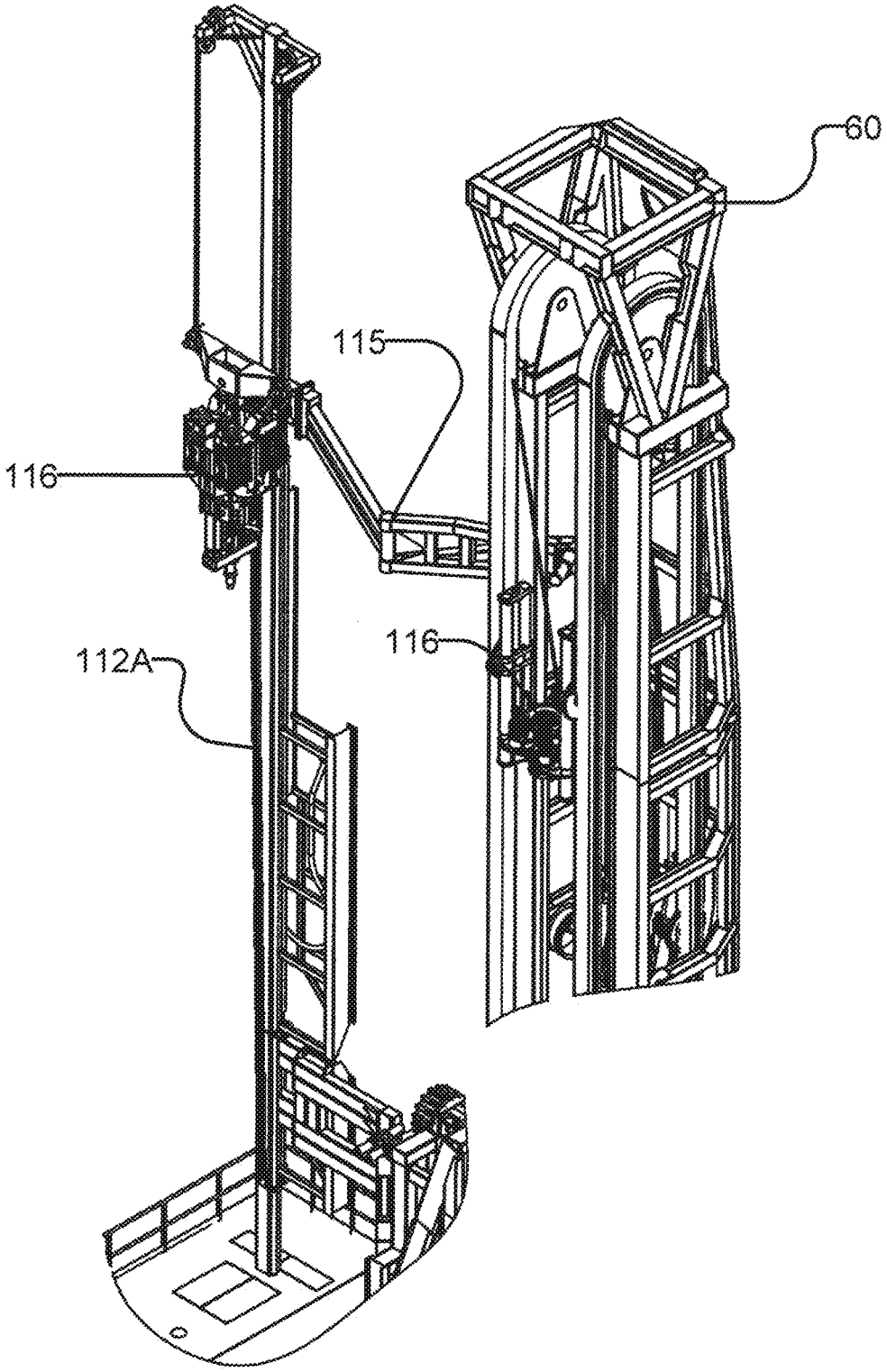
FIG. 15 shows an example track system useful for supporting accessory equipment such as a top drive. The track is movable toward or away from well center.

In the illustrated embodiment a separate motor 64 is coupled to drive each chain 61. Operation of motors 64 is synchronized such that chains 61 circulate in synch with one another. In some embodiments motors 64 are synchronized by the operation of electronic motor control systems. In some embodiments motors 64 are mechanically synchronized. This may be achieved by providing a mechanical transmission that couples together rotors of motors 64. For example, FIG. 14 shows an example embodiment wherein two motors 64R and 64L are coupled by a synchronizing transmission 150 which includes a pair of right angle drives 151R and 151L coupled by a shaft 152. Right angle drives 151R and 151L are respectively coupled to motors 64R and 64L by shafts 153R and 153L. A chain or non-slip belt drive could be used to couple rotation of shafts 153R and 153L in place of right angle drives 151R and 151L and shaft 152.

Chains 61L and 61R may be sidebar-style chains such as roller chains, for example. Coupling units 14 are pivotally mounted between chains 61L and 61R. In the example embodiment, each coupling unit 14 is connected so that force is transferred to chains 61L and 61R through the centerlines of the chains. Beneficially coupling units 14 may include a rigid cross-member that is coupled to each of chains 61R and 61L and acts as a load equalizer. Elevator 14A may be supported by such a rigid member such that the load carried by elevator 14A is split between chains 16. Such load sharing is facilitated by connecting coupling units 14 to chains 61 using couplings which can accommodate some changes in alignment of the rigid cross member. For example, the rigid cross member may couple to chains 61 using spherical bearings, an example of which is described below.

Advantageously in some embodiments, drive sprockets 63 engage chains 61 on the outside of the loops of chains 61. This facilitates disassembly of mast 60. For example, sprockets 63 may be provided on a first component and the part of mast 60 that carries chains 61 may be on a second component. The first and second components may be separated for transport and assembled to provide apparatus 10 at a well site. Each drive sprocket 63 may engage a corresponding one of chains 61 in a gap between a pair of other sprockets such that appropriate wrap is provided around the drive sprocket 63. This construction permits assembly of apparatus 10 without taking chains 61 apart.

In some embodiments a top drive 30 or other apparatus is removably coupled to a roller chain (e.g. chains 61) or other sidebar type chain by a coupling 70 of the type illustrated in FIG. 7. Coupling 70 includes specially-shaped trunnions 72 that engage in the openings 61C between adjacent rollers 61A and opposing chain plates 61B of a chain 61. As shown best in FIGS. 7D, 7E and 7F, the end 72A of each trunnion 72 is shaped so that in one dimension it is smaller than the distance between adjacent rollers 61A and in another dimension it is larger than the distance between adjacent rollers 61A. In the illustrated embodiments, the smaller dimension is provided by tapered surfaces 61B on either side of trunnion 72. Behind end portion 72A, trunnions 72 are necked down to provide a bearing area 72D. As shown best in FIG. 7E, bearing area 72D may be provided by a circumferential groove around trunnion 72 having a radius substantially equal to that of rollers 61A. With this construction, tips or ears 72C project on either side of trunnion 72. Tips or ears 72C define the wide dimension.

Figure 7A:
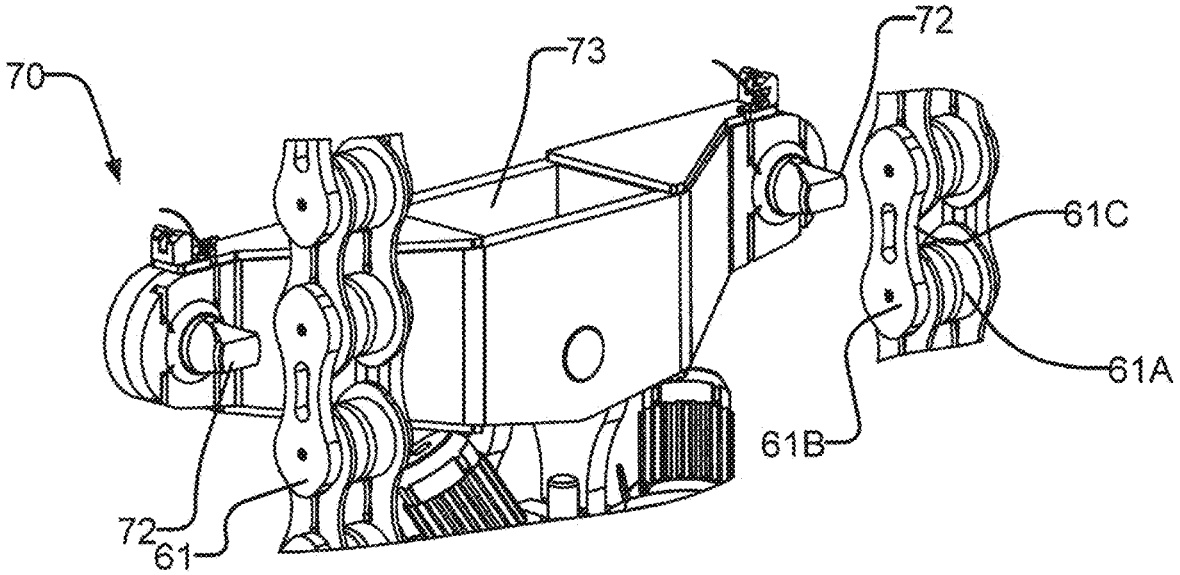
FIGS. 7A to 7C illustrate a coupling suitable for coupling a top drive or other device to a roller chain.
Figure 7B:
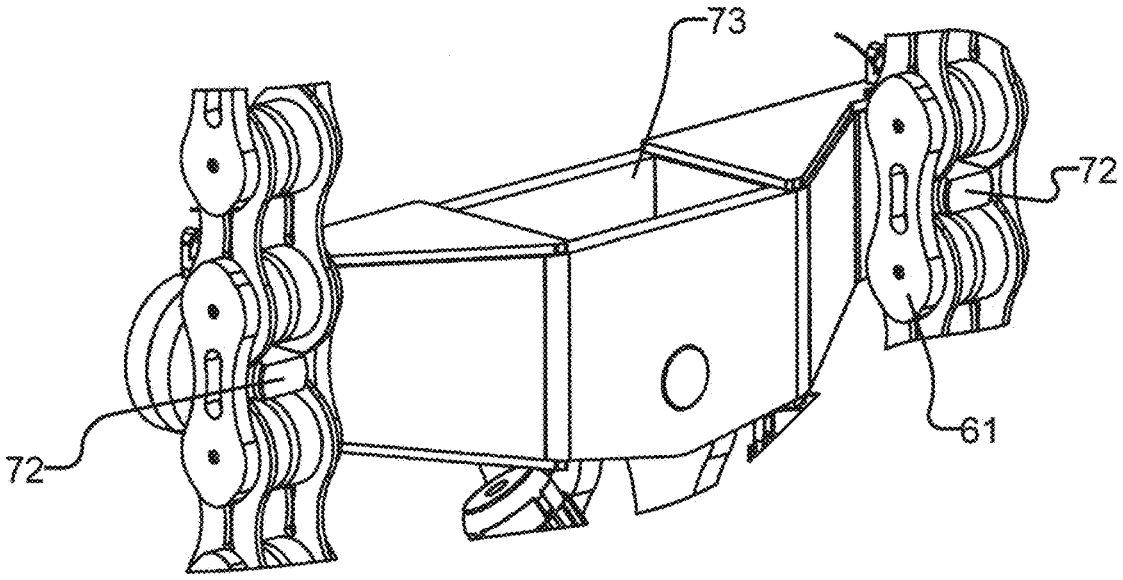
Figure 7C:
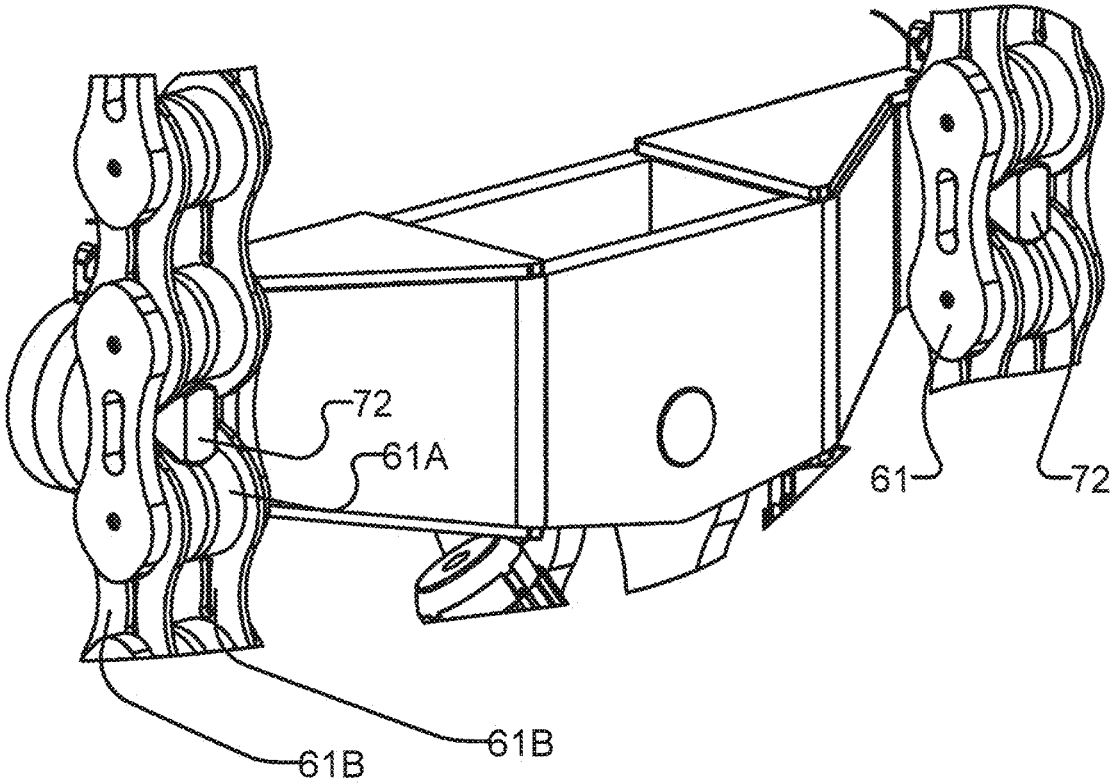
Figure 7D:
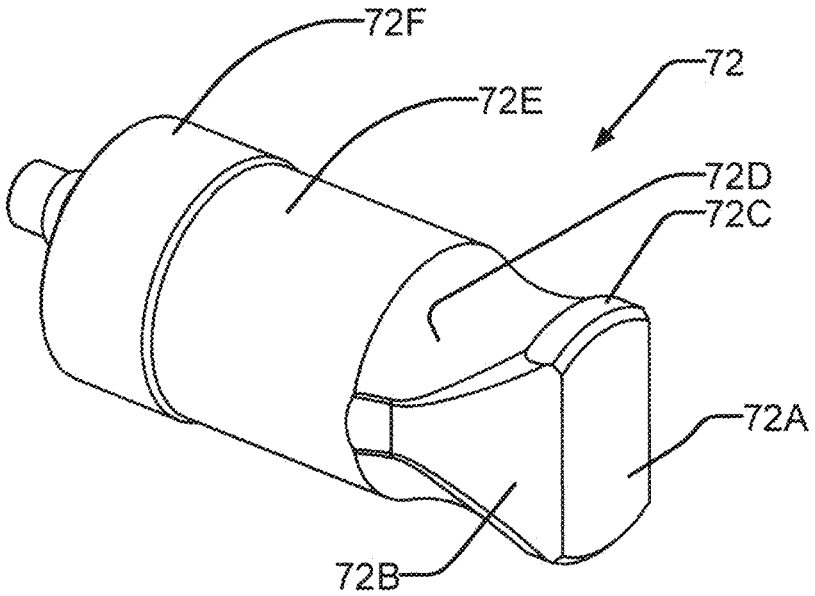
FIGS. 7D, 7E and 7F show an example pin for the coupling of FIGS. 7A to 7C.
Figure 7E:
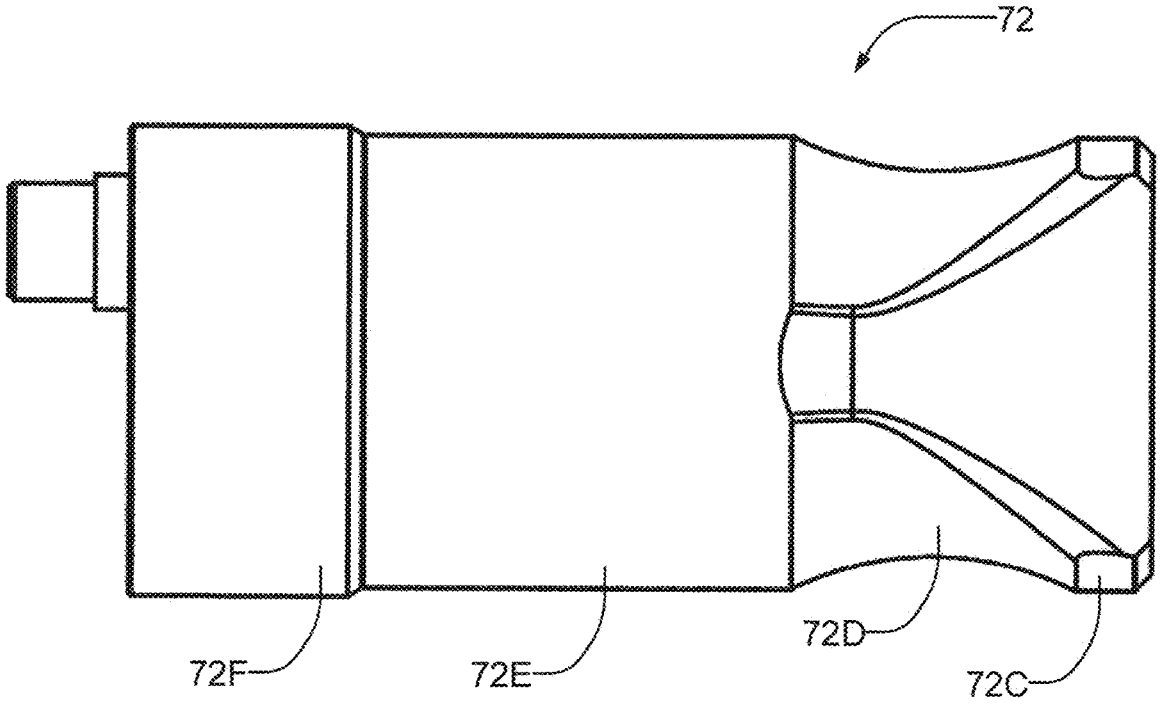
Figure 7F:
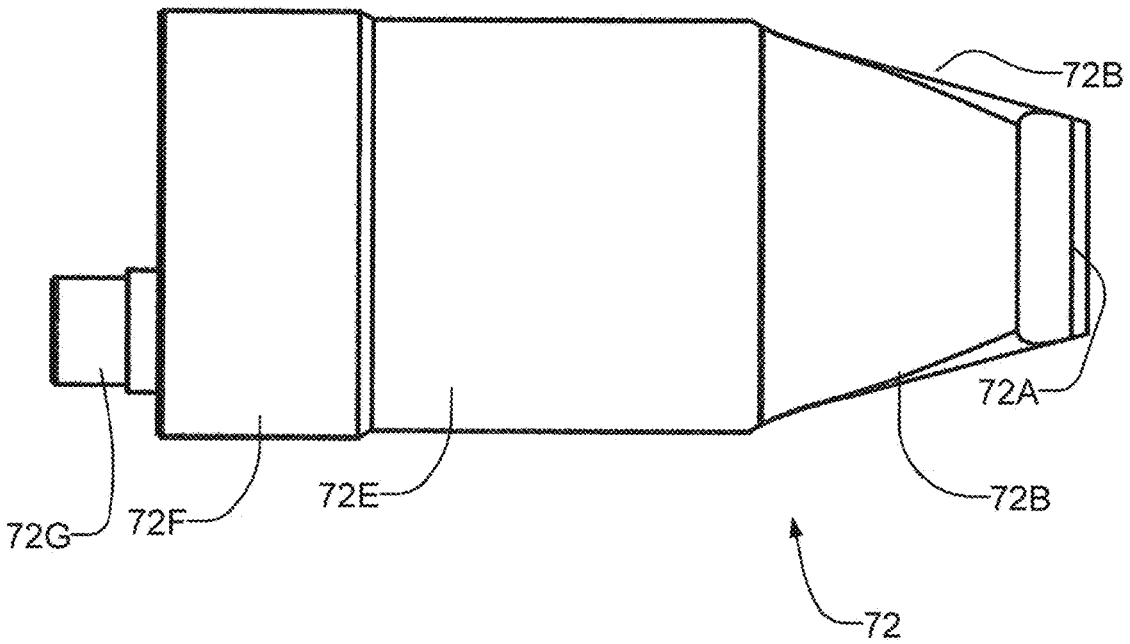

As shown in FIG. 7A, a pair of trunnions 72 may be provided. One trunnion 72 may engage each chain 61. Initially trunnions 72 are oriented with their wide dimensions transverse to chains 61. Trunnions 72 can then be inserted through selected apertures 61C as shown in FIG. 7B. Tapered surfaces 72B help to guide trunnions 72 into openings 61C. When pins 72 are sufficiently inserted into openings 61C, trunnions 72 can be rotated by 90 degrees as shown in FIG. 7C. In the rotated configuration, trunnions 72 engage rollers 61A.

In the illustrated embodiment, two trunnions 72 are supported by a frame 73. The centers of trunnions 72 are spaced apart by a distance equal to a distance between the center lines of chains 61. Bearing surfaces 72E are rotatably supported by frame 73 (e.g. in suitable bushings or bearings). Expanded portions 72F keep trunnions 72 from pulling out from frame 73.

Figure 7G:
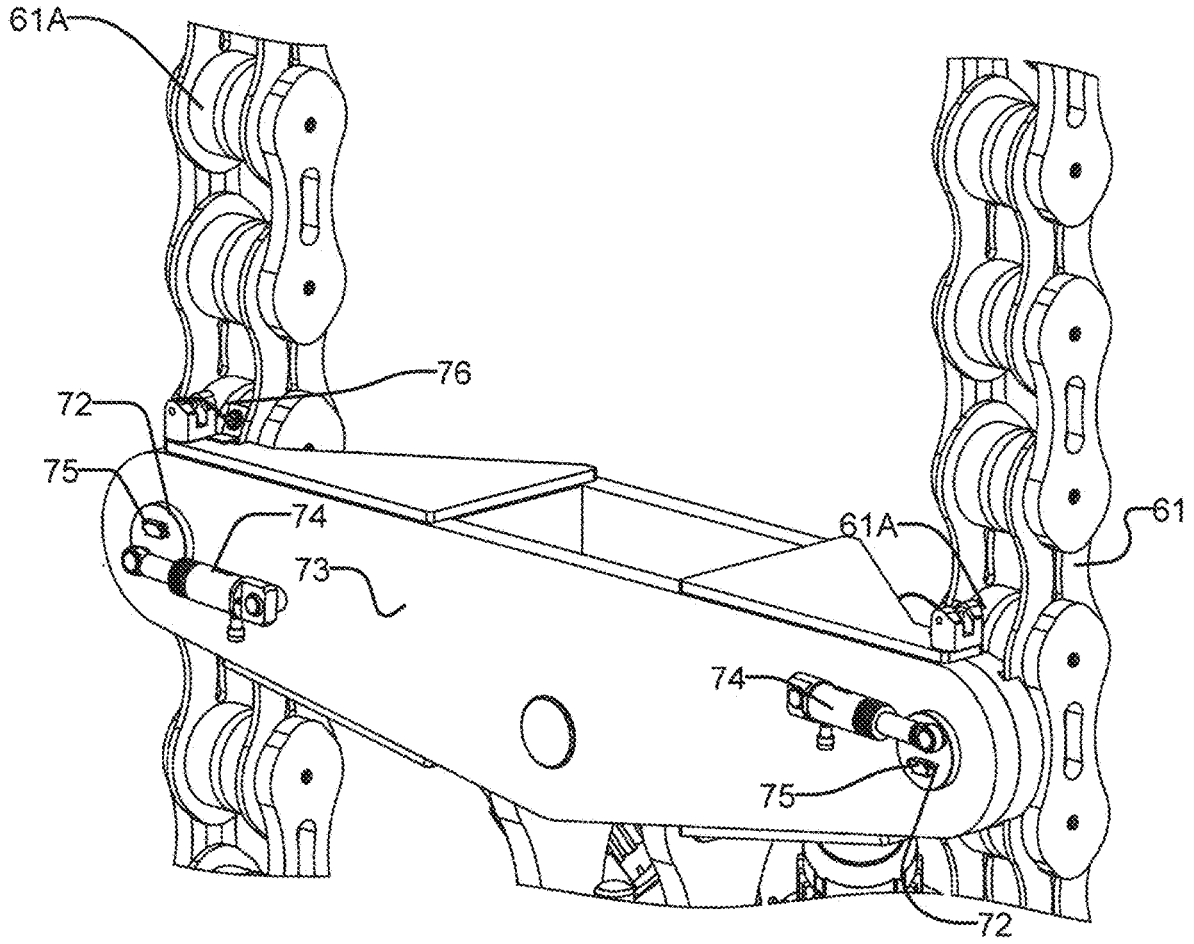
FIG. 7G is a perspective view showing an example actuation mechanism and instrumentation for the coupling of FIGS. 7A to 7C.

Suitable actuators are provided to rotate trunnions 72 between their unlocked and locked orientations. In alternative embodiments a single actuator may be provided to rotate both trunnions 72 by way of suitable gearing or linkages. Rotary or linear actuator s may be provided to rotate trunnions 72. FIG. 7G shows an example embodiment wherein a linear actuator 74 (e.g. a hydraulic cylinder) is provided to move each trunnion 72 between its locked and unlocked orientations. In the illustrated embodiment, actuator 74 engages an off-centre drive pin 72G.

Sensors may be provided to verify successful coupling of trunnions 72 to chain 61. In the illustrated embodiment, inclination sensors 75 are provided on each trunnion 72. Inclination sensors 74 can detect the angle of rotation of each trunnion 72. Proximity sensors 76 are also provided. When coupling 70 is successfully coupled to chains 61 each of proximity sensors 76 is located close to a roller 61A of the corresponding chain 61. A safety mechanism (e.g. an electronic controller) may detect successful coupling of coupling 70 to chains 61 by verifying that both of proximity sensors 76 detect a roller (or other suitable part) of a chain 61 and also that inclination sensors 75 indicate that both of trunnions 72 are oriented in their engaged ('locked') configurations.

Coupling 70 may be applied to couple any desired equipment to chains 61. For example, a top drive or a make break unit may be coupled anywhere along chains 61 using coupling 70. Coupling 70 may be located such that the quill of a top drive attached between two chains in a vertical section of the chains is in the same plane as the centerlines of the chains.

In other embodiments a top drive or other apparatus may be coupled indirectly to circulating elements such as chains 61. This may be done, for example, by providing a coupling on the top drive that engages with a corresponding coupling provided on a cross head.

It is beneficial for elevators 14A to be suspended so that their weight (and much more-significantly the weight of the suspended drill string 13) is applied in alignment with the centers of rollers 61A of chains 61. As mentioned above, it is also beneficial to provide a system that facilitates load sharing between chains 61 such that each chain 61 supports a similar proportion of the load. FIG. 5F illustrates an arrangement 80 that may be used for supporting coupling units 14 (or other devices). FIG. 5F shows a cross section of an example chain 61. Chain 61 includes spaced-apart rollers 61A. In the illustrated embodiment, rollers 61A are rotatably supported on pins or shafts 61D by bearings or bushings 61E.

Arrangement 80 includes hollow connection rollers 82 which are provided at each location where it is desired to a couple a connection unit to a chain 61. Rollers 82 may be mounted to rotate relative to the plates between which they are supported. Spigots 55 which support apparatus (e.g. an elevator or connection unit or other apparatus to be supported) project into bores 82A of connection rollers 82. Connection rollers 82 are coupled to adjoining pins 61D of chain 61 by outer chain plates 61G and 61H on one side and by inner chain plates 61I and 61J on an opposing side. Chain plates 61G and 61H are axially retained relative to pin 61D by retaining bolt assembly 61F.

A bearing 83 is located at or near the center of bore 82A (e.g. half-way between inner chain plates 61I and 61J). Bearing 83 allows rotation of spigot 55 relative to connection roller 82. Bearing 83 is held in place on the end of spigot 55 by a retaining plate 84. In the illustrated embodiment, bearing 83 is a spherical bearing. Spherical bearing 83 accommodates imperfect alignment between the axis of spigot 55 and the axis of connection roller 82. This in turn facilitates load sharing between spaced-apart chains 61. A spacer 85 holds bearing 83 in place.

Mirror image arrangements 80 may be provided on a pair of spaced apart chains 61. Arrangements 80 facilitate transfer of force to chains 61 at locations that are centered both side-to side and front-to-back on chains 61 (i.e. on the center lines of chains 61).

FIGS. 8A to 8L illustrate various embodiments and configurations of elevators 300. Such elevators may be applied in combination with other apparatus described herein (e.g. used as elevators 14A in apparatus described above). Such elevators may also be applied in other applications. In the illustrated embodiment, elevator 300 comprises a platform 302 supported on a base 304 by roller bearings 306. This permits elevator 300 to rotate about the centerline of a supported drill string or drill string section.

A pair of shafts 308A and 308B (collectively referred to as shafts 308) are mounted substantially parallel to one another on platform 302. It is not mandatory that shafts 308 are parallel. In some embodiments shafts 308 are angled slightly relative to one another.

Figure 8A:
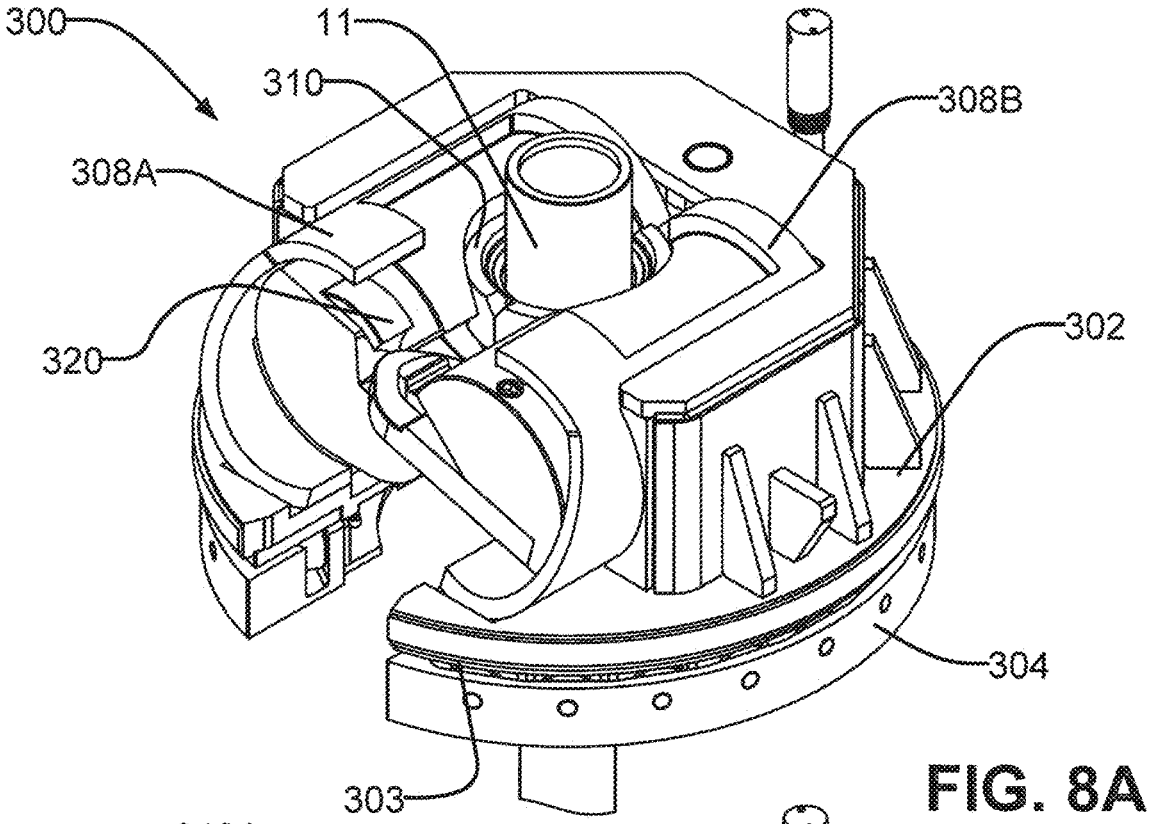
FIGS. 8A and 8B are perspective views of a portion of a drill string in an elevator in closed and open positions respectively according to one example embodiment.
Figure 8B:
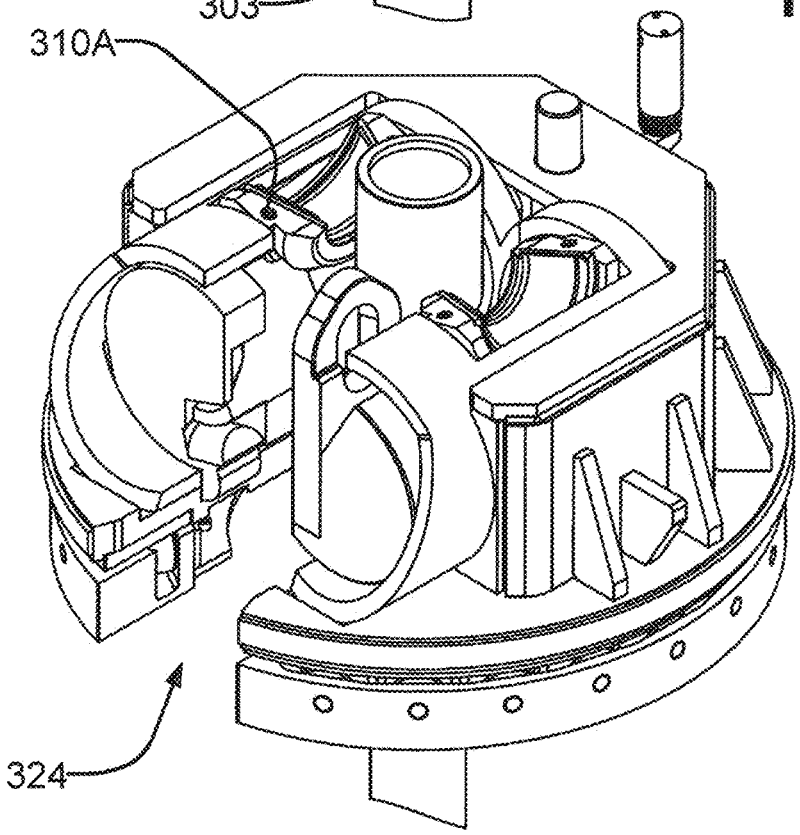
Figure 8C:
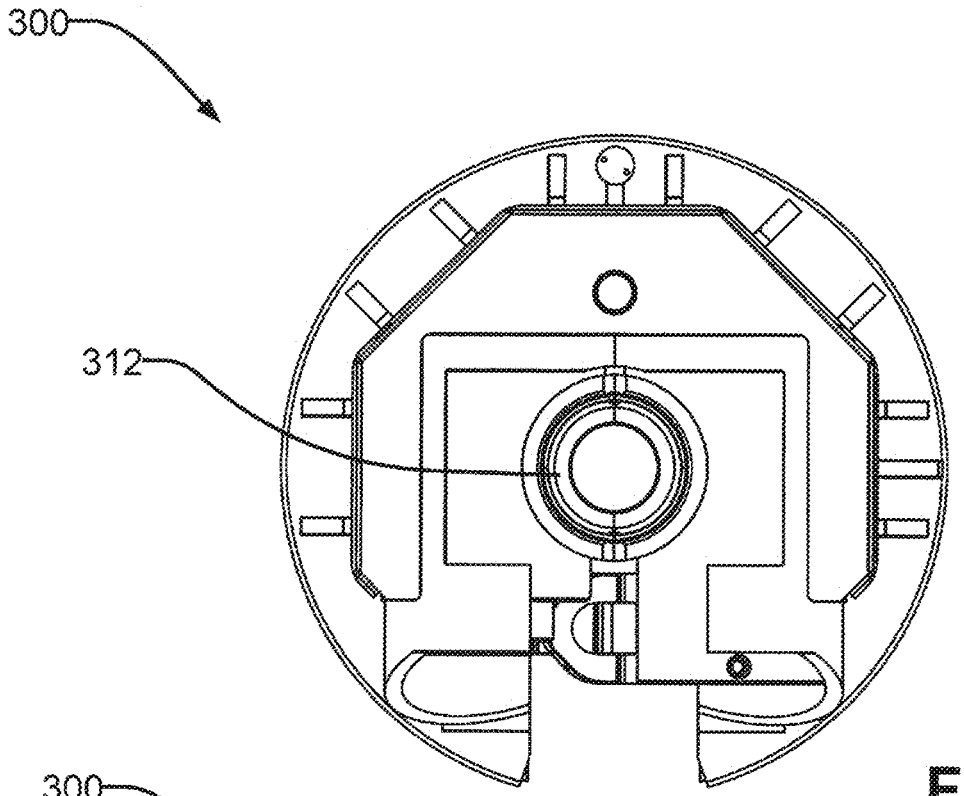
FIGS. 8C and 8D are top plan views of the elevator of FIGS. 8A and 8B in closed and open positions respectively.
Figure 8D:
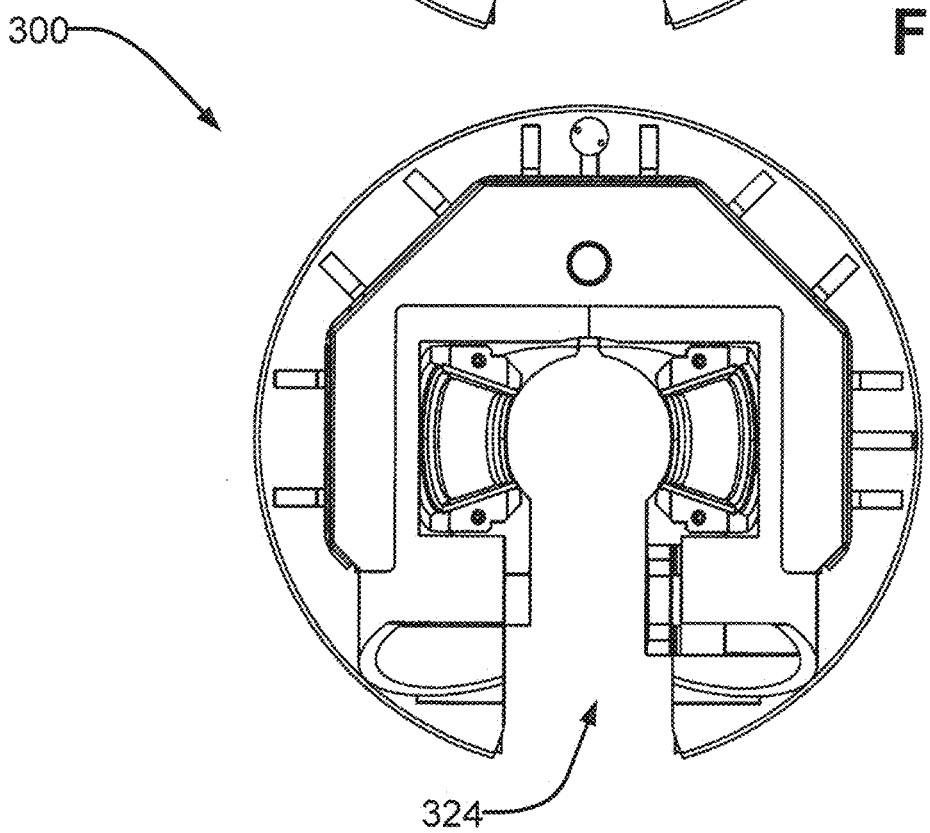

Shafts 308A and 308B each comprise a semi-circular collar 310. Shafts 308 are rotatable about their respective longitudinal axes to cause semi-circular collars 310 to move between a closed position in which collars 310 abut one another to create a substantially complete circular collar 312 for supporting an upset of a drill sting section 11 (as depicted in FIG. 8C) and an open position in which collars 310 are spaced apart semi-circular collars 310 to allow a tubular upset to pass through elevator 14A (as depicted in FIG. 8D).

Figure 8E:
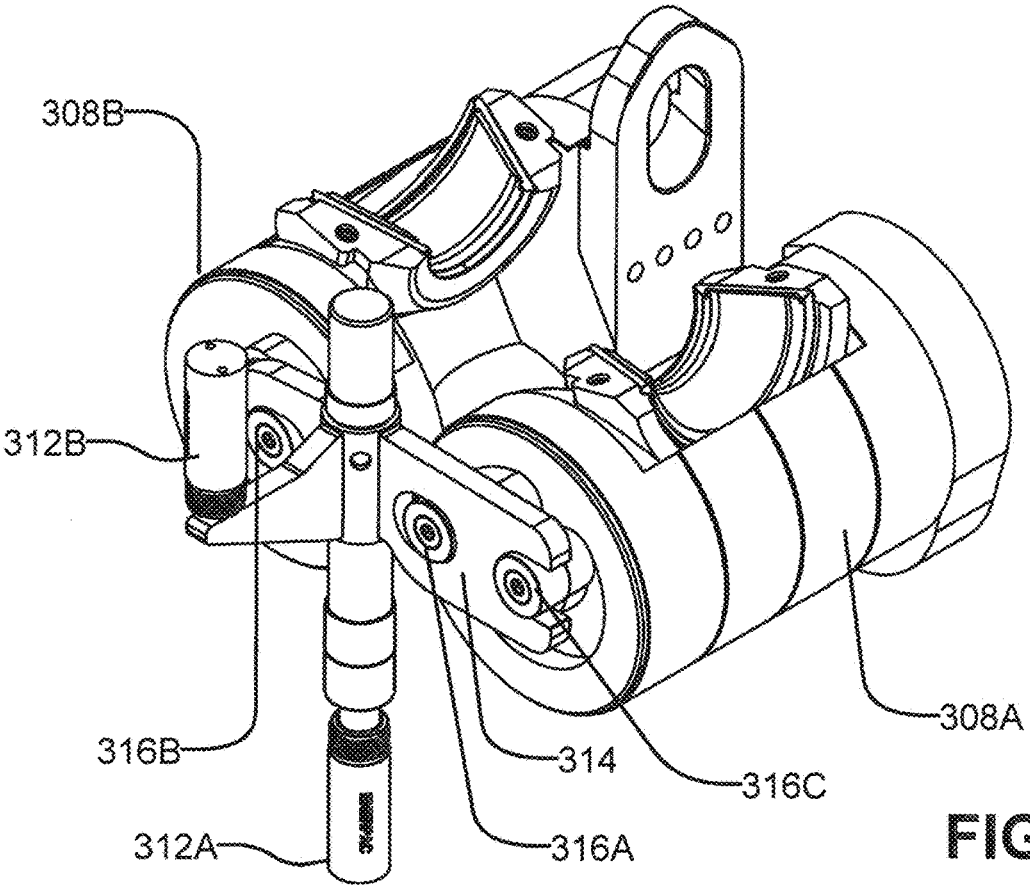
FIGS. 8E and 8F are perspective views of the shaft and latch portions of the elevators of FIGS. 8A and 8B in closed and open positions respectively.
Figure 8F:
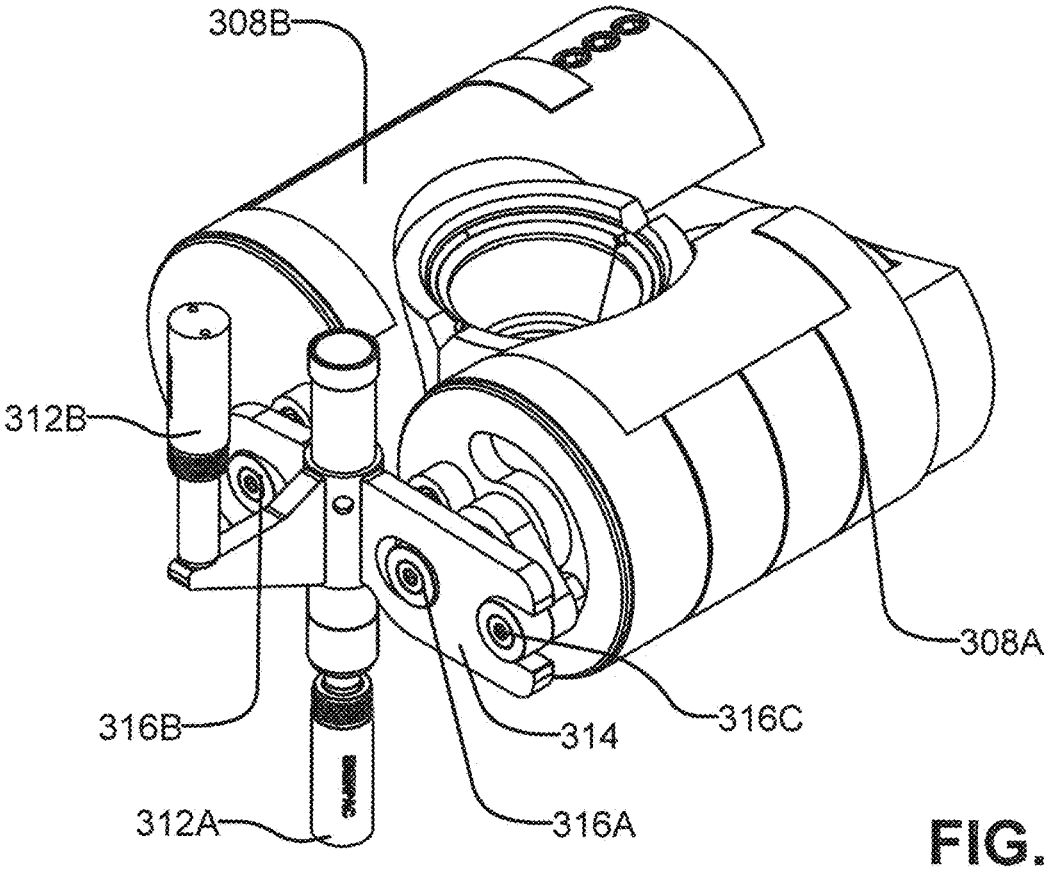

An example arrangement for controlling rotation of shafts 308A and 308B about their respective longitudinal axes applies actuators 312A and 312B, as best seen in FIGS. 8E and 8F. Actuators 312A and 312B individually push on a yoke or link 314 in opposite directions to cause rollers 316A and 316B to rotate shafts 308A and 308B in opposite directions simultaneously. Rollers 316A and 316B are eccentrically mounted to shafts 308 and, when pushed by yoke 314 cause counter rotation of shafts 308 to open or close elevator 300.

In the particular arrangement shown, actuator 312A pushes link 314 away from actuator 312A. Movement of link 314 causes rollers 316A and 316B to cause shaft 308A to rotate clockwise and shaft 308B to rotate counterclockwise thereby spacing apart collars 310 and opening elevator 300. To close elevator 300, actuator 312B pushes link 314 away from actuator 312B to reverse the direction of rotation of shafts 308 and create the substantially complete circular collar 312, as shown in FIG. 8F. Other methods of rotating shafts 308 may be employed. In some alternative embodiments other arrangements of one or more actuators are provided to selectively raise and lower link 314. For example, a single double-acting actuator is connected to raise and lower link 14 in some embodiments.

Elevator 200 has an open side through which a tubular may be brought into a position where it can be engaged by collars 310 and a closed side. In some embodiments shafts 308 are angled so that they are farther apart at the open side of elevator 200.

It is not necessary to fix actuators 312A and 312B to link 314. Actuators 312A and 312B may be fixed to a crosshead or other fixed structure, thereby allowing platform 302 to be rotated relative to actuators 312A and 312B. When link 314 is aligned with actuators 312A and 312B, the actuators may be operated to engage abutment surfaces on link 314 and thereby push link 314 so as to rotate shafts 308 between the open and closed positions as desired. Rotation of platform 302 may be employed in conjunction with make/break unit 14C for coupling/uncoupling drill string sections 11. Rotation of platform 302 could allow rotation of drill string 13 while elevator 300 is supporting drill string 13. Such rotation can be driven by a top drive or by a make break unit (e.g. rotatable jaws 14E) or by external means.

To ease operation, a latch sensor 322A may be provided to allow an operator or control system to monitor the degree of rotation of elevator 14A. Latch sensor 322A may comprise a proximity sensor that senses when shaft 314A of link 314 protrudes up (signifying that elevator 300 is in the open position) or does not protrude (signifying that elevator 300 is in the open position). A rotational sensor 322B may be provided to monitor whether or not platform 302 is aligned with base 304 to allow drill string sections 11 to travel through opening 324.

In some embodiments, elevator 300 may comprise a latch mechanism 318 for preventing shafts 308 from spreading apart while carrying the weight of drill string 13. Spreading forces can be particularly large in the case where elevator 300 is supporting drillpipe with tapered tool joint upsets (typically 18 degrees). The illustrated example latch mechanism 318 comprises a loop member 318A and hook member 318B. In the illustrated embodiment, loop member 318A is fixed to shaft 308B and rotates as shaft 308B rotates while hook member 318B is connected to a secondary shaft 320 within shaft 308A that rotates in an opposite direction to the rotation of shaft 308A due to cam 316C. In this way, as shafts 308 are rotated into a closed position, loop member 318A is rotated toward shaft 308A and hook member 318B is rotated into an opening 318A-1 of loop member 318A to prevent movement of shaft 308A relative to shaft 308B when in the locked configuration. Although only one embodiment of latch mechanism 318 is depicted, one skilled in the art that various embodiments for maintaining alignment of shafts 308 could be employed instead. For example, the hook and loop members could be swapped.

Figure 8G:
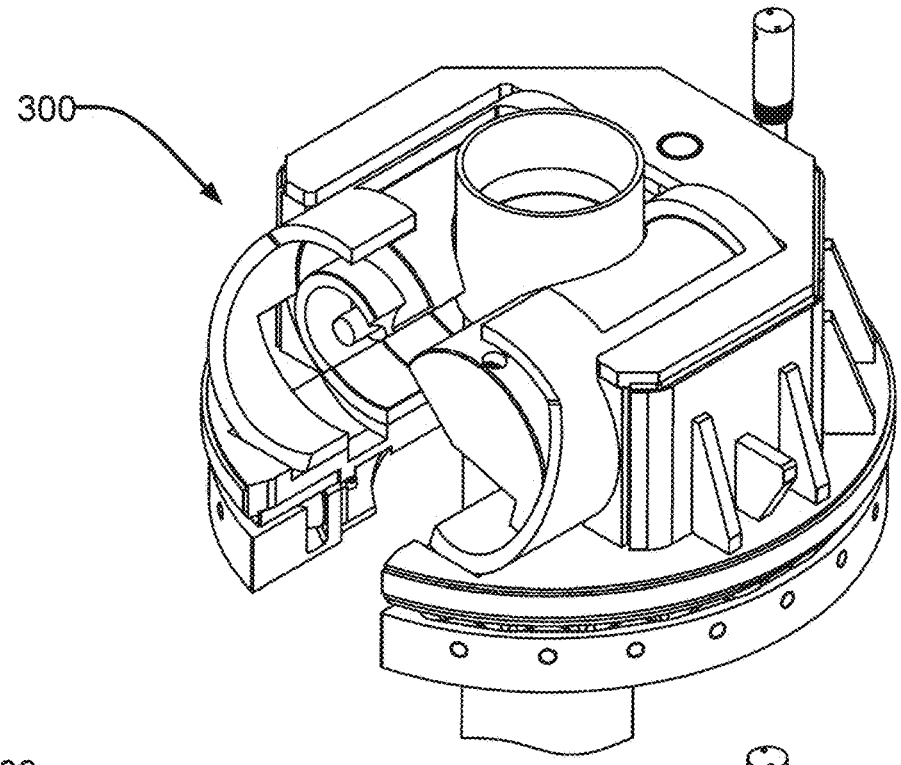
FIGS. 8G and 8H are perspective views of a portion of casing in an elevator in closed and open positions respectively according to one example embodiment.
Figure 8H:
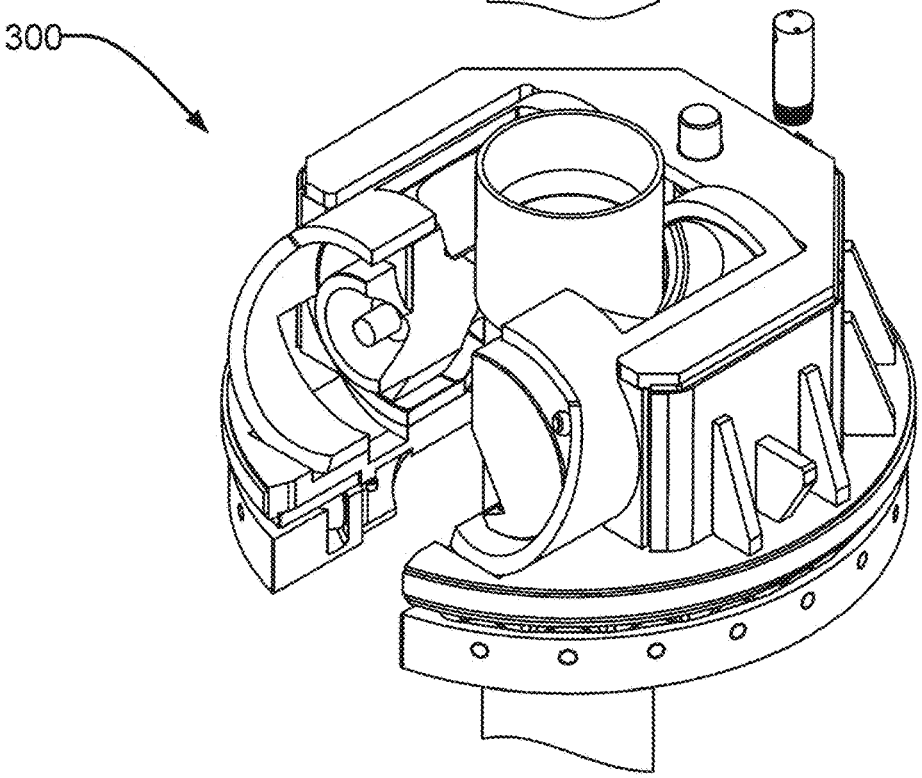
Figure 8I:
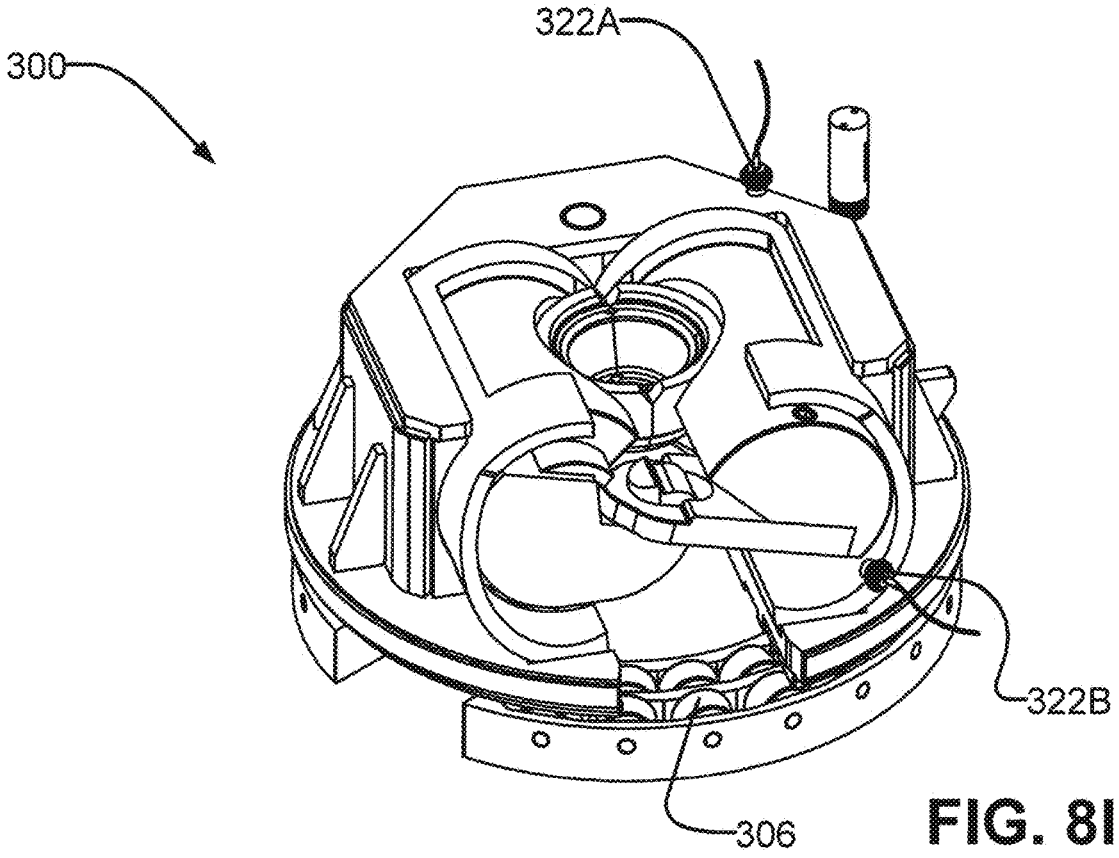
FIGS. 8I and 8J are perspective views of an elevator rotating on a support bearing according to one example embodiment.
Figure 8J:
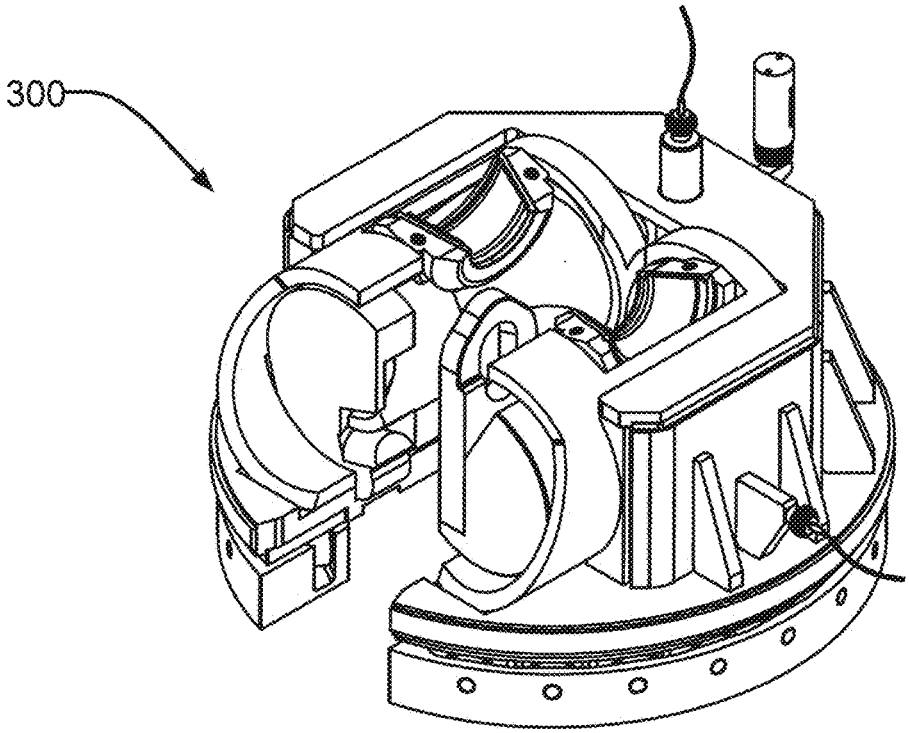

Collars 310 may be configured to accommodate various sizes and shapes of drill string sections 11. In some embodiments, collars 310 are detachable from shafts 308. For example, as best seen in FIG. 8B, collars 310 and shafts 308 may be provided with screws for attaching and removing collars 310. In this way, collars 310 can be swapped to accommodate various types of drill string segments 11. In some embodiments, elevator 14A may also be employed for supporting casing, such as is depicted in FIGS. 8G and 8H. Casing may require particular collars 310 to be installed on shafts 308 or may not require collars 310 at all. Instead, casing may be supported by shafts 308 themselves without collars 310. In some embodiments collars 310 include seals which seal the space between the semi-circular inner edges of collars 310 and a drill string section 11 being supported and/or provide sealing between a mud can (as described for example elsewhere herein) and collars 301.

Figure 8K:
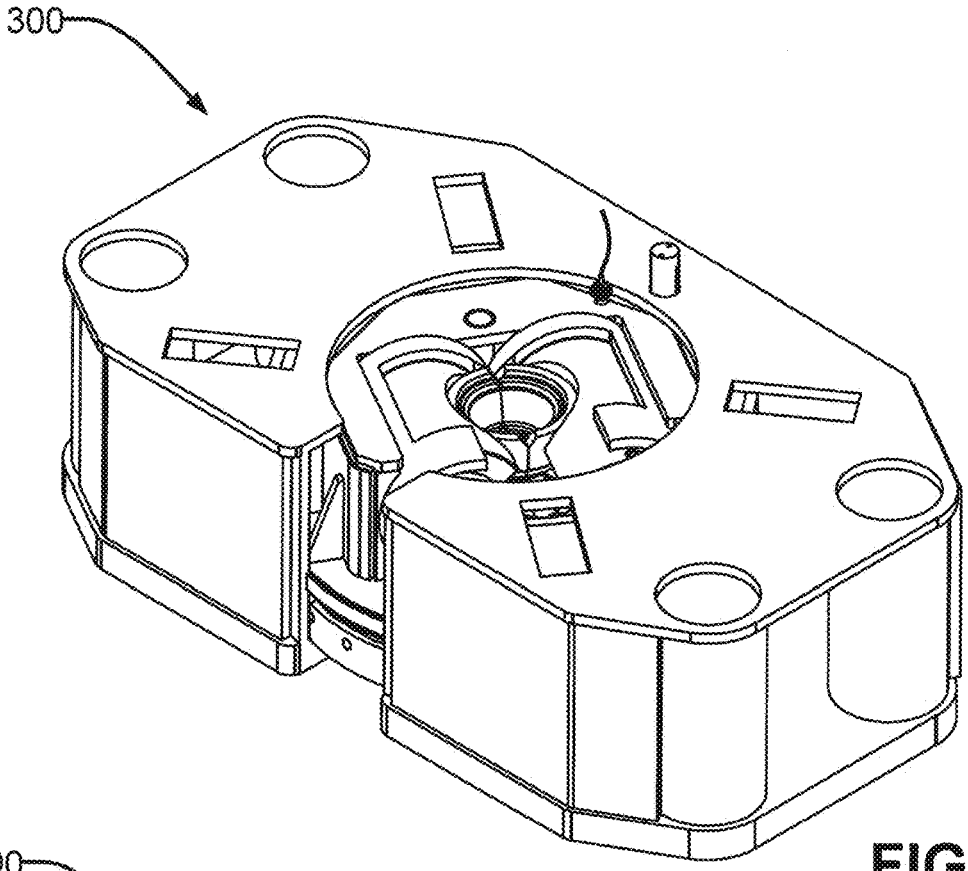
FIGS. 8K and 8L are perspective views of an elevator arranged within a crosshead bridge frame in rotated closed and open positions accordingly according to one example embodiment.
Figure 8L:
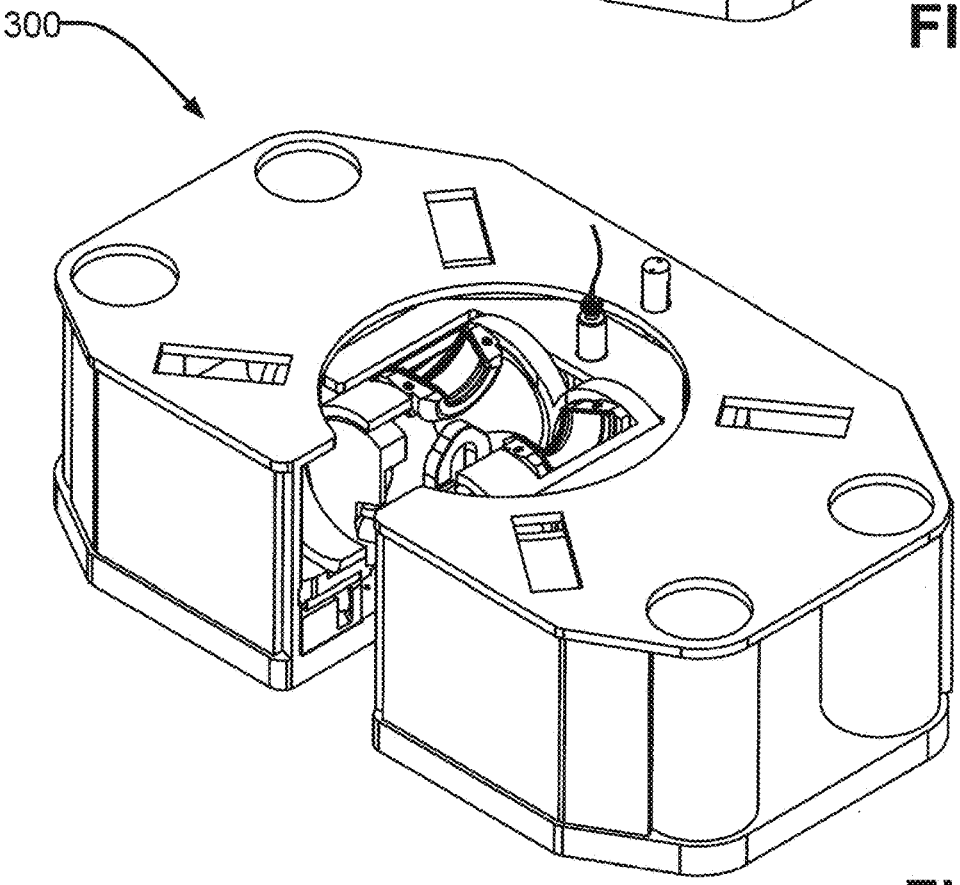
Figure 8M:
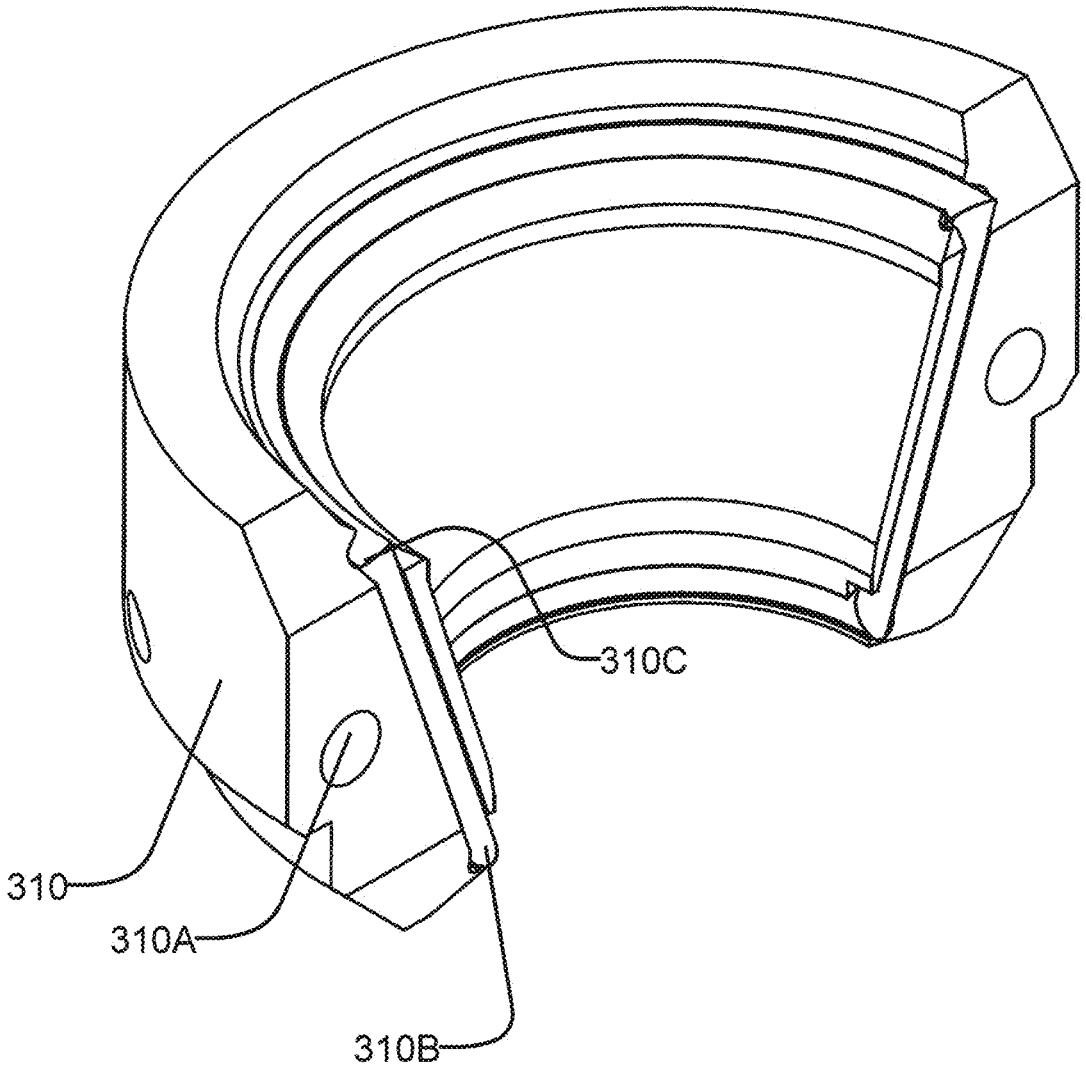
FIG. 8M depicts a perspective view of a semi-circular collar according to one example embodiment.

In some embodiments, elevator 300 is partly or completely encapsulated within a cross head bridge frame such as is depicted in FIGS. 8K and 8L. As can be seen from FIGS. 8K and 8L, elevator 300 is still free to open and close and to rotate within the cross head bridge frame.

In some embodiments an elevator 300 or a conventional elevator is mounted for rotation such that its opening side can be turned to face in different directions. For example, such embodiments may provide an elevator that forms a structural element of a crossbeam and can be rotated so as to accept a drill string section 11 from either side of the crossbeam. One way to provide a structure in which a rotating element can form a structural component of a crossbeam is described in U.S. Pat. No. 7,794,192 which is hereby incorporated herein by reference for all purposes. In some embodiments the elevator is rotatable by at least approximately 180 degrees. In some embodiments the elevator is automatically rotated as it passes over the top end of path 15 such that the opening of the elevator faces away from path 15 both when the elevator is on front side 15A of path 15 and when the elevator is on back side 15C of path 15.

FIGS. 4A and 4B and the associated discussion explain example ways to transfer power to connection units 14 in a form that may be transferred through flexible elements such as cables or hoses. Another way to deliver power to individual connection units 14 as they travel along path 15 is to circulate a flexible member, such as a belt cable or chain that is arranged to follow path 15 and to drive one or more power generators. One or more separate power generators may be provided on each connection unit 14. For example, the flexible member may drive one or more hydraulic pumps or one or more electrical power generators on each connecting unit 14. In the alternative, one or more power generators that circulate around path 15 may each service two or more connection units 14. Power may be conveyed from the power generators to connection units 14 by way of flexible power-carrying members such as hoses or cables that extend along path 15.

In some embodiments where power generators are carried around path 15 by chains (e.g. chains 61 in embodiments described herein) A power generator is located on one side of the chain, the flexible member is located on an opposing side of the chain, and power is provided to the power generator by way of a shaft that extends through a hollow pin of the chain.

Figure 9A:
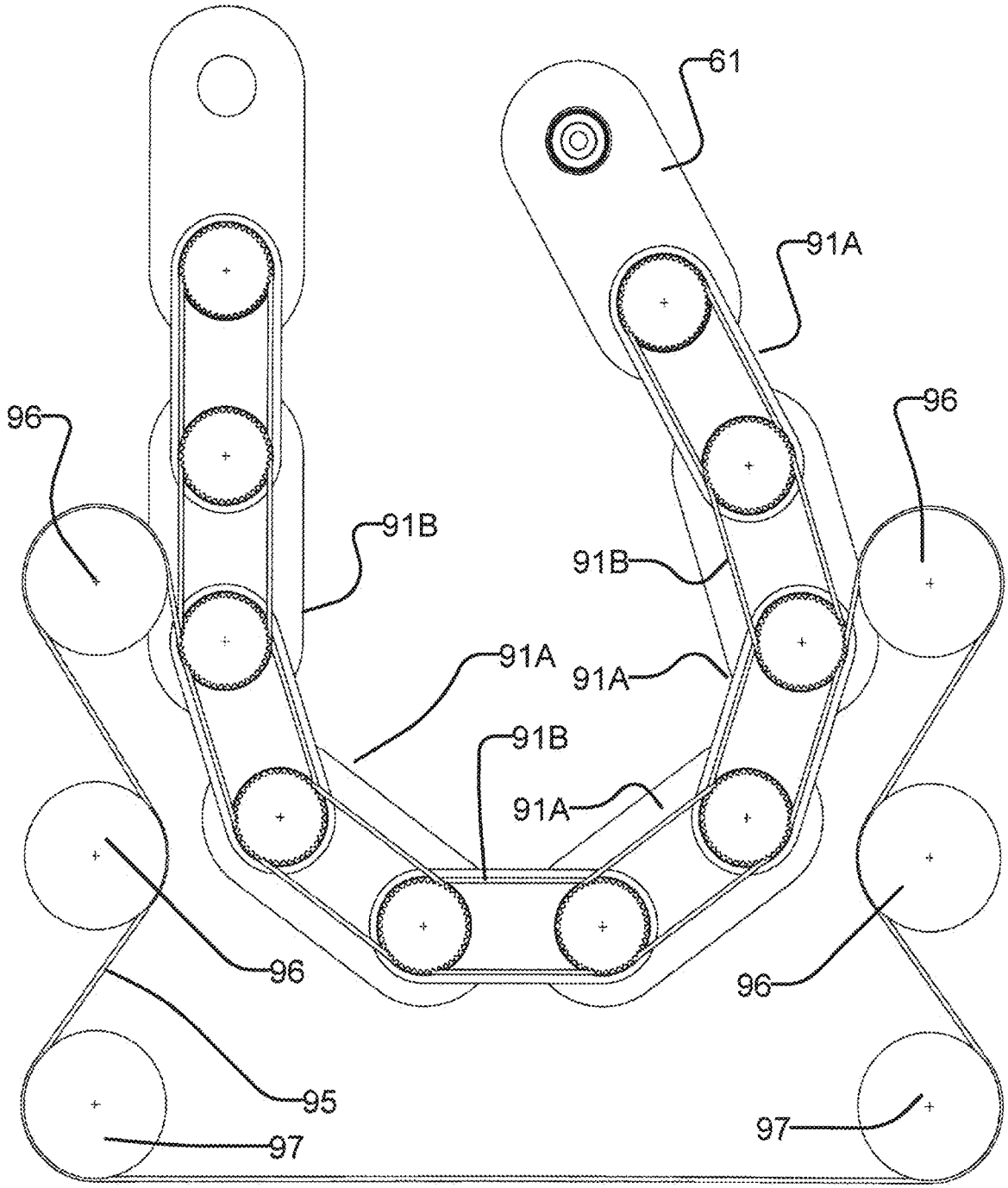
FIGS. 9A to 9D illustrate a mechanical power delivery system according to one example embodiment.

FIGS. 9A through 9D and 10A and 10B illustrate power delivery systems according to two different example embodiments. FIG. 9A shows an example power delivery system 90. System 90 transfers power along chains 61 by way of a series of drive loops 91 (e.g. drive belts or roller chains) which engage corresponding sprockets 92 centered on pins of chain 61. Because the sprockets are centered on pins of chain 61, spacing between adjacent sprockets is not altered when chain 61 bends (e.g. while passing around a drive or idler sprocket).

Drive loops 91 alternate between inner drive loops 91A and outer drive loops 91B. Inner drive loops 91A drive or are driven by inner sprockets 92A and outer drive loops 91B drive or are driven by outer sprockets 92B. Sprockets 92A and 92B are unitary or coupled together such that a drive loop 91A drives the next drive loop 91B which drives the next drive loop 91A, and so on around chain 61.

A power generator may be located at any pin 61D of chain 61 and driven by the sprockets 92 at that pin 61D. In some embodiments (including the illustrated embodiment—see FIG. 9B) a pin 61D is hollow and power is transferred to the power generator (e.g. a pump or electrical generator) 93 by coupling a shaft to be driven by the sprockets 92 and extending the shaft through a bore of the pin 91D to drive the power generator on a side of the pin opposed to the sprockets 92.

Figure 9B:
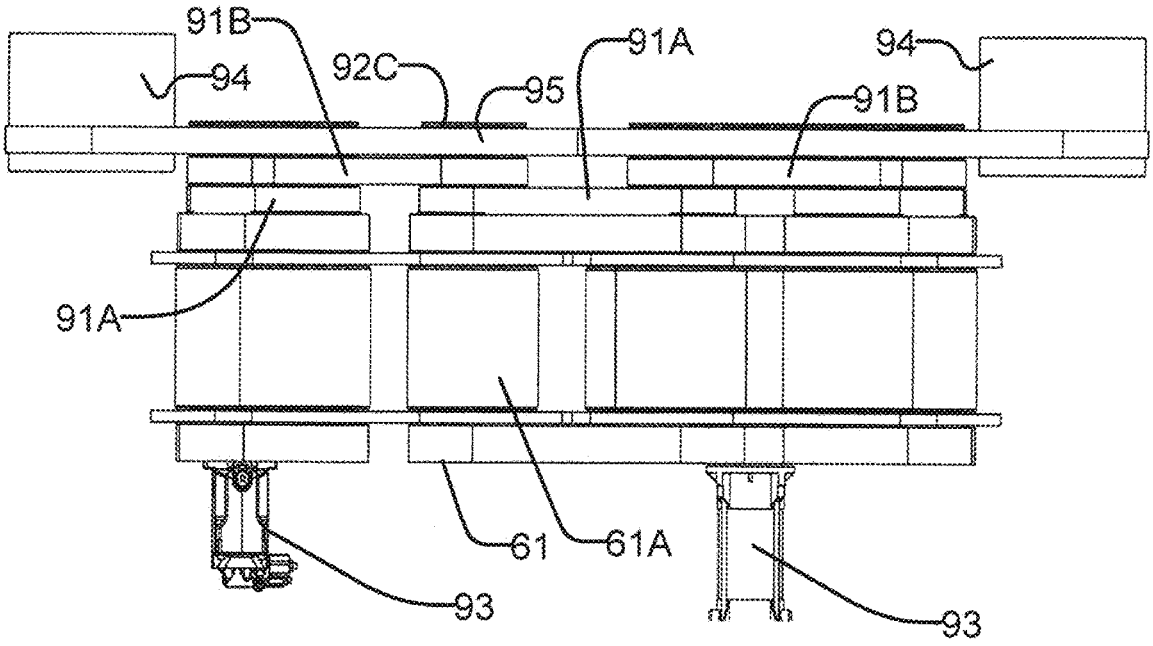
Figure 9C:
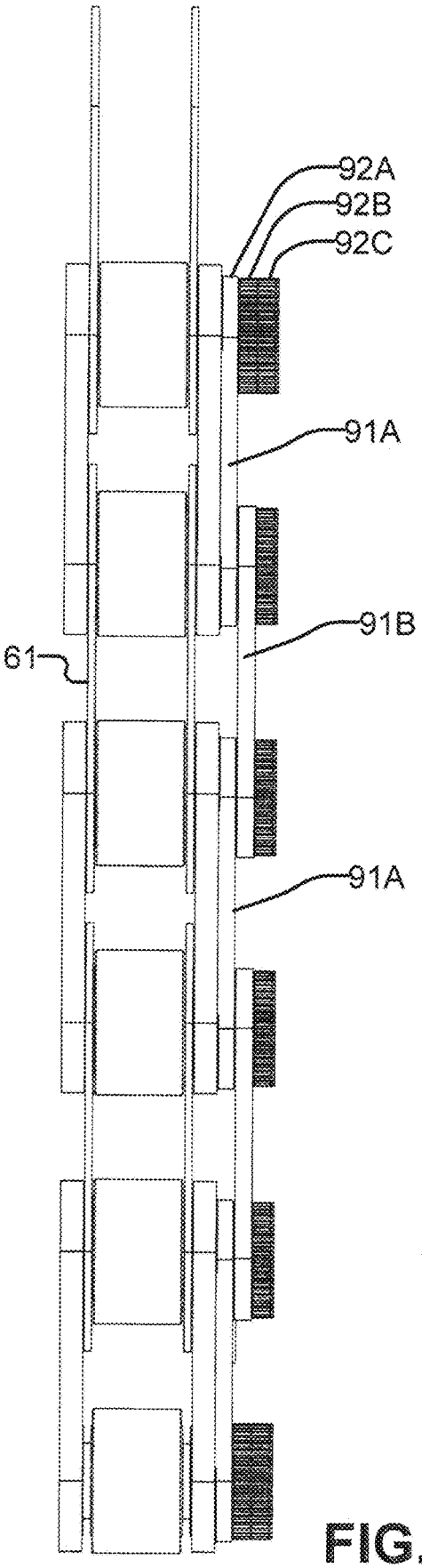
Figure 9D:
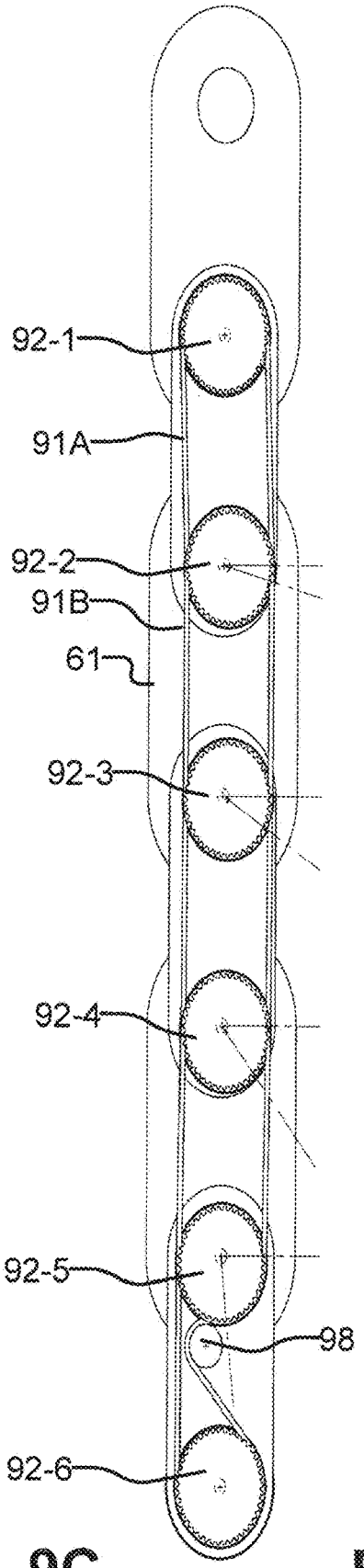

Power may be transferred from a stationary power unit (e.g. an engine or motor) to the interconnected drive loops 91 by way of sprockets 92C that are coupled to rotate with sprockets 92A and 92B. FIG. 9B shows motors 94 coupled to drive a flexible drive loop (e.g. a chain or belt) 95 by drive sprockets 97. Drive loop 95 is guided by idlers 96 to extend around a curve taken by chain 61. Drive loop 95 engages a plurality of sprockets 92C that are located along the path taken by drive loop 95. Drive loop 95 turns those of sprockets 92C that it is in contact with as it is circulated by motors 94. Drive loops 91A and 91B carry power around chain 61 to drive one or more power generators at any location or locations around chain 61, Most drive belts or drive chains require a tensioner to maintain a desired working tension. In some embodiments a separate tensioner is provided for each one of drive loops 91. The tensioners may, for example, comprise rollers or idler sprockets biased against the drive loops by springs or the like. In an alternative embodiment illustrated in FIG. 9D a plurality of drive loops 91 are tensioned by a single mechanism. In this embodiment, some of sprockets 92 are mounted to rotate on eccentric shafts such that the center-to-center spacing of adjacent sprockets 92 at either end of a drive loop 91 varies depending on rotations of the eccentric shafts. The eccentricity of the shafts is sufficient to maintain desired tension levels in drive loops 91. A series of two or more eccentrically-mounted sprockets 92 may be located between non-eccentrically-mounted end sprockets 92. One tensioner 98 may be provided on one of the drive loops 91 between the end sprockets. The eccentrically-mounted sprockets 92 will position themselves to maintain the same tension in the drive loops 91 between the end sprockets. In some embodiments, four or more drive loops 91 each use such an arrangement to share a single tensioner 98. In the embodiment illustrated in FIG. 9D, sprockets 92-1 and 92-6 are end sprockets. The drive loops 91 between them share a single tensioner 98 by way of eccentrically mounting intermediate sprockets 92-2 through 92-5.

Figure 10A:
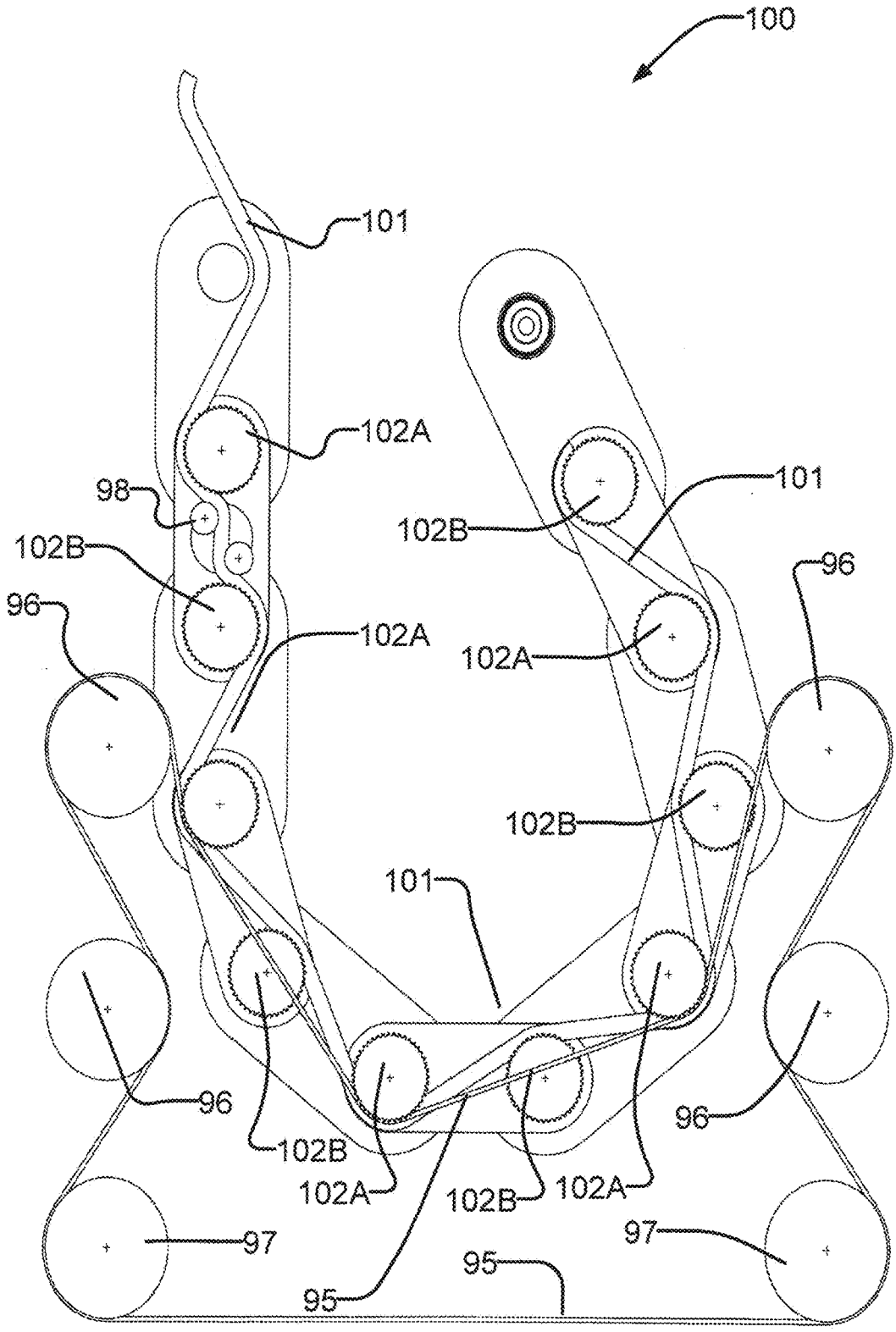
FIGS. 10A through 10C illustrate a mechanical power delivery system according to another example embodiment.
Figure 10B:
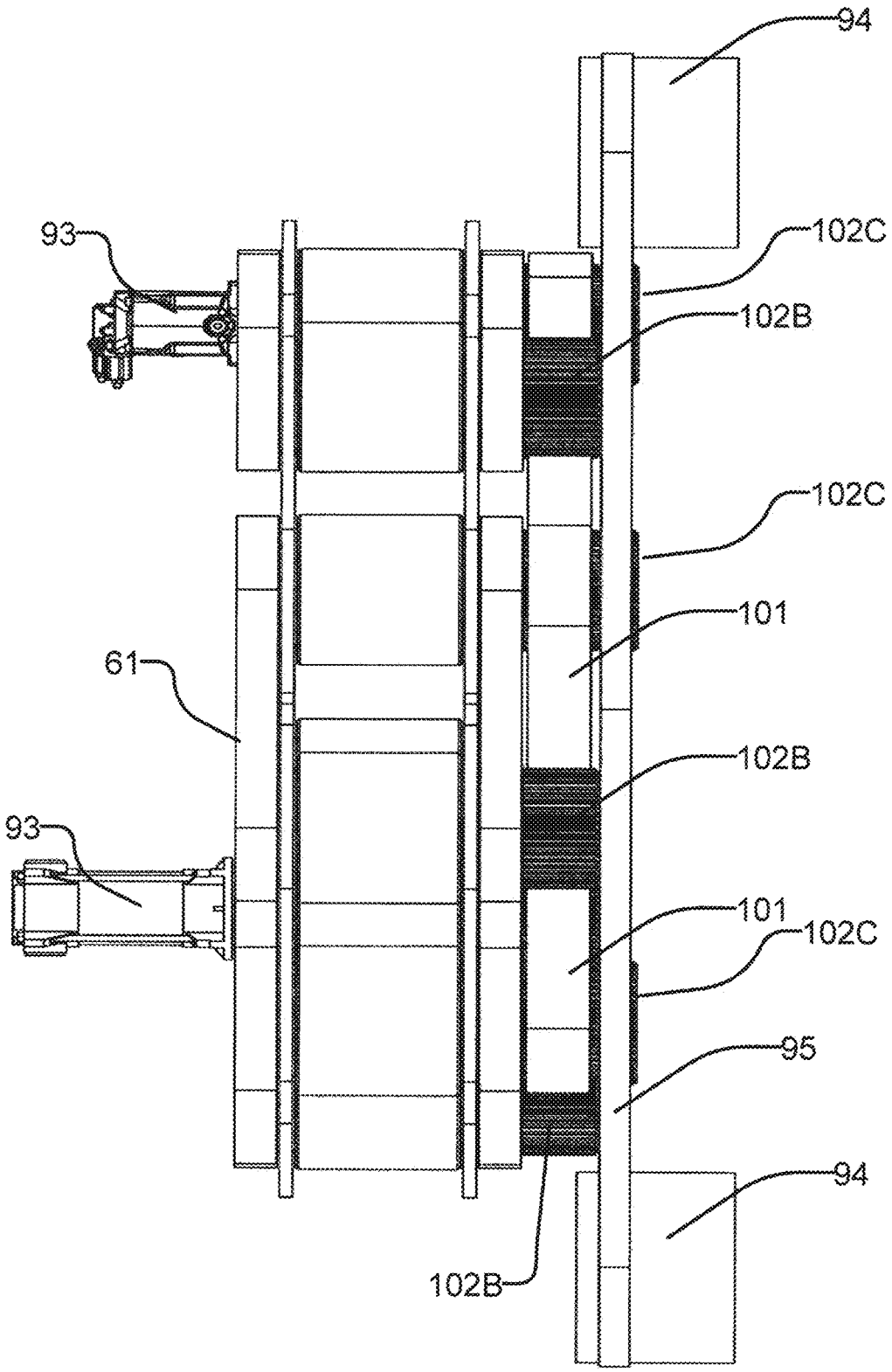

FIGS. 10A and 10B illustrate a power delivery system 100 according to another example embodiment. Power delivery system 100 is similar in concept to power delivery system 90. Like power delivery system 90, power delivery system 100 provides sprockets 92 rotatably mounted at each pin of chain 61. In power delivery system 100, a single drive loop 101 extends all around chain 61. Drive loop 101 may, for example, comprise a roller chain or suitable drive belt. Drive loop 101 passes in a sinuous fashion around sprockets 102. With this construction, the direction of rotation of sprockets 102 alternates as one traverses along chain 61.

Power delivery system 100 includes a drive system comprising motors 94, drive loop 95, idlers 96 and drive sprockets 97. FIGS. 10A and 10B show sprockets 102A that are driven by and rotate in the same direction as the travel of drive loop 95 which alternate with sprockets 102B that are not directly driven by drive loop 95 and rotate in a direction opposite to a direction of travel of drive loop 95. Drive loop 95 drives sprockets 102A by way of sprockets 102C which may be extensions of sprockets 102A or separate sprockets coupled to rotate together with sprockets 102A. One or more tensioners 98 may be provided to maintain appropriate tension in drive loop 101. One or more power generators 93 may be driven by any of sprockets 102A or 102B.

Figure 10C:
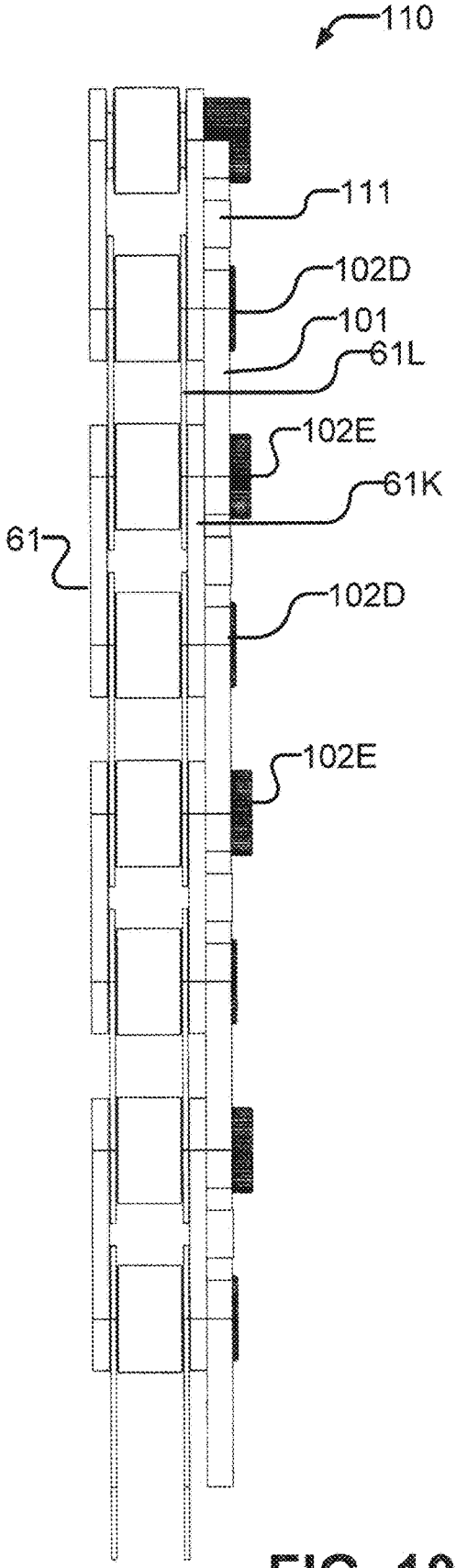
Figure 10D:
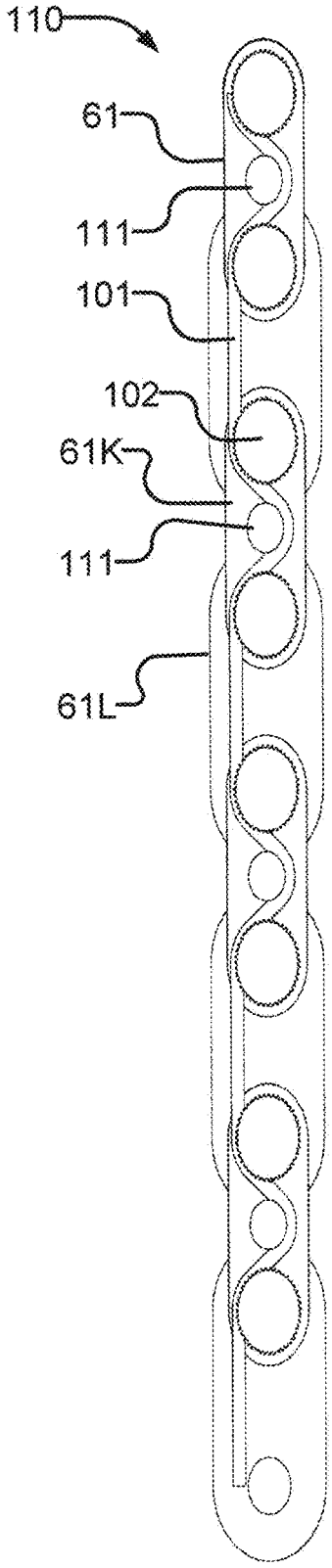

FIGS. 10C and 10D show an alternative power delivery system 110 which is similar to power delivery system 100, differing mainly in the routing of drive loop 101. In power delivery system 110, sprockets 102C and 102D are located at the pins of chain 61. Drive loop 101 passes in the same direction around all of sprockets 102C and 102D. Idlers 111 are provided at locations spaced apart along chain 61. In the illustrated embodiment, chain 61 has outer chain plates 61K and inner chain plates 61L. An idler 111 is mounted on each outer chain plate 61K. Idlers 111 may comprise sprockets that are free to rotate.

Some or all of sprockets 102C and 102D are extended so that they can be driven by a drive loop 95 in the same manner described above with respect to power delivery system 100. In the illustrated embodiment, sprockets 102E are extended to engage a drive loop 95. One or more power generators may be driven by any of sprockets 102D or 102E.

In some alternative embodiments one or more prime movers and a source of fuel for the prime mover are mounted to be carried around path 15. For example, a fuel cell may be carried around path 15. Electricity generated by the fuel cell may be used directly to drive electrical actuators and or used to drive an electric motor connected to drive a hydraulic pump. Fuel may be provided to the prime mover periodically (e.g. a tank carried to move along path 15 may be filled during periods when the apparatus is not circulating around path 15 or provisions may be made to supply fuel to the prime mover while the apparatus is circulating around path 15. As another example of a prime mover an engine connected to drive a hydraulic pump and or an electrical generator may be supported to circulate around path 15. Power may be routed from the prime mover to destinations where the power is needed along path 15 (unless the prime mover is already located at the location at which power is required) by way of flexible hoses or cables extending along path 15.

FIGS. 11A to 11E illustrate an optional system 110 for handling devices such as top drives that may be used to perform work on a drill string. System 110 includes one or more tracks 112 that are movable (for example by pivotal swinging motions) into and out of a work area adjacent to well center. The illustrated embodiment includes tracks 112A and 112B.

In some embodiments a make/break unit is provided on a track 112. In such embodiments the make break unit may be positioned as required along front side 15A of path 15 to make or break connections between drill string sections. In some such embodiments make/break units that travel around path 15 (e.g. carried by chains 61) are not provided. In other embodiments a rotatable jaw is provided on a track 112. The rotatable jaw may cooperate with backup jaws that are mounted to travel around path 15 to make or break connections between drill string sections. In other embodiments a non-rotatable backup jaw is carried on a track 112. The backup jaw on track 112 may be positioned and operated to cooperate with a rotatable jaw that is supported to travel around path 15.

Figure 11A:
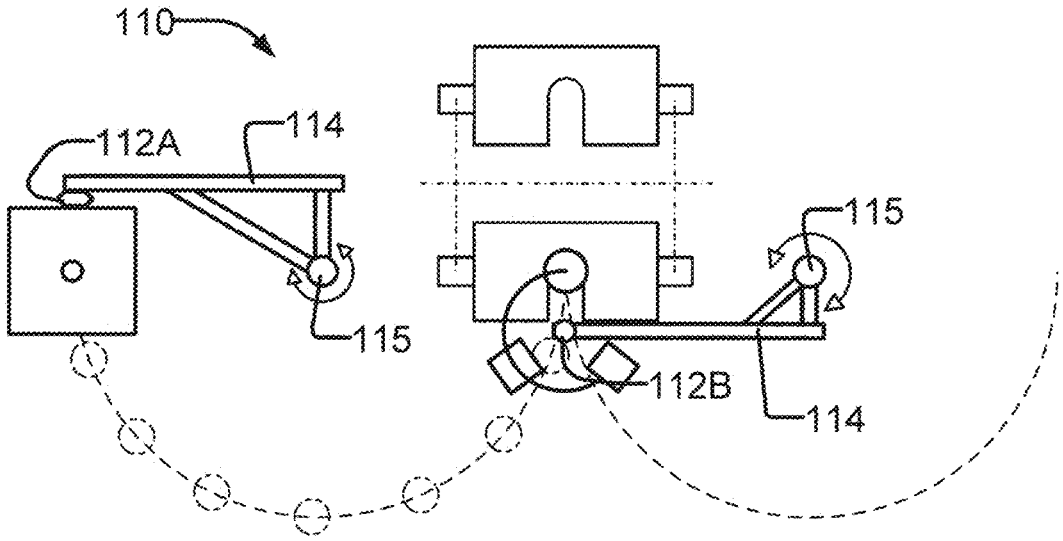
FIGS. 11A and 11B are schematic depictions of a drill string handling system equipped with movable frames for bringing equipment into or out of a working area
Figure 11B:
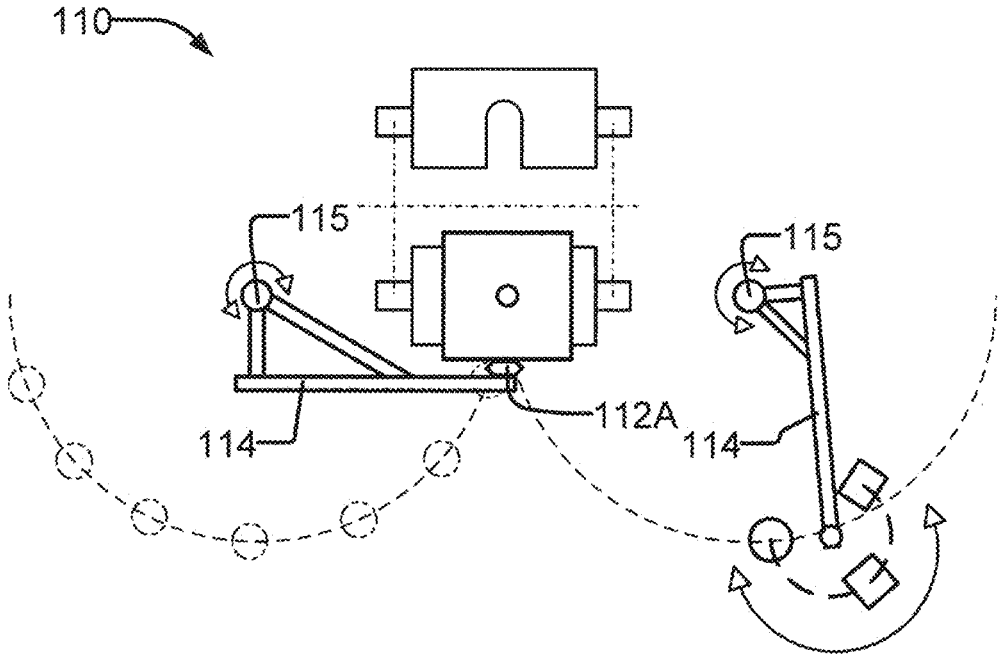
Figure 11C:
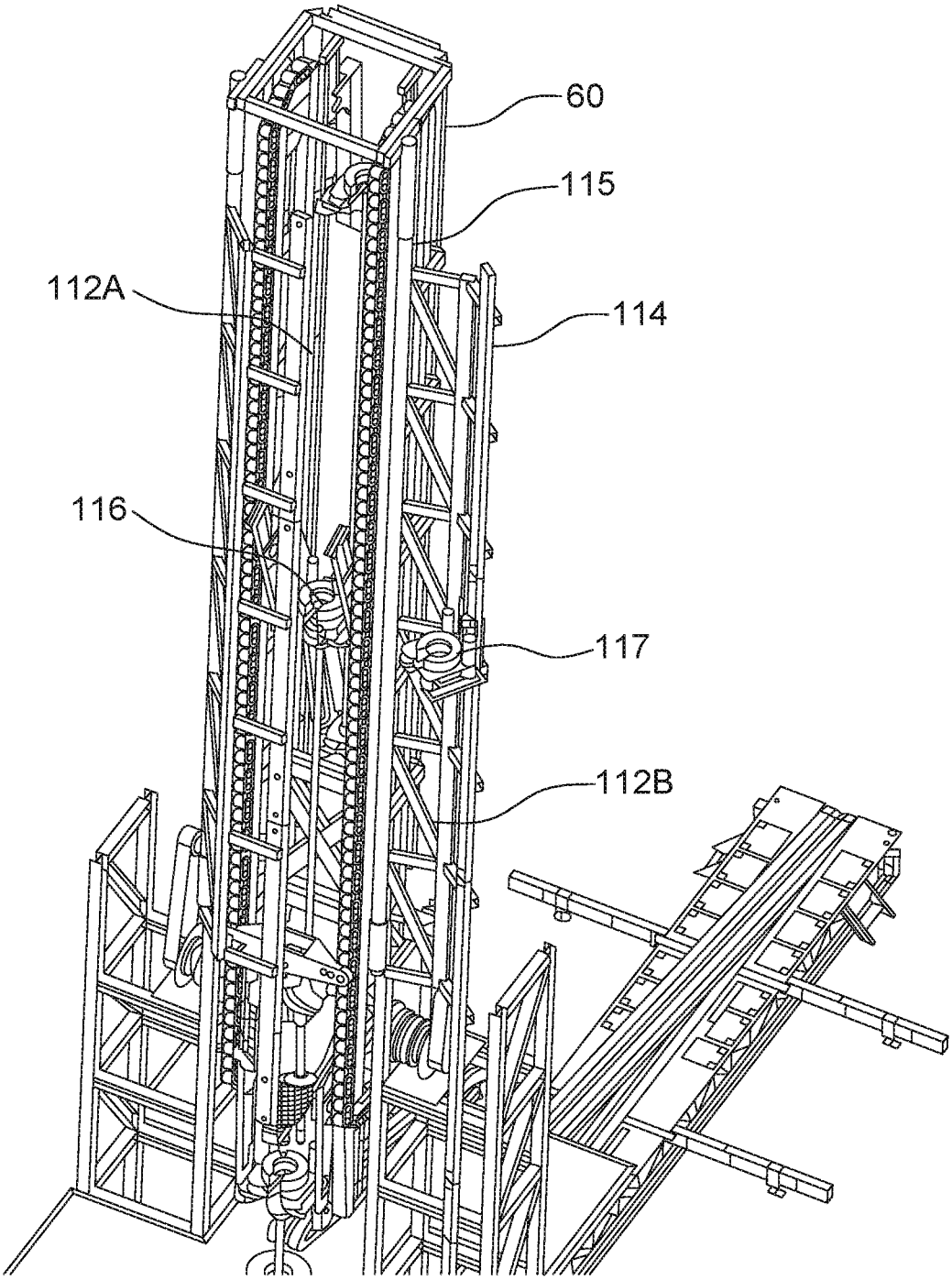
FIG. 11C is a perspective view showing a drill string handling system equipped with movable frames for bringing equipment into or out of a working area.

Tracks 112A and 112B are pivotally mounted so that they can be swung in toward well center or swung away from well center. In the embodiment shown in FIG. 11C, each track 112 is supported on a frame 114 pivoted to mast 60 at hinges 115. Actuators (not shown) are provided to move tracks 112A and 112B toward or away from well center. The actuators may comprise rotary actuators or linear actuators coupled to move frame 114. In FIG. 11C, track 112A is swung toward well center and track 112B is swung away from well center.

Figure 11D:
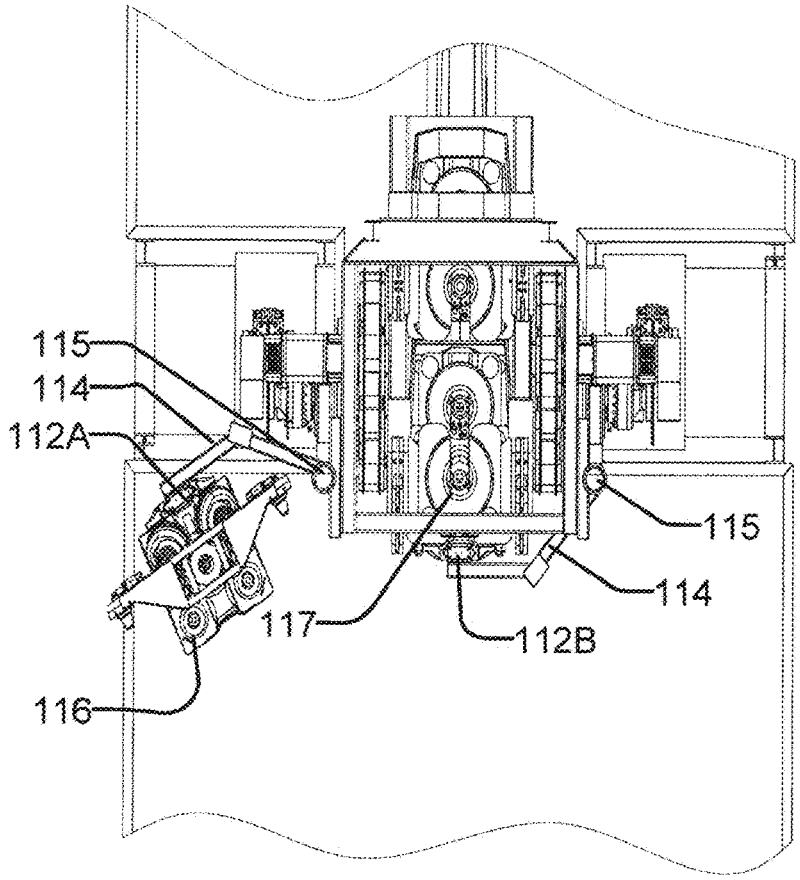
FIGS. 11D and 11E are top views of the apparatus of FIG. 11A in which respectively show first and second pieces of equipment in the working area.
Figure 11E:
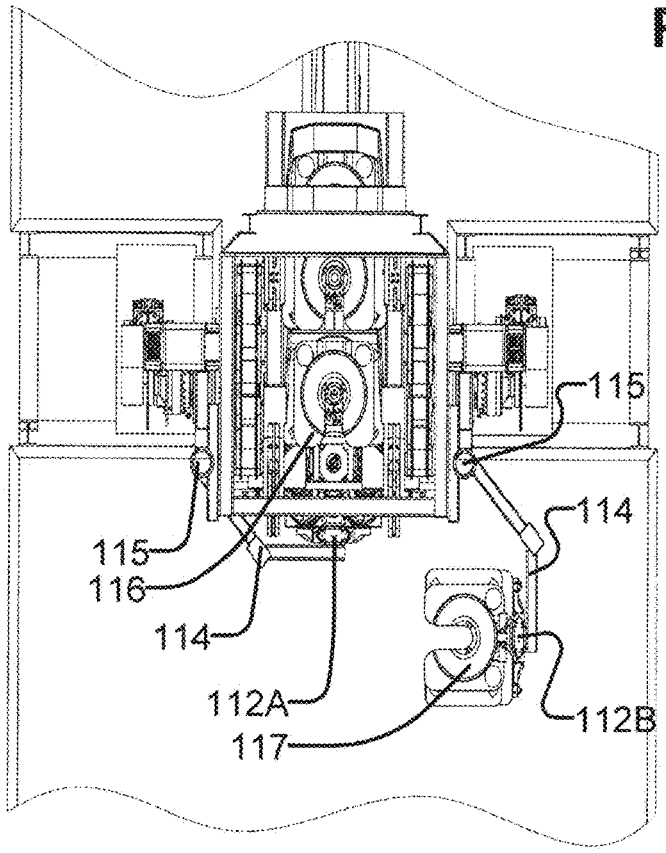

In the illustrated embodiment, a top drive 116 is provided on track 112A and a make/break unit 117 is provided on track 112B. As needed, top drive 116 may be brought to well center by pivoting frame 114 into the configuration shown in FIG. 11C. Top drive 116 may include a coupling assembly 70 as described above so that top drive 116 may be coupled to a selected location along chains 61 for drilling or reaming. Top drive 116 may be retracted to a standby position well away from well center as illustrated in FIG. 11D.

Tracks 112A and 112B may include hoists operable to raise or lower equipment to desired positions along the tracks. Equipment such as a top drive or a mud can may be positioned vertically on a track 112 and then brought into well center when needed. After the equipment has been used it may be re-positioned by hoisting it along track 112. In some embodiments, when drilling, a top drive is positioned along track 112 while track 112 is pivoted away from well center. The top drive is then brought into well center by pivoting frame 114. At this point the top drive may be coupled to chains 61, for example with a coupling 70 as described elsewhere herein. The top drive may then be coupled to the drill string and operated to drill the borehole deeper. During this phase, track 112 may absorb some or all of the reaction torque from the top drive. When it is time to add another drill string section the top drive may be uncoupled from the drill string and uncoupled from chains 61. Track 112 may then be pivoted away from well center and the top drive may be hoisted up track 112 to a starting position for the next drill string section. The process can then be repeated for another drill string section.

A wide range of equipment may be provided on tracks 112. In some embodiments, top drives are provided on both tracks 112A and 112B such that one top drive may be hoisted to a ready-to drill position while another top drive is actively drilling. Such an embodiment provides redundancy in case one top drive requires servicing and may also provide some increase in speed. Frames 114 may be separable from mast 60 for transport.

Apparatus of the type described herein may be configured to make or break couplings between drill string sections in a wide variety of ways. Some of these are illustrated in the accompanying drawings. For example:

- Connections may be made or broken by plural make/break units that each travel around path 15 (for example connection units 14). Each of the make/break units may comprise a rotatable jaw and another jaw which may be a fixed jaw. In such embodiments a connection may be made or unmade by engaging the jaws of the make/break unit and rotating the jaws relative to one another in an appropriate direction. Such embodiments advantageously isolate reactive torques that arise from making or unmaking connections within the crosshead, avoiding the need for chains or other circulating elements to absorb the reactive torques. Such embodiments are also advantageous in that torques can be applied directly adjacent to tooljoints such that each drill string section may comprise a double (two drill string sections coupled together) without risk that the drill string sections of the double might become unintentionally separated by applied torques.
- In other embodiments a make break unit is not carried around path 15 but may be brought into engagement with tool joints of two tubulars on the front side of path 15. For example, the make/break unit may be carried on a track 112. The make break unit may travel along a portion of path 15 as a connection is being made or broken. In some embodiments the make/break unit is removably coupled to chains 61, for example using a coupling like coupling 70 while a connection is being made or broken. An advantage of this embodiment is that the equipment circulating on path 15 may be simplified. For example, connection units 14 may provide adjustable-elevation elevators without backup jaws or rotary jaws.
- In other embodiments a plurality of backup jaws are carried along path 15. One of the backup jaws may be closed to grip a drill string section against rotation. A rotary jaw may be brought into engagement with a second adjoining tubular. The rotary jaw does not need to be carried around path 15 but may be brought into engagement with a tool joint of the second tubulars on the front side of path 15. For example, the rotary jaw may be carried on a track 112. The rotary jaw may travel along a portion of path 15 as a connection is being made or broken. In some embodiments the rotary jaw is removably coupled to chains 61, for example using a coupling like coupling 70 while a connection is being made or broken.

In other embodiments a plurality of rotatable jaws are spaced apart along path 15 (for example as part of connection units 14). In such embodiments a rotary jaw of one connection unit 14 may grip one tubular and a rotary jaw of a second connection unit 14 may grip an adjacent tubular. One or both of the rotary jaws may be rotated relative to the other to make or break a connection between the tubulars. In this embodiments backup jaws are not required (although one or more backup jaws may optionally be provided, either as parts of connection units 14 or else separately positionable to selectively engage tubulars on the front side of path 15 as the tubulars are advanced along path 15).

Figure 12A:
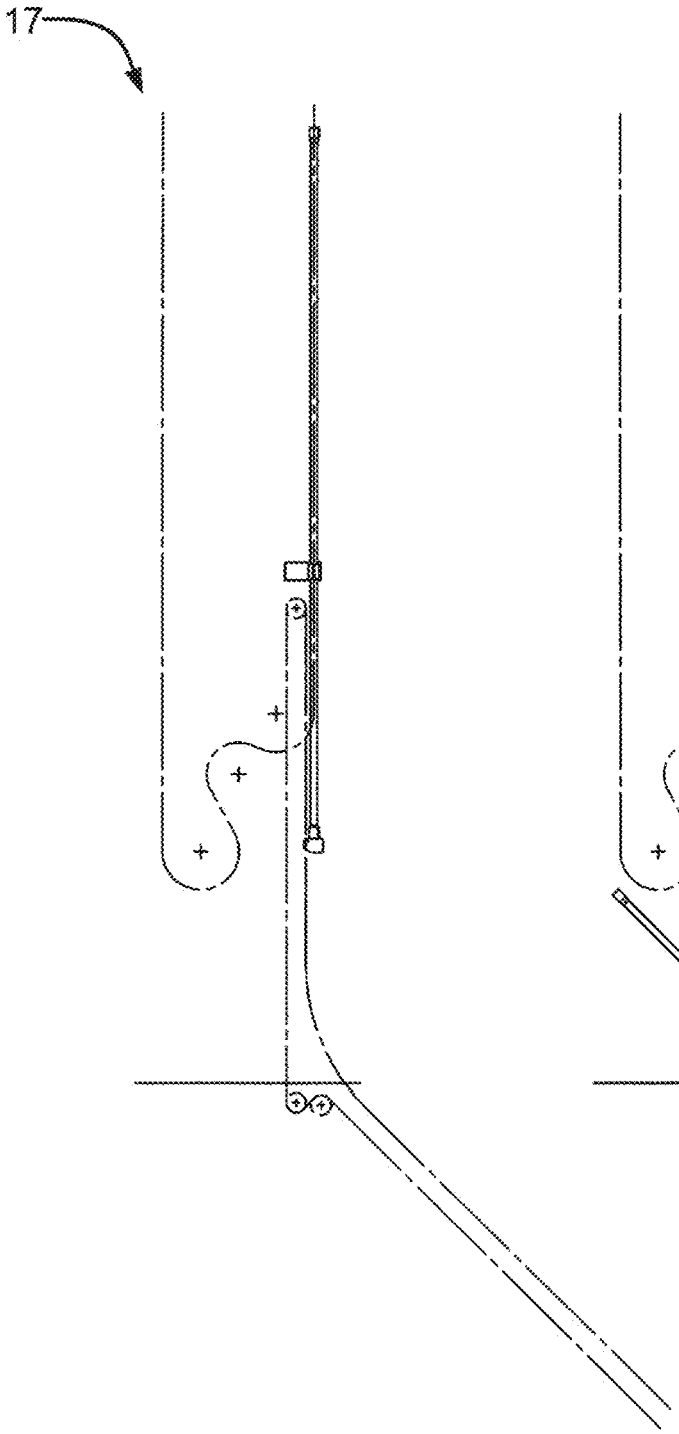
FIG. 12A is a schematic depiction of a drill string handling system according to an example embodiment.
Figure 12B:
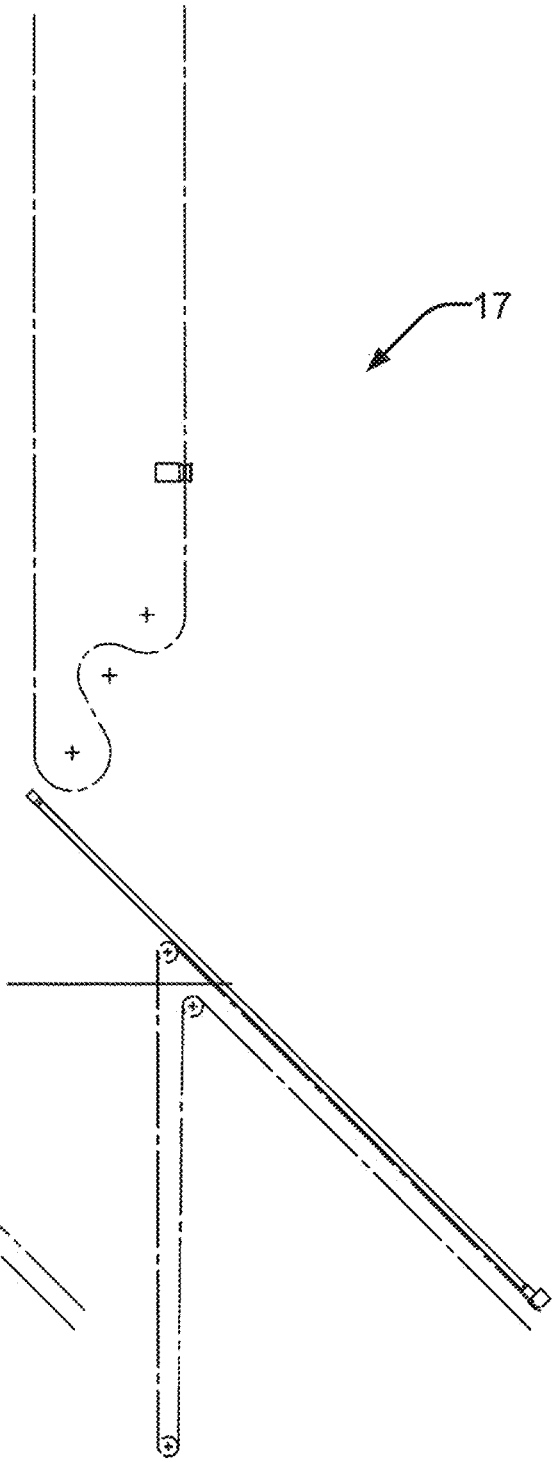
FIG. 12B is a schematic depiction of a drill string handling system according to another example embodiment.

FIGS. 12A and 12B illustrates an alternative example configuration for a pipe handling system 17. Such a pipe handling system may be reconfigurable between the configuration shown in FIG. 12A where drill string sections are passed between pipe handling system 17 and an elevator 14A below or in a lowermost part of path 15 and the configuration shown, for example, in FIG. 12B where drill string sections are passed to or from elevators 14A on a back side of path 15. The configuration of FIG. 12A may be particularly beneficial for passing to a system as described herein special purpose subs or other drill string sections that are of non-standard lengths. For example, components of a bottom hole assembly (BHA) that are shorter than standard drill string sections may be passed to an apparatus as described herein at or near well center.

Optionally, for the purpose of holding a drill string to receive special purpose or special length drill string sections, conventional slips or other apparatus for holding the drill string may be provided on the drill rig floor. In some embodiments, when it is desired to add an odd-length drill string section (typically a section shorter than other sections) or a drill string section that requires special handling, then drill string 13 may be supported by slips 121 in the drill rig floor. A drill string section 11 may then be presented at or near well center and engaged by an elevator 14A of a coupling unit 14 or an elevator of a top drive. The elevator 14A may then be lifted to bring the drill string section 11 to a vertical orientation from where it can be stabbed into the upper end of the drill string. A portion of mast 60 just above the drill rig floor may be free of cross members which would block the erection of drill string sections 11 of a desired length.

Figure 12C:
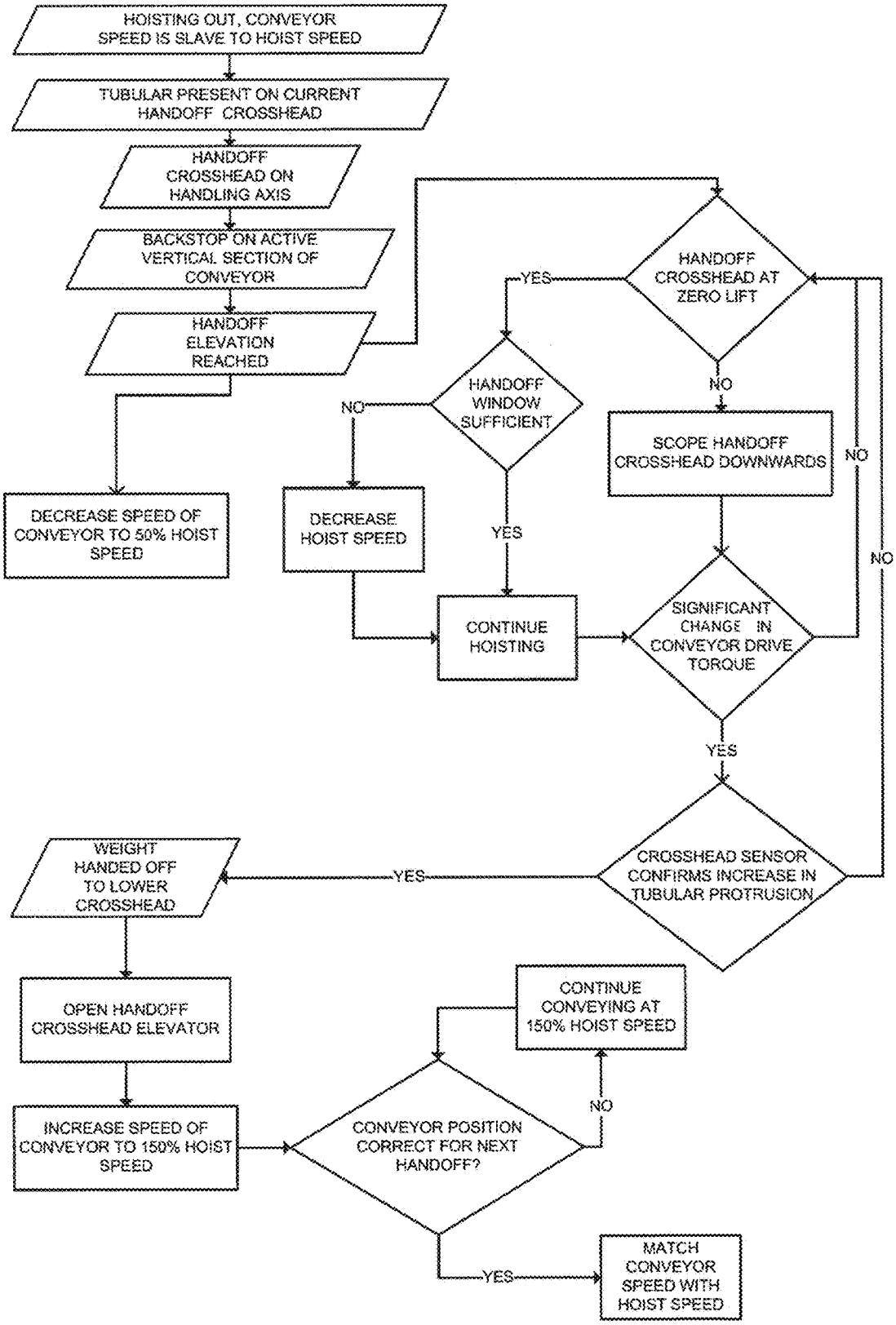
FIG. 12C is a flow chart illustrating a method for transferring a section of a drill string to a conveyor according to one example embodiment.

FIG. 12C is a flow chart illustrating a method and apparatus for transferring drill string sections 11 from apparatus 10 to pipe handling system 17 according to an example embodiment. The speed of the conveyor of pipe handling system 17 may be controlled based on the travel speed of connection units 14 around path 15. As a drill string section 11 travels along the back side of path 15C to a handoff elevation (i.e. enters the handoff zone), the conveyor speed may be decreased to a speed lower than that of connection units 14. This speed may be, for example in the range of 40% to 60% or 70% of the speed of connection units 14. In an example case the speed of a conveyor of pipe handling system 17 is reduced to approximately 50% of the speed of connection unit 14. This allows the end of a drill string section to catch up to a backstop or other surface on the conveyor.

If connection unit 14 is at zero lift, and the handoff window is sufficiently large, the speed of connection unit 14 and the conveyor is maintained until it is detected that the drill string section has landed on the conveyor backstop. This may be detected by a suitably-located sensor and/or by detecting a change in the load on the motor driving the conveyor. A significant change in the torque required to drive the conveyor can be used to indicate that the conveyor is supporting the weight of drill string section 11. If the handoff window is not sufficiently large, then the speed of connection unit 14 may be decreased. If the connection unit 14 is not at zero lift, connection unit 14 may be scoped down until a significant increase in the torque required to drive the conveyor occurs.

A sensor may optionally be provided on connection unit 14 to detect whether drill string section 11 protrudes from elevator 14A, signifying a transfer of weight to the conveyor. At this point, elevator 14A can be opened to complete the transfer of drill string section 11 to the conveyor. After the drill string section has been transferred from elevator 14A to the conveyor of pipe handling system 17 the speed of the conveyor can be increased (e.g. to 150% speed) until the conveyor is in position for the next handoff, at which point this method begins again. One exemplary benefit of this method is that the handoff can occur at any point in the handoff window and is not required to happen at a precise moment which would require tighter tolerances.

Other optional equipment that may be provided on a rig floor to handle exceptional circumstances, special drill string sections and the like include: an independent make/break machine, slips and a power tong.

During tripping out, it is common for drill string sections 11 to still contain drilling mud/fluid. Consequently, as drill string sections 11 are uncoupled, drilling mud may be released in an unwanted manner onto the drilling rig. In some embodiments, a mud can is provided to capture any drilling mud that is released upon uncoupling of drill string sections 11. The mud can surrounds a joint comprised of two adjacent drill string sections 11 as the adjacent drill string sections 11 are uncoupled and may optionally provide suction to assist in removal of any unwanted drilling mud from the joint as it is uncoupled. In some embodiments a mud can comprises a tubular body that is engaged over the top of a tubular string and is advanced sown the string without being removed from the string as tripping out progresses. Such a mud can does not need to be split. In some embodiments the mud can is passed through an open elevator (e.g. an open elevator 300 as described above).

Figure 13A:
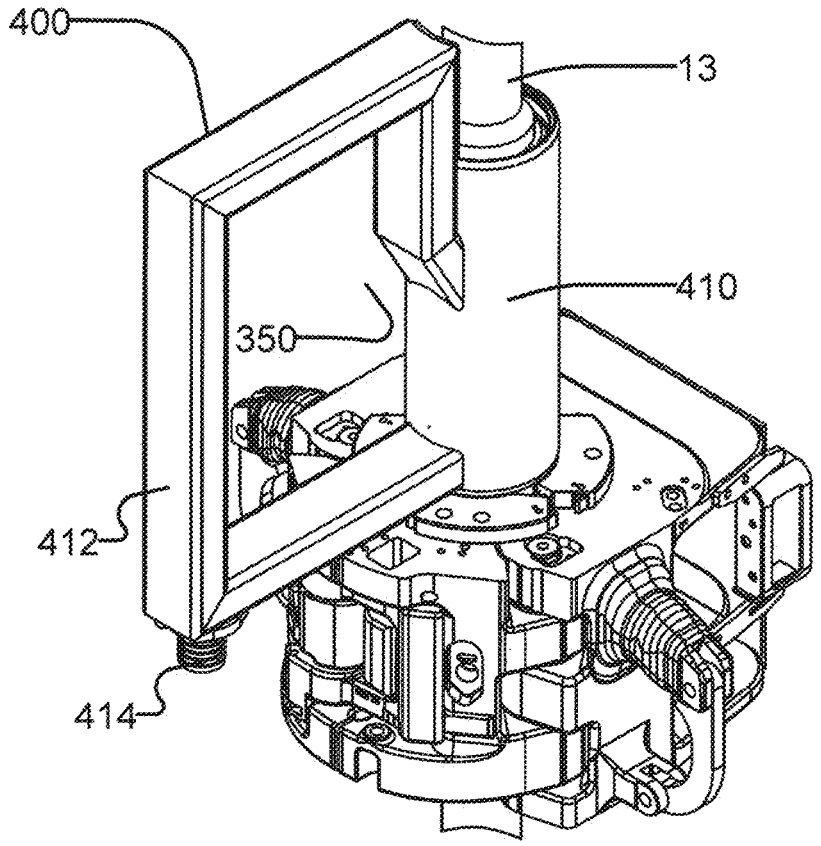
FIG. 13A is a perspective view of a mud can installed on an elevator according to an example embodiment.
Figure 13B:
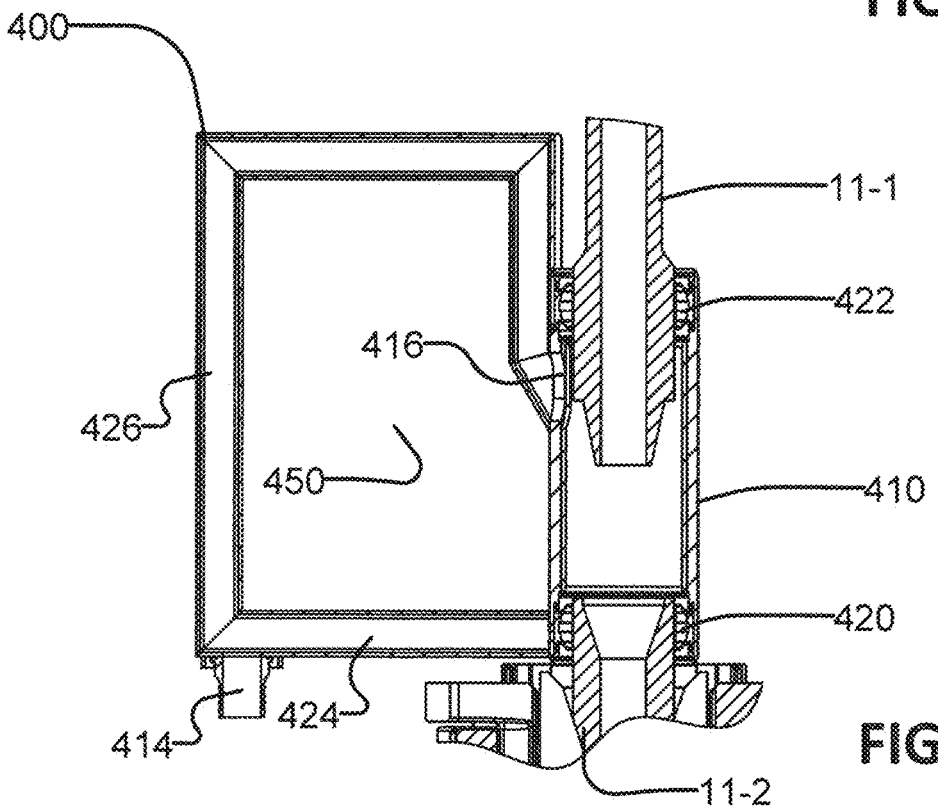
FIG. 13B is a side elevation cross-section of the mud can of FIG. 13A.

FIG. 13A depicts a mud can 400 and an elevator according to one example embodiment. Mud can 400 comprises a cylinder portion 410 and a mounting portion 412. Drill string 13 is arranged to extend through the hollow interior of 410A of cylinder portion 410 as depicted in FIGS. 13A and 13B. In use, drill string section 11-1 may be unthreaded from drill string section 11-2 without unstabbing drill string section 11-2 from drill string section 11-1, prior to sliding mud can 400 over top of the joint.

Once mud can 400 is over top of the joint, optional lower seal 420 and upper seal 422 may be expanded (e.g. inflated or mechanically expanded) (as depicted in FIG. 13B) to seal the mud can to the tubulars and prevent mud spillage. A vacuum connection may be attached to outlet 414 to provide suction through upper conduit 426 to suction inlet 416. Drilling mud is then suctioned out of drill string section 11-2, through suction inlet 416, upper conduit 426 and out via outlet 414. Outlet 414 may be plumbed to the mud tanks, either with gravity drainage or optionally with suction assist via a vacuum pump.

Figure 13C:
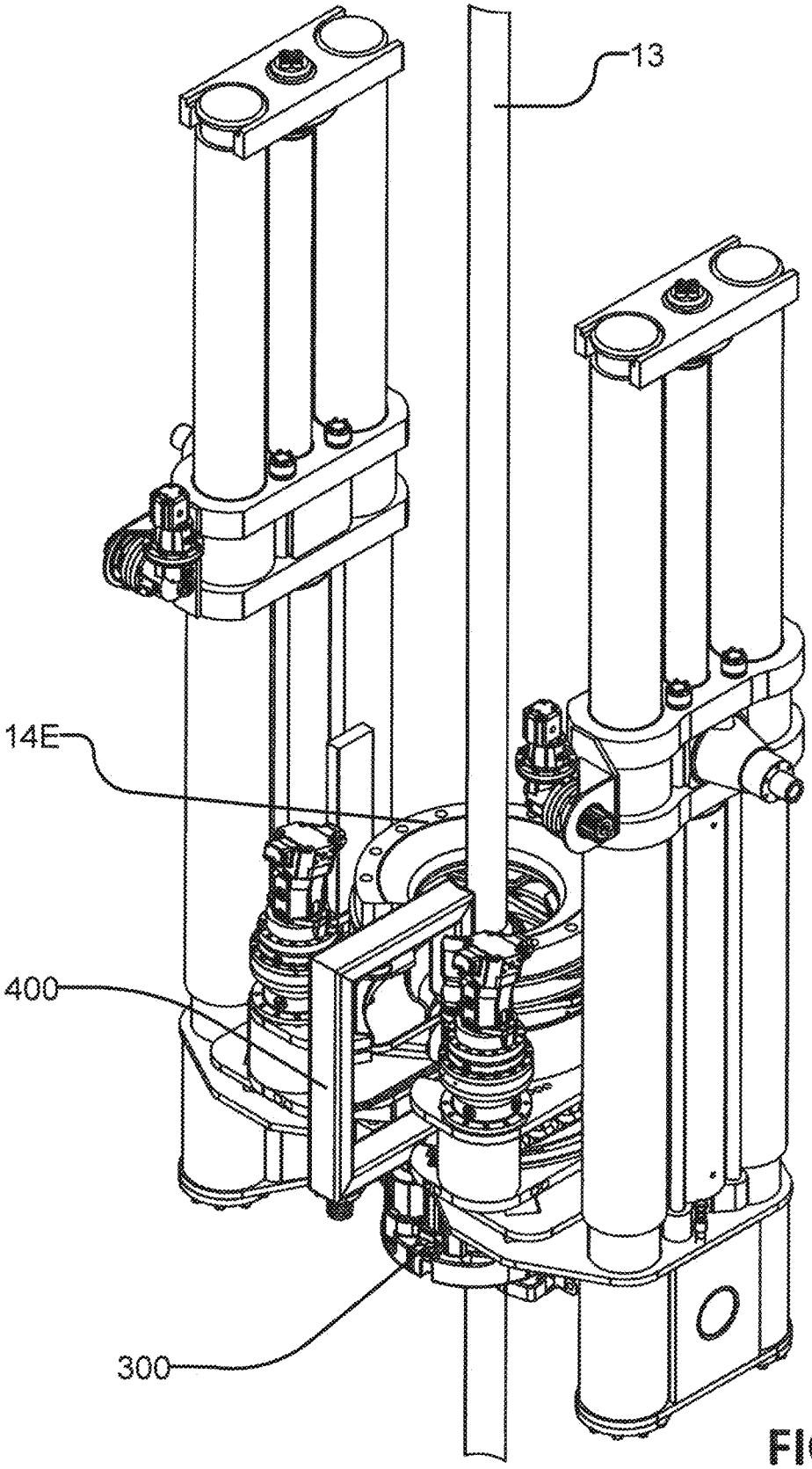
FIG. 13C is a perspective view of the mud can of FIG. 13A installed on a connection unit according to an example embodiment.

As best depicted in FIG. 13C, a mud can 400 may be configured in such a manner that rotatable jaw 14E may still be caused to rotate when mud can 400 is installed over a tool joint. In the illustrated embodiment, mounting 412 is shaped to permit rotatable jaw 14E to rotate through space 450 in mounting 412. This may allow longer drill string sections 11 to be employed.

Returning to FIG. 2G, as a connection unit 14 passes over top end of path 15B, it translates laterally (i.e. from left to right, as illustrated in FIG. 2G). To allow for this horizontal translation, it may sometimes be beneficial for the opening of rotatable jaw 14E to face toward the inside of path 15 (i.e. rotated 180° as compared to FIG. 11C). In this way, connection zone 20 is effectively elongated.

Figure 13D:
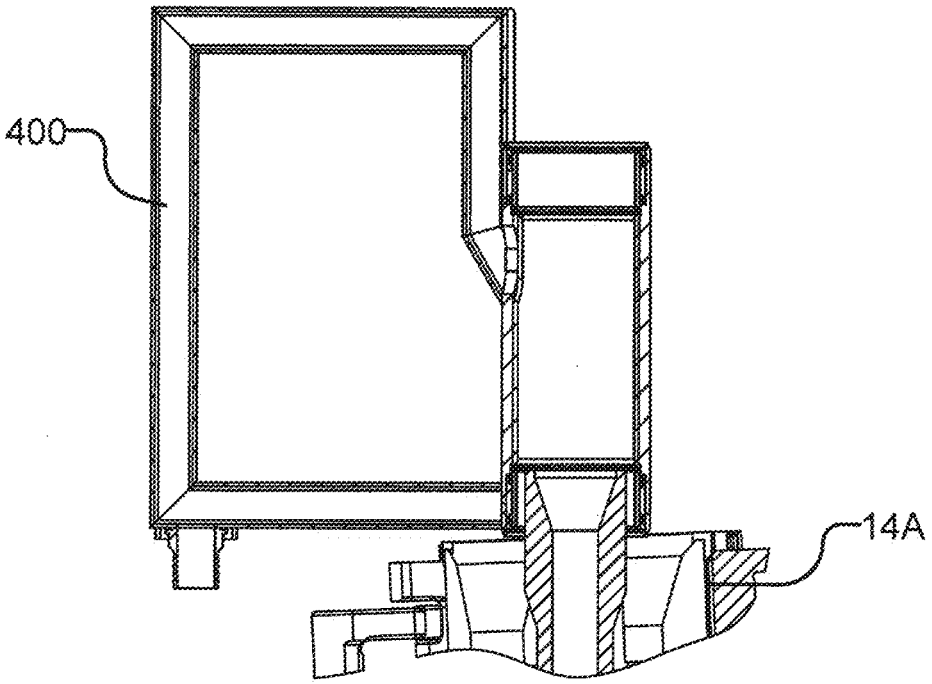
FIG. 13D is a side elevation cross-section of the mud can of FIG. 133A installed on a tilted elevator according to can example embodiment.
Figure 13E:
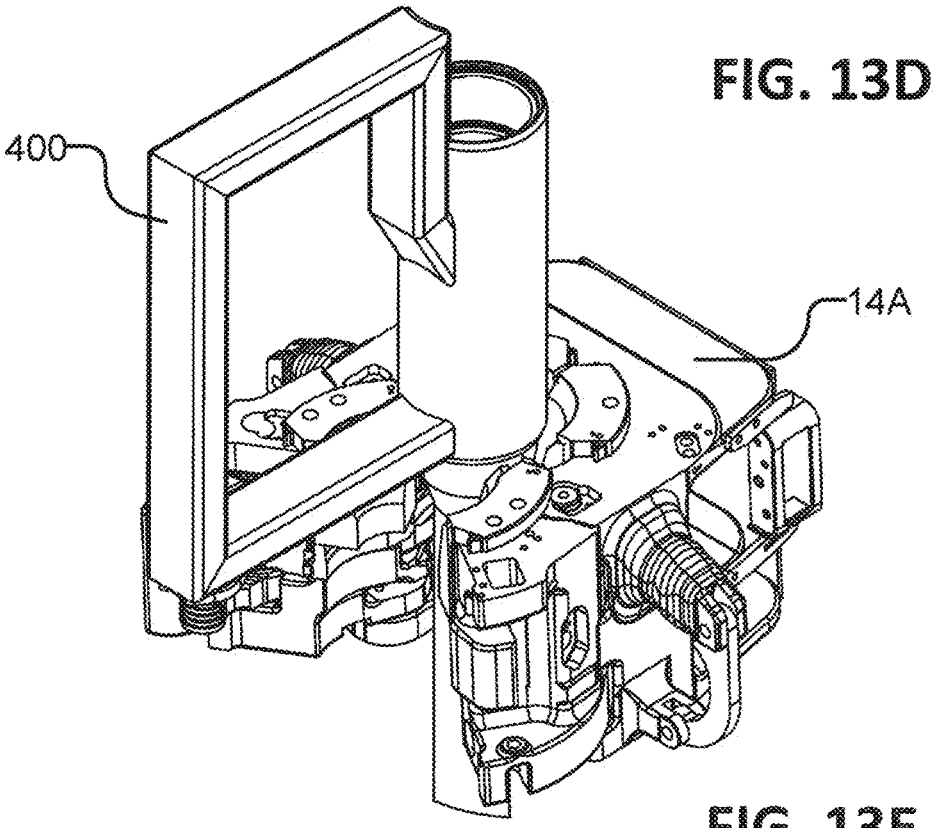
FIG. 13E is a perspective view of the mud can of FIG. 13A installed on a tilted elevator according to can example embodiment.
Figure 13F:
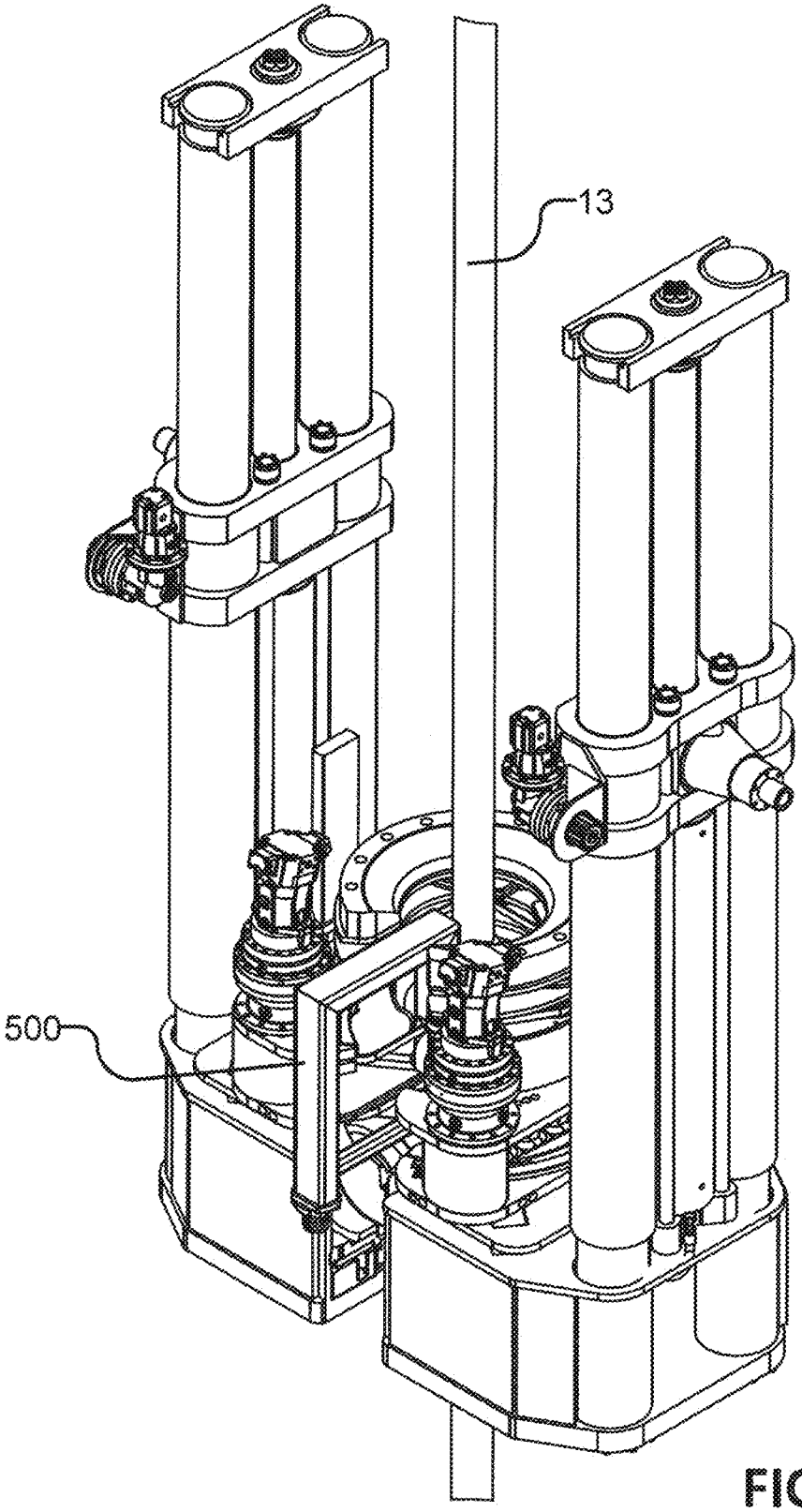
FIG. 13F is a perspective view of a mud can installed on a connection unit according to another example embodiment.

Once drill string section 11-1 and 11-2 have been uncoupled and mud can 400 has finished its job, mud can 400 may be translated down drill string 13 to the next joint (i.e. between drill string section 11-2 and 11-3). In some embodiments, seals 420 and 422 are first deflated (as depicted in FIG. 13D). In some embodiments, cylinder 410 of mud can 400 connection unit 14 may be tilted to allow mud can 400 to pass as illustrated in FIGS. 13D and 13E. The angle of tilt may depend on the geometry of mud can 400 and connection unit 14. For example, the angle of title may be between 2° and 10°. In a specific example embodiment, the angle of tilt is approximately 2.5°.

FIGS. 13F through 13J depict an example mud can 500. Mud can 500 is generally similar to mud can 400 except that it is designed to be used with elevator 300. As compared to mud can 400, lower conduit 524 of mud can 500 is thinner than lower conduit 424 of mud can 400 and seals 420, 422 are not present. Mud can 500 is particularly useful in cases where an elevator provides a face seal against which the lower edge of mud can 500 may be sealed. The reduced diameter of mud can 500 facilitates passage of mud can 500 through elevator 300 when elevator 300 is in its open configuration.

Figure 13G:
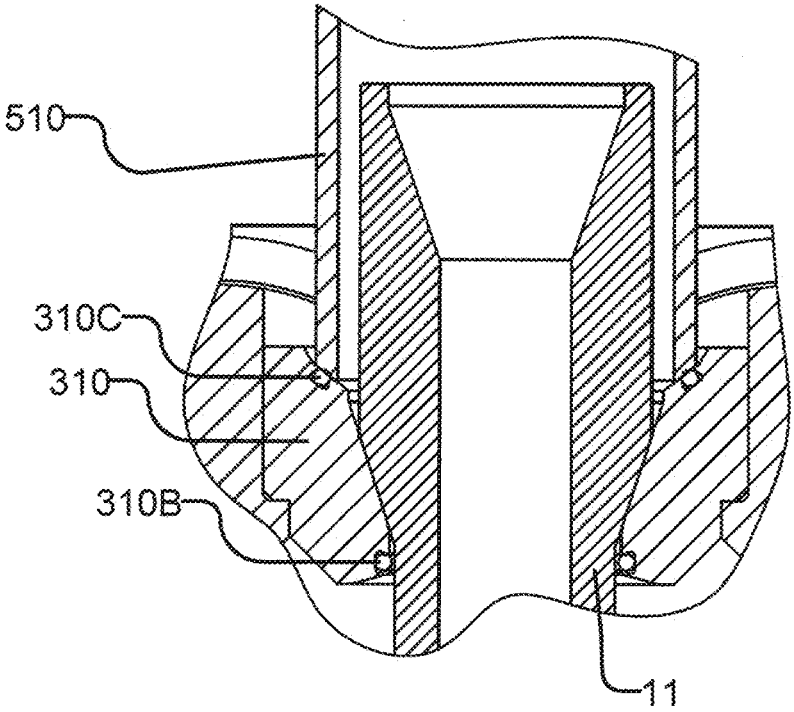
FIG. 13G is a partial cross-section of the mud can of FIG. 13F installed on an elevator.
Figure 13H:
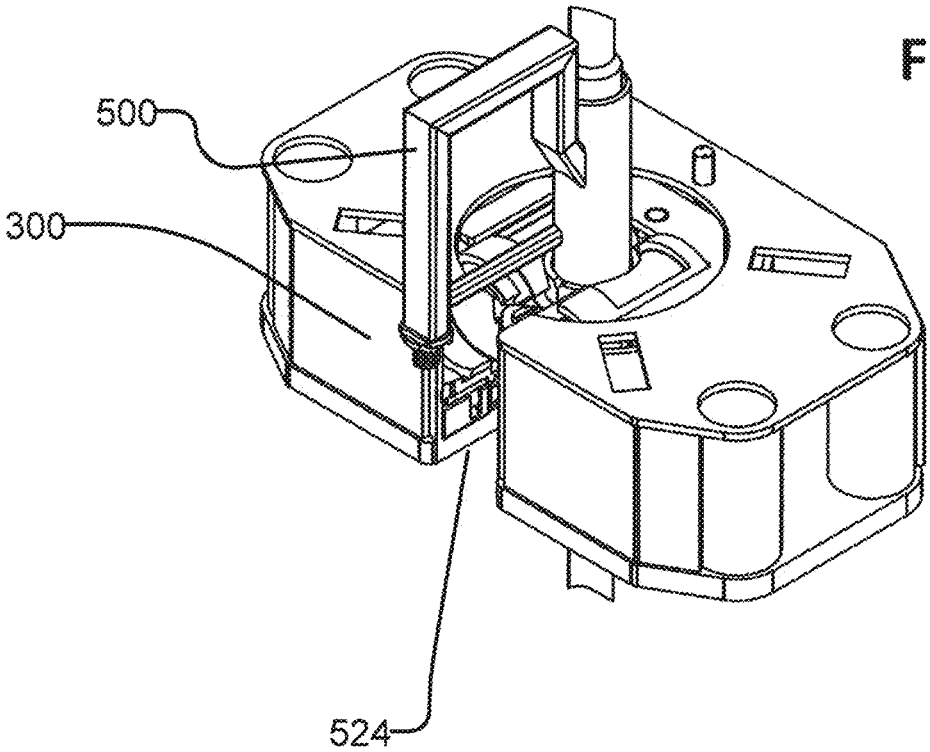
FIG. 13H is a perspective view of the mud can of FIG. 13F installed on an elevator in the closed position.
Figure 13I:
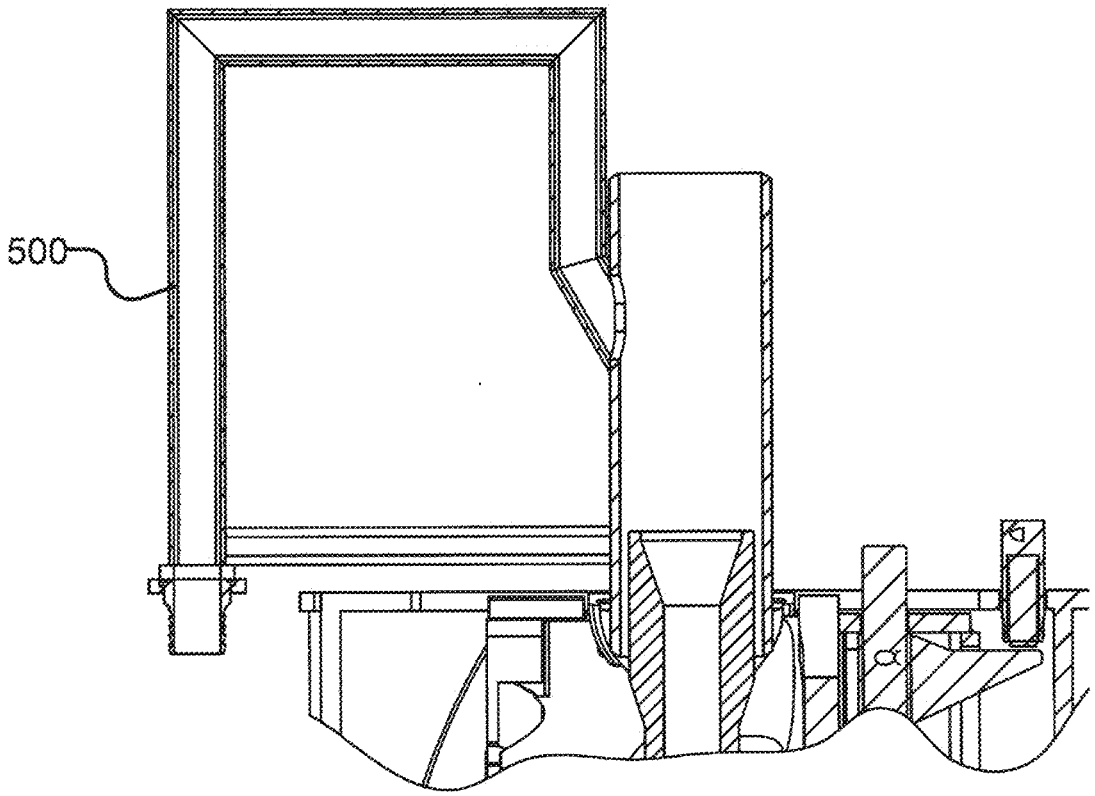
FIG. 13I is a side elevation cross-section of the mud can of FIG. 13F installed on an elevator.
Figure 13J:
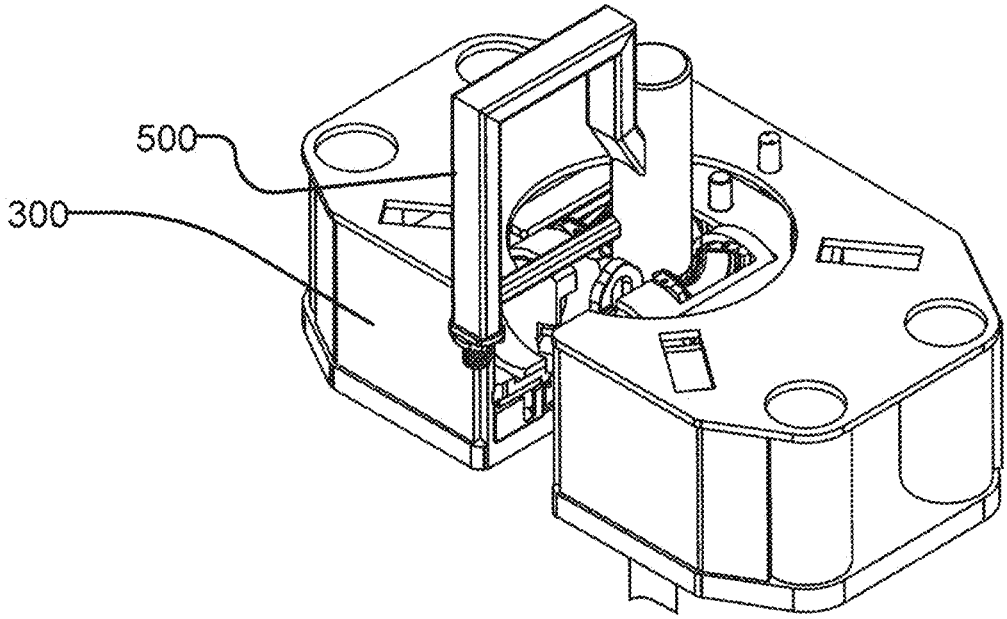
FIG. 13J is a perspective view the mud can of FIG. 13F installed on an elevator in the open position.

Mud can 500 may be operated in a similar manner as mud can 400. However, mud can 500 does not require tilting of connection unit 14 since the throat of elevator 300, in its open position as discussed herein, is sufficiently wide for mud can 500 to pass through, as best seen in FIGS. 13I and 13J.

In some embodiments, mud can 500 does not include seals 420, 422. Instead, mud can 500 may seal against collars 310 of elevator 300 to prevent drilling fluid from escaping. In particular, collars 310 may comprise seals 310B and 310C as depicted in FIG. 13G. Seal 310B may be arranged to seal against drill string section 11 while seal 310 may be arranged to abut and seal against mud can 500. Seals 310B, 310C may comprise any suitable sealing material such as a polymer or rubber. In some embodiments 310B, 310C comprise o-rings while in other embodiments, they are molded into collars 310.

Some embodiments provide significant safety advantages as compared to other drilling systems. These safety advantages may include:

- movements of the apparatus are relatively slow, continuous and predictable;
- human operators can remain safely out of harm's way. No human is required in a derrickman or equivalent position;
- heavy elements do not need to be supported by wire lines which can fail as a result of fatigue;
- tubulars being handled may always be supported by positive supports (e.g. elevators) as opposed to grips of types which are susceptible to failure.

Some advantages of certain embodiments include one or more of:

- Relatively high tripping speed (e.g. a nominal trip speed 5400 ft/hr, twice that of a conventional triple).
- Slow travel speeds that are continuous or nearly continuous as opposed to intermittent much faster travel speeds. For example, travel speed may be in the range of 1 to 2 feet/second in some embodiments—e.g. 1.5 ft/sec. Lower peak speeds may reduce damage to the wellbore and/or the drill string. Lower peak speeds may also reduce or substantially eliminate surge & swab pressures—resulting in safer operations.
- Full speed tripping may be achieved even in open hole. Where prior art systems are limited to reduced speeds (e.g. 1 min/stand hoist speed) by the need to reduce swab pressures, example embodiments may achieve average speeds of 2.5-3 times that of a conventional triple.
- Reduced peak power requirement for hoisting.
- No slip damage to drill pipe.
- Connection time 60-90 sec (pump off to pump on) while drilling.
- Keeping the drill string moving while making or breaking connections reduces the risk of stuck pipe.
- Bit farther off bottom on connections—reduced stuck pipe risk.
- Since the top drive is not needed for tripping the top drive may be serviced while tripping is happening. The servicing may be performed at a convenient location at or near the rig floor in some cases.
- All hoisting elements (e.g. chains 61) may have indefinite life as opposed to wirelines and their sheaves which tend to wear significantly and require replacement relatively often.
- Supports automation:
  - Continuous motion, no stop/start/ramp/dock management in the normal cycle.
  - Fast cycle without doing anything fast.
  - Handling degrees of freedom minimized.
  - Reduced hand-off requirements.
  - No manual operations required.
  - No split detection required.
  - Easy, reliable & precise vertical position instrumentation.
  - No slip-setting unknowns.
- Excellent land rig mobility.
- Avoids the mobility/separability challenge of the wireline (connected to 5 different rig components).
- Pulldown capable—underbalanced drilling or casing push.
- Clear vertical access through the top drive.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

While processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A method for tripping a tubular string, the method comprising:

providing a circulating member supporting a plurality of elevators moving the circulating member to cause the elevators to circulate along a closed path;

while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators wherein the tubular string comprises a plurality of sections coupled at tool joints, the first location comprises a first tool joint and the second location comprises a second tool joint; and after transferring the weight of the tubular string to the second one of the elevators, unmaking a connection of a tubular string section containing the first tool joint from a tubular string section containing the second tool joint;

wherein a make break unit is carried together with each one of the elevators and unmaking the connection is performed by the make break unit corresponding to the second one of the elevators.

2. The method according to claim 1 wherein unmaking the connection comprises gripping the second tool joint with a backup jaw, gripping the tubular string section with a rotary jaw and turning the rotary jaw relative to the backup jaw.

3. A method for tripping a tubular string, the method comprising:

providing a circulating member supporting a plurality of elevators moving the circulating member to cause the elevators to circulate along a closed path;

while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators wherein the tubular string comprises a plurality of sections coupled at tool joints, the first location comprises a first tool joint and the second location comprises a second tool joint;

after transferring the weight of the tubular string to the second one of the elevators, unmaking a connection of a tubular string section containing the first tool joint from a tubular string section containing the second tool joint wherein unmaking the connection is performed while moving the circulating member such that the second one of the elevators lifts the tubular string while the connection is unmade; and after unmaking the connection, transferring the tubular string section to a pipe handling system;

wherein transferring the tubular string section to the pipe handling system comprises carrying the tubular string section to a backside of the path and, on the backside of the path, transferring the tubular string section to the pipe handling system.

4. The method according to claim 3 wherein transferring the tubular string section to the pipe handling system comprises lowering a bottom end of the tubular string section onto an end stop of the pipe handling system and allowing relative motion of the first one of the elevators and the end stop to lift the first tool joint relative to the first one of the elevators.

5. The method according to claim 4 comprising, while lowering the bottom end of the tubular string section onto the end stop, moving the end stop in a generally downward direction.

6. A method for tripping a tubular string, the method comprising:

providing a circulating member supporting a plurality of elevators moving the circulating member to cause the elevators to circulate along a closed path;

while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators wherein the tubular string comprises a plurality of sections coupled at tool joints, the first location comprises a first tool joint and the second location comprises a second tool joint; and before transferring the weight of the tubular string to the second one of the elevators, making a connection of a tubular string section containing the first tool joint to a tubular string section containing the second tool joint;

wherein the tubular string section containing the second tool joint is delivered from a back side of the circulating member.

7. The method according to claim 6 wherein making the connection is performed while moving the circulating member such that the first one of the elevators lowers the tubular string while the connection is being made.

8. A method for tripping a tubular string, the method comprising:

providing a circulating member supporting a plurality of elevators moving the circulating member to cause the elevators to circulate along a closed path;

while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators wherein the tubular string comprises a plurality of sections coupled at tool joints, the first location comprises a first tool joint and the second location comprises a second tool joint; and before transferring the weight of the tubular string to the second one of the elevators, making a connection of a tubular string section containing the first tool joint to a tubular string section containing the second tool joint;

wherein a make break unit is carried together with each one of the elevators and making the connection is performed by the make break unit corresponding to the second one of the elevators.

9. The method according to claim 8 wherein the tubular string section containing the second tool joint is delivered from below the circulating member.

10. A method for tripping a tubular string, the method comprising:

providing a circulating member supporting a plurality of elevators moving the circulating member to cause the elevators to circulate along a closed path;

while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators;

wherein the tubular string comprises a plurality of sections coupled at tool joints, the first location comprises a first tool joint and the second location comprises a second tool joint; and while supporting the tubular string on the first one of the plurality of elevators:

connecting a top drive to the circulating member and connecting a quill of the top drive to a coupling at an uphole end of the tubular string;

transferring the weight of the tubular string to the top drive;

with the quill of the top drive coupled to the uphole end of the tubular string, operating the top drive to drive or hold the tubular string to advance the borehole while moving the circulating member;

transferring the weight of the tubular string back to the first one of the plurality of elevators;

disconnecting the quill of the top drive from the tubular string; and disconnecting the top drive from the circulating member.

11. The method according to claim 10 wherein connecting the top drive to the circulating member comprises connecting the top drive to a structure coupling one of the elevators to the circulating member.

12. The method according to claim 10 comprising, while supporting the tubular string on the first one of the plurality of elevators, operating the circulating member move the tubular string in the borehole.

13. The method according to claim 12 wherein the movement comprises reciprocation.

14. A method for tripping a tubular string, the method comprising:

providing a circulating member supporting a plurality of elevators moving the circulating member to cause the elevators to circulate along a closed path; and while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators;

wherein the tubular string comprises a plurality of sections coupled at tool joints, the first location comprises a first tool joint and the second location comprises a second tool joint;

wherein the elevators are suspended from pivotal couplings that connect the elevators to the circulating member and the method comprises allowing the pivotal couplings to pivot as the circulating member carries the elevators around the path.

15. The method according to claim 14 wherein transferring the weight of the tubular string onto the second one of the elevators comprises moving the elevators relative to one another.

16. The method according to claim 14 comprising, while transferring the weight of the tubular string to the second one of the elevators moving the tubular string longitudinally at a speed in the range of 0 to 5 feet/sec in either direction.

17. The method according to claim 14 wherein the circulating member comprises a pair of parallel chain loops supported for circulation on a tower.

18. The method according to claim 17 wherein moving the circulating member to cause the elevators to circulate along the closed path comprises driving each of the pair of parallel chain loops with a drive sprocket.

19. A method for tripping a tubular string, the method comprising:

providing a circulating member supporting a plurality of elevators moving the circulating member to cause the elevators to circulate along a closed path;

while moving the circulating member, engaging a first location on the tubular string with a first one of the elevators, supporting a weight of the tubular string on the first one of the elevators, supporting a second location of the tubular string with a second one of the elevators, and transferring the weight of the tubular string to the second one of the elevators wherein the tubular string comprises a plurality of sections coupled at tool joints, the first location comprises a first tool joint and the second location comprises a second tool joint;

after transferring the weight of the tubular string to the second one of the elevators, unmaking a connection of a tubular string section containing the first tool joint from a tubular string section containing the second tool joint; and before unmaking the connection:

passing the tubular string through a cavity of a mud can;

locating the mud can substantially surrounding the connection;

draining drilling fluid released by unmaking the connection from the cavity of the mud can; and after unmaking the connection, moving the mud can past the second one of the plurality of elevators without removing the mud can from the tubular string.

20. Drilling apparatus comprising:

a tower;

a pair of parallel chain loops supported for circulation on the tower;

a drive connected to circulate the chain loops;

a plurality of crossheads connected pivotally between the chain loops at spaced-apart locations along the chain loops, each of the crossheads supporting an elevator for a tubular string; and one or more actuators coupled to adjust an elevation of each elevator relative to the chain loops.

21. Drilling apparatus according to claim 20 wherein the elevators are mounted for rotation relative to the crossheads, a center of rotation of the elevator corresponding to a centerline of a tubular string section supported by the elevator.

22. Drilling apparatus according to claim 20 comprising a mud can, the mud can comprising:

a hollow cylinder;

a mounting in fluid connection with a cavity of the hollow cylinder; and an outlet for draining the hollow cylinder;

wherein the mud can is locatable surrounding a tubular string connection while the connection is uncoupled to collect drilling fluids that are thereby released.

23. Drilling apparatus according to claim 20 wherein the chain loops are supported by a pair of top sprockets at a top end of a path followed by the chain loops and wherein the tower is constructed to provide an opening between the top sprockets, the opening extending vertically from a location above the tops of the top sprockets by a distance sufficient to pass a tubular string section suspended by the elevator of one of the crossheads while a point of attachment of the crosshead to the chain loops is passing over the top sprockets.

24. Drilling apparatus according to claim 23 wherein the opening extends vertically by a distance of at least 10 meters downward from top edges of the top sprockets.

25. Drilling apparatus according to claim 20 wherein each of the crossheads comprises first and second pivotal couplings respectively coupled to the first and second chain loops and a platform suspended from the first and second pivotal couplings, the platform having an opening extending from an edge of the platform to a location directly below a pivot axis of the couplings.

26. Drilling apparatus according to claim 25 comprising an actuator connected to tilt the crosshead about the pivot axis of the pivotal couplings.

27. Drilling apparatus according to claim 25 wherein the platform is suspended from each of the pivotal couplings by a corresponding extendable beam.

28. Drilling apparatus according to claim 27 wherein the extendable beam is telescoping.

29. Drilling apparatus according to claim 25 wherein the platform is suspended from each of the pivotal couplings by one of the one or more actuators.

30. Drilling apparatus according to claim 25 wherein the platform is coupled to the pivotal couplings by linear rails that are attached to the platform and are slidably coupled to the pivotal couplings.

31. Drilling apparatus according to claim 25 wherein each side of the platform is coupled to a corresponding one of the pivotal couplings by a pair of spaced-apart linear rails.

32. Drilling apparatus according to claim 31 wherein the linear rails extend through guide tubes attached to the pivotal couplings and the guide tubes include spaced-apart bushings or bearings.

33. Drilling apparatus according to claim 31 wherein one of the one or more actuators is located between the linear rails of each of the pairs of linear rails.

34. Drilling apparatus according to claim 33 wherein the actuators act on bridges coupling the linear rails of each of the pairs of linear rails to selectively raise the platform toward, or lower the platform away, from the pivot axis of the couplings.

35. Drilling apparatus according to claim 25 wherein each of the chain loops comprises opposing longitudinally-extending plates coupled by transversely-extending pins and the pivotal couplings each comprise one of the pins being a hollow pin having a bore extending longitudinally through the pin.

36. Drilling apparatus according to claim 35 wherein the transversely-extending pins comprise rollers.

37. Drilling apparatus according to claim 35 wherein the pivotal coupling comprises a spigot for supporting the elevator and the spigot is pivotally coupled to the hollow pin by coupling in the bore of the hollow pin.

38. Drilling apparatus according to claim 37 wherein the pivotal coupling comprises a spherical bearing located in the bore between the plates, and the spigot is coupled to the hollow pin by the spherical bearing.

39. Drilling apparatus according to claim 37 comprising a passage extending through the spigot in at least one of the pivotal couplings, the passage connected to supply power to one or more devices supported on the crossheads.

40. Drilling apparatus according to claim 39 wherein the passage exits substantially on an axial centerline of the spigot, the drilling apparatus comprising a rotary coupling connected to fluidly couple the passage to a hydraulic conduit extending along the chain.

41. Drilling apparatus according to claim 20 comprising a top drive, the top drive comprising a quill operable to drive rotation of a tubular string, the top drive comprising first and second couplings respectively operable to detachably couple the top drive to the first and second chain loops.

42. Drilling apparatus according to claim 41 comprising a track extending parallel to the chain loops wherein the top drive is slidably mounted to the track and the track is pivotally coupled to the tower for rotation about a generally vertical axis.

43. Drilling apparatus according to claim 41 wherein the chain loops each comprise transversely-extending longitudinally spaced apart pins and the first and second couplings each comprise a rotatable member projecting from the top drive and engageable between adjacent pins of one of the chain loops, an end of the rotatable member having opposed projecting ears wherein a dimension between outer edges of the ears exceeds a spacing between the adjacent pins.

44. Drilling apparatus according to claim 43 wherein the transversely-extending longitudinally spaced apart pins comprise rollers.

45. Drilling apparatus according to claim 43 wherein ends of the rotatable members are formed to taper in a direction at right angles to the projection of the ears.

46. Drilling apparatus according to claim 43 wherein surfaces of the rotatable member inward from the ears are radiused to match a radius of curvature of the pins.

47. Drilling apparatus according to claim 46 wherein the ears comprise radii in two planes creating a compound curved surface of contact with the pins.

48. Drilling apparatus according to claim 41 comprising a track extending parallel to the chain loops wherein the top drive is slidably mounted to the track and the track is movably coupled to the tower.

49. Drilling apparatus according to claim 48 comprising a hoist coupled to the top drive and operative to lift the top drive up the track.

50. Drilling apparatus according to claim 20 wherein the drive is connected to drive the chain loops by drive sprockets that engage exterior sides of the chain loops.

51. Drilling apparatus according to claim 50 wherein the drive sprockets are each located between a pair of idler sprockets, the idler sprockets mounted in an interior of the corresponding chain loop.

52. Drilling apparatus according to claim 20 wherein the drive comprises first and second drive motors respectively coupled to drive the first and second chain loops and wherein the two drive motors are synchronized.

53. Drilling apparatus according to claim 52 wherein the two drive motors are electronically synchronized.

54. Drilling apparatus according to claim 52 wherein the two drive motors are mechanically synchronized.

55. Drilling apparatus according to claim 54 wherein the two drive motors are synchronized by a common rotating shaft connected to rotate with each of the two drive motors.

56. Drilling apparatus according to claim 20 wherein the chain loops follow parallel paths and each of the paths has a straight section.

57. Drilling apparatus according to claim 56 wherein the straight section is at least 50 feet in length.

58. Drilling apparatus according to claim 56 wherein a midline between the chain loops in the straight section is substantially aligned with a wellbore.

59. Drilling apparatus according to claim 58 wherein the straight section is at least as long as a tubular string section.

60. Drilling apparatus according to claim 20 wherein the chain loops carry four crossheads and the four crossheads are substantially equally spaced apart along the chain loops.

61. Drilling apparatus according to claim 60 wherein the crossheads are spaced apart along the chain loops by distances comprising a multiple of a length of tubular string sections employed by the drilling apparatus.

62. Drilling apparatus according to claim 20 wherein one or more of the elevators comprises:

first and second support members each pivotally mounted to a base for rotation about respective horizontal pivot axes, the first and second support members pivotally rotatable about their respective horizontal pivot axes between:

a joint-supporting configuration wherein portions of adjoining edges of the first and second support members each define a corresponding portion of an aperture dimensioned to pass a generally vertical drill pipe extending along a centerline and a top face of each of the first and second members defines a corresponding portion of a joint-supporting surface extending peripherally around the aperture for supporting a tubular string section; and an open configuration wherein the top faces of each of the first and second support members are spaced apart from one another by a distance sufficient to pass a vertical drill pipe extending along the centerline; and wherein the base and the first and second support members in the open configuration define an opening dimensioned to allow a vertical tubular string section to be passed from an outside edge of the base to the centerline when the support members are in the open configuration.

63. Drilling apparatus according to claim 62 wherein the elevator is mounted to the crosshead for rotation about a generally vertical axis centered relative to the aperture.

64. Drilling apparatus according to claim 20 comprising a control system connected to control the actuators to transfer weight of a supported tubular string from one of the elevators to a next one of the elevators, the control system comprising a programmable controller, an interface connecting the programmable controller to operate the actuators to selectively raise or lower each of the elevators and load sensors operative to supply signals to the programmable controller, the load signals indicative of loads being carried by each of the elevators.

65. Drilling apparatus according to claim 64 wherein the actuators comprise hydraulic actuators and the load sensors comprise pressure sensors connected to measure pressure of hydraulic fluid in the hydraulic actuators.

* * * * *